US007591108B2

(12) United States Patent
Tuczek

(10) Patent No.: US 7,591,108 B2
(45) Date of Patent: Sep. 22, 2009

(54) DOUBLE-CURVED SHELL

(75) Inventor: Florian Tuczek, Sebastian-Bach-Strasse 36, Leipzig (DE) 04109

(73) Assignee: Florian Tuczek, Leipzig (DE)

( * ) Notice: Subject to any disclaimer, the term of this patent is extended or adjusted under 35 U.S.C. 154(b) by 26 days.

(21) Appl. No.: 11/766,219

(22) Filed: Jun. 21, 2007

(65) Prior Publication Data

US 2007/0251161 A1 Nov. 1, 2007

Related U.S. Application Data

(63) Continuation of application No. PCT/EP2005/012450, filed on Nov. 21, 2005.

(30) Foreign Application Priority Data

Dec. 21, 2004 (DE) ..... 10 2004 061 485

(51) Int. Cl.
*E04B 7/00* (2006.01)

(52) U.S. Cl. ..... 52/80.1; 52/80.2; 52/81.4; 52/81.5

(58) Field of Classification Search ..... 52/80.1–81.6, 52/2.11–2.26, 745.07
See application file for complete search history.

(56) References Cited

U.S. PATENT DOCUMENTS 2,682,235 A 6/1954 Fuller (Continued)

FOREIGN PATENT DOCUMENTS

DE 37 15 228 11/1988

(Continued)

OTHER PUBLICATIONS

Huybers, P. et al., "Polyhedral Sphere Subdivisions," in Spatial Structures: Heritage, Present and Future, G.C. Giuliani, International Association for Shell and Spatial Structures International Symposium, Mailand, 1955, p. 196, Fig. 13.

(Continued)

*Primary Examiner*—Richard E Chilcot, Jr.
*Assistant Examiner*—Matthew J. Smith
(74) *Attorney, Agent, or Firm*—Darby & Darby

(57) ABSTRACT

Triangulated shells can be free-formed but are uneconomical compared to translational shells that can only be flat. Scale-trans shells are limited in terms of number and arrangement of the openings. The present invention provides a free-formed, custom-tailored shell surface and a regularly shaped, mass-produced shell surface that can be assembled fairly evenly from advantageously quadrangular mesh elements having coplanar node points. The flexibility of a triangle net of shell pieces in a large scale is combined with the evenness of a quad net for meshes in a small scale, whereby triangular meshes at the shared side of adjoining square nets are combined in pairs to give irregular quadrangular meshes having coplanar vertices. The inventive shell is especially suitable for use as an energy-saving building such as a weekend home, emergency shelter, cupola of an observatory, roof of a building or an inner courtyard, as the shell of a large multi-story building or as a sports hall or factory building. It is also suitable as a part of a vault, and as a complex shell consisting of a single continuous surface for exhibition or station buildings. Parts of a Bohemian dome, cushion-roof, Isler shell or blob can be combined within any individual shell.

29 Claims, 21 Drawing Sheets

U.S. PATENT DOCUMENTS

| | | | | | |
|---|---|---|---|---|---|
| 2,891,491 | A | * | 6/1959 | Richter | 52/80.1 |
| 3,206,895 | A | * | 9/1965 | De Ridder et al. | 52/80.2 |
| 3,751,862 | A | * | 8/1973 | Linecker | 52/80.1 |
| 3,798,849 | A | * | 3/1974 | Biggs et al. | 52/80.2 |
| 3,958,375 | A | * | 5/1976 | Tully | 52/80.2 |
| 4,115,486 | A | * | 9/1978 | Cowman, Jr. et al. | 52/80.2 |
| 4,685,257 | A | * | 8/1987 | Richter | 52/80.2 |
| 4,858,397 | A | | 8/1989 | Lantz | |
| 5,524,396 | A | * | 6/1996 | Lalvani | 52/81.1 |
| 6,912,488 | B1 | * | 6/2005 | Saebi | 52/745.07 |

FOREIGN PATENT DOCUMENTS

| | | |
|---|---|---|
| FR | 814 505 | 6/1937 |

OTHER PUBLICATIONS

Lalvani, H., "Transpolyhedra: Dual Transformations by Explosion—Implosion," Papers in Theoretical Morphology 1, New York, 1977 Published by Heresh Lalvani, Library of Congress Card No. 77—81420, p. 67, Fig. 8 of "plate 27"; p. 19 and p. 60.

Bach, Klaus, and Burkhardt, Berthold, and Otto, Frei, "Mitteilungen des Instituts für leichte Flächentragwerke", N°. 18, (IL 18) Forming Bubbles, Stuttgart, Germany, 1987, p. 234, 235, Figs. 22 and 25.

Bögle, Annette, floating roofs—Grid Shells; Light Structures—Jörg Schlaich, Rudolf Bergermann; Ed. Bögle, Annette, and Cachola Schmal, Peter, and. Flagge, Ingeborg, (exhibition of DAM Frankfurt / M., 2004), Munich, 2003, pp. 113-130.

Lehman, Raimund, Glass—Structure and Technology in Architecture, Ed. Behling, Sophia and Stefan, Munich, 1999, pp. 74-77 , Figs. on p. 75 and 77, each top left ).

Schober, Hans, Glass Roofs and Glass Facades; Glass—Structure and Technology in Architecture, Ed. Behling, Sophia and Stefan, Munich, Germany, 1999, pp. 68-73.

Heinle, Erwin, and Schlaich, Jörg, Kuppeln, Stuttgart, Germany, 1996, p. 187, Fig. bottom, I. a. r., p. 222, picture. 94.

Partial Translation of Heinle document (No. 7).

* cited by examiner

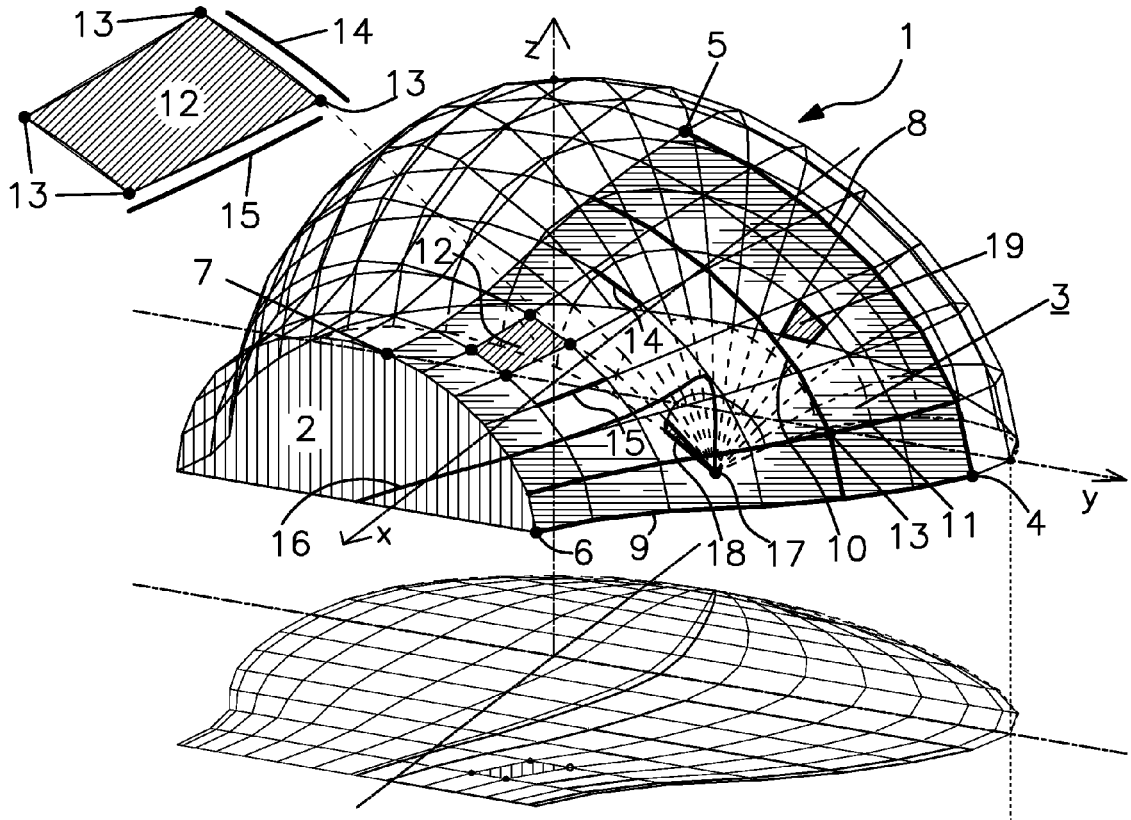
state of the art
⇓
other problem
Fig. 1
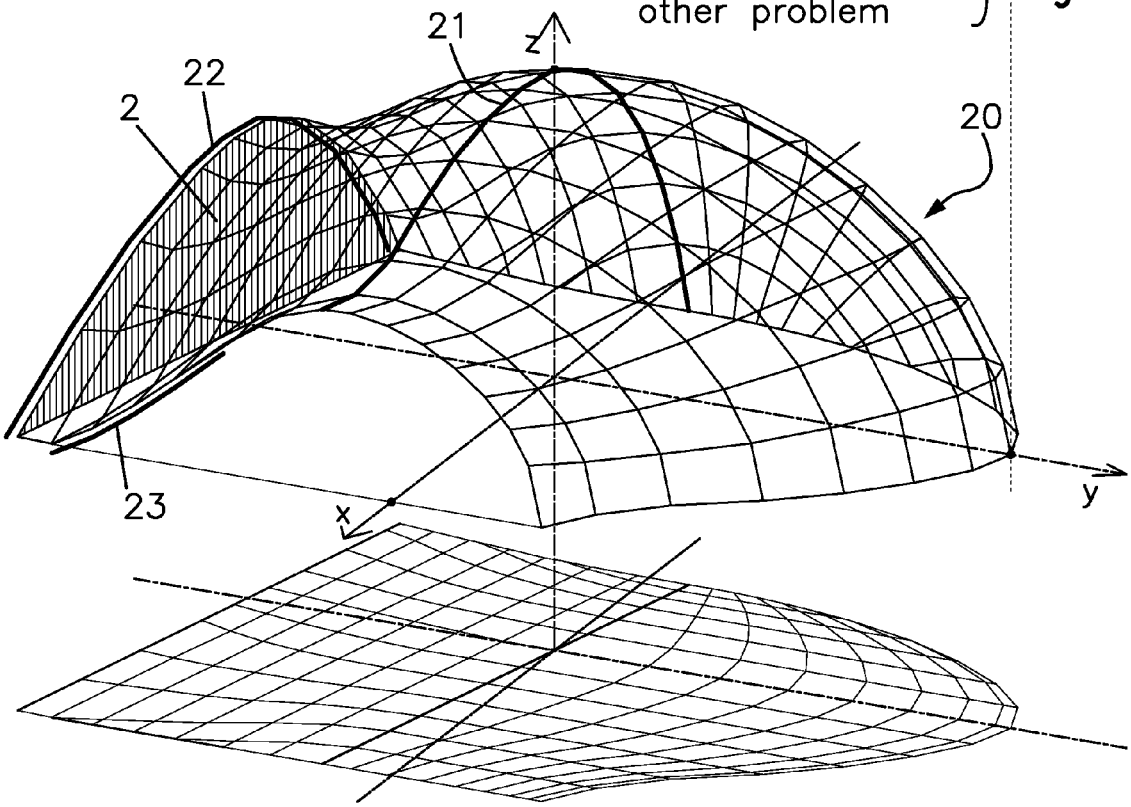

A'+B'
B
A
A+A'
B+B'
C
D
s1
s2
s3
s4
60°
30°

47
49
50
60

5
63
55

5
55
62

55
12
55
61

26
29
62
5
30
C+C'
31
26
64
28
57
5
52
65
51
26
31
30
A+A' z
14
15
41
40
66
6
31
28
x
y
6
6

67
6
6

26
z
26
14
31
15
x
y
70
69 z
15
67
14
11
12
12
x
y
6
15
14
52

71
30
26
z
5
24
30
24
24
3
31
24
x
6
y 68
51
58
6
52
51

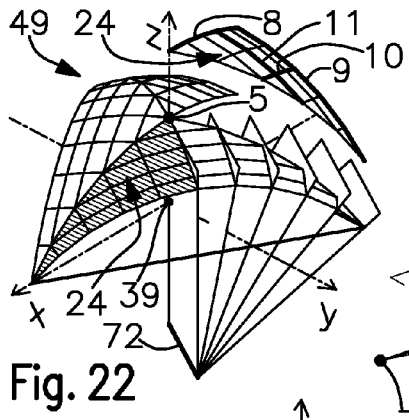
Fig. 22
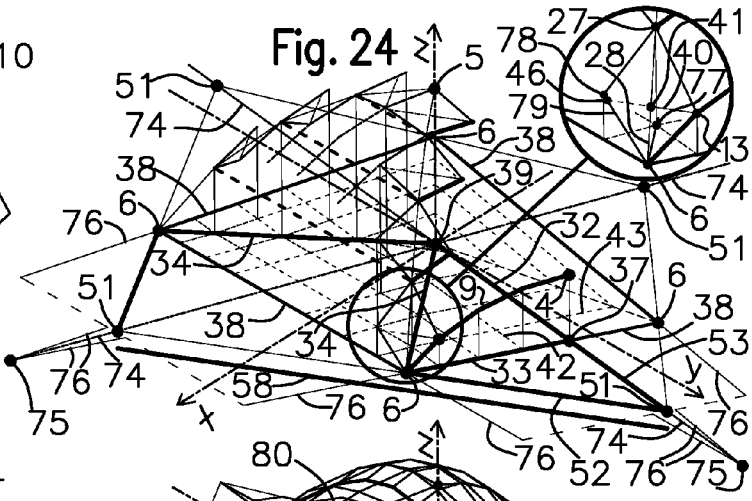
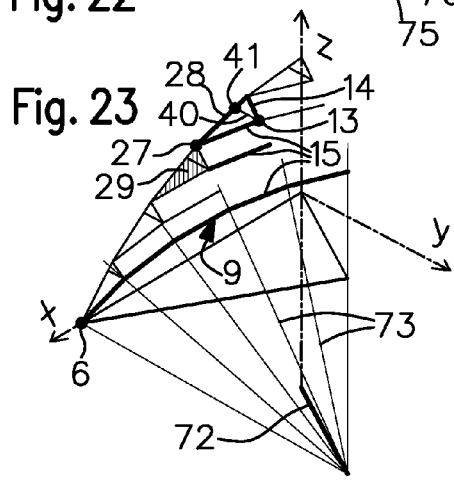
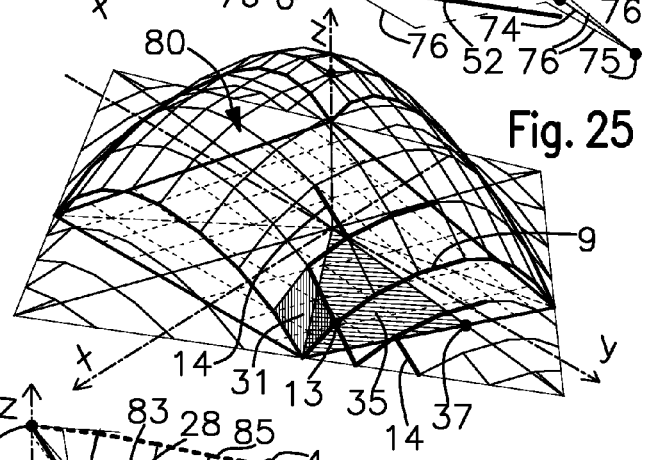
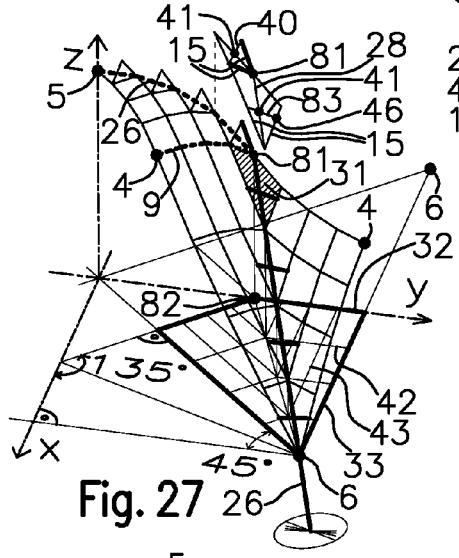
Fig. 27
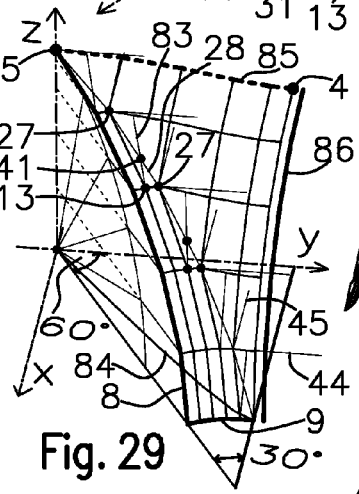
Fig. 29
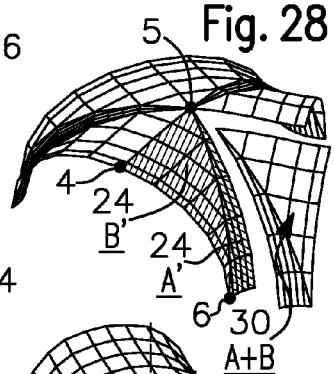
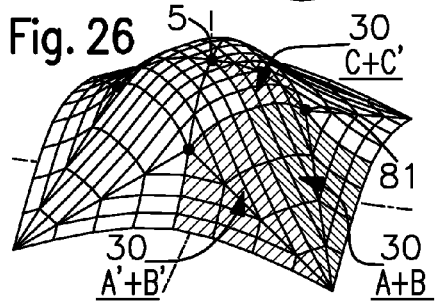
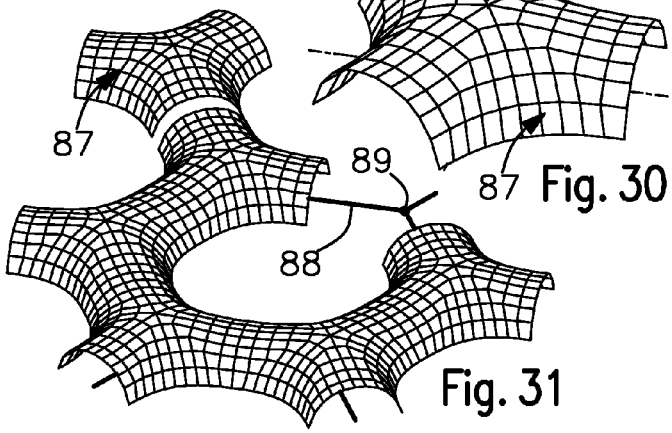

A+A'
35.26°

A+A'
A'
A
C+C
C
s1
s2
s3

52
9
52
126
25
5
6
25
56
5 z
x
y
z
49

30
A+A'

119
127
9
48
11
61
30
C+C
64
z
y
x 30
6
121
88

9
8
91
89
89
122
125

6

128
129
122

30
K+K'
8
s2
24
K
9
s4
24
K'
129
131
131
30
K+K'
130
129

6
132
6
6
134
125
132
132
133
94

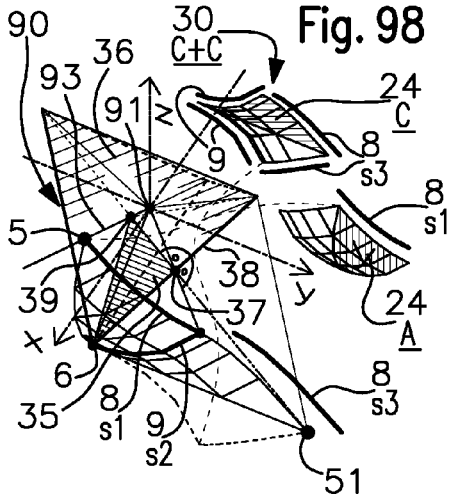
Fig. 98
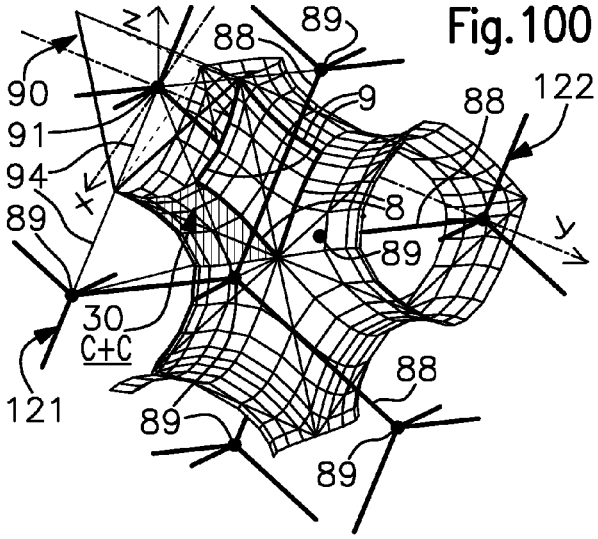
Fig. 100
Fig. 99
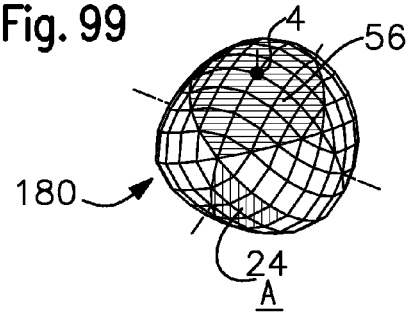
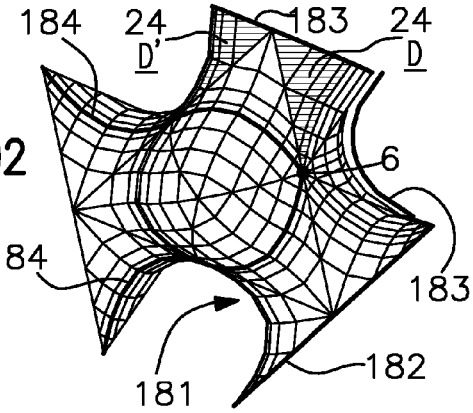
Fig. 102
Fig. 101
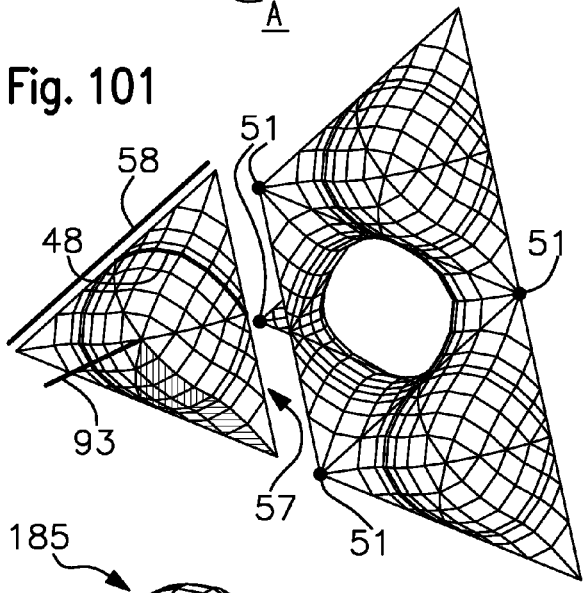
Fig. 103
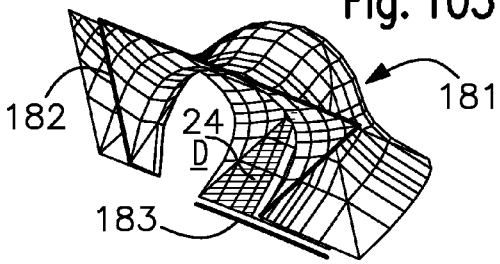
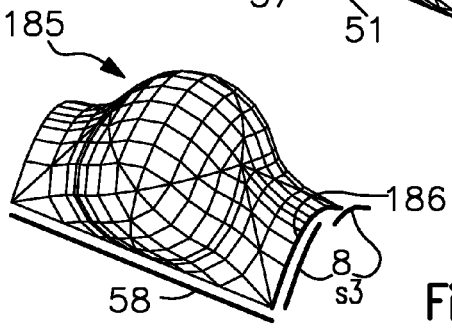
Fig. 105
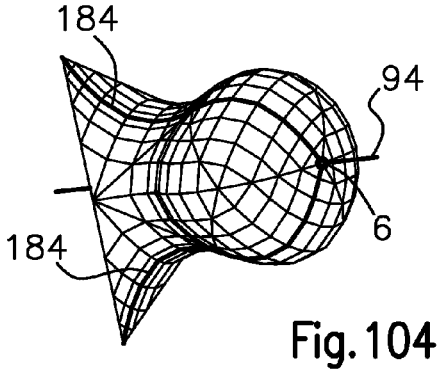
Fig. 104

Fig. 106
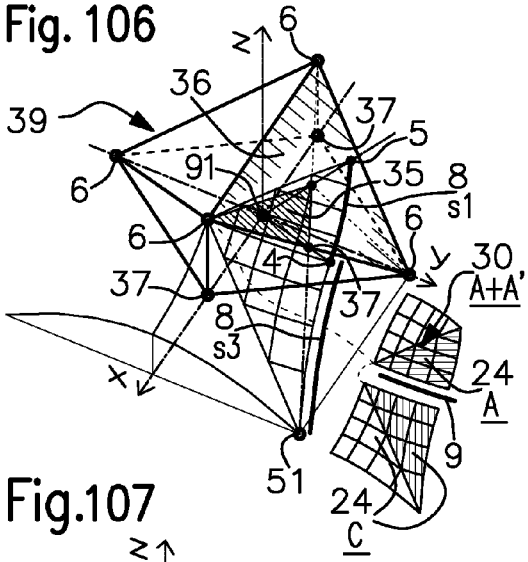
Fig. 108
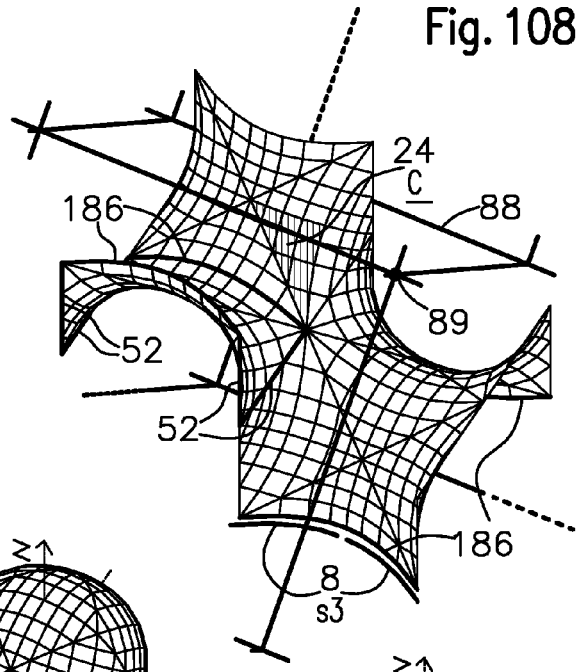
Fig.107
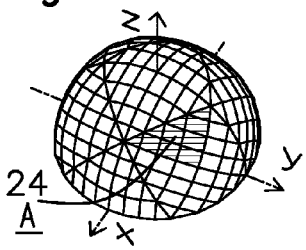
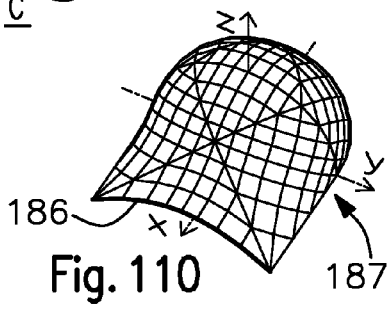
Fig. 110
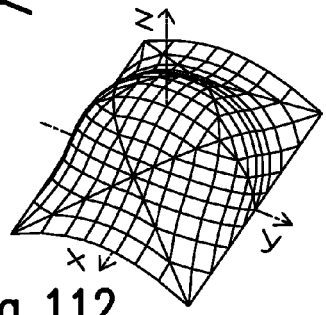
Fig. 112
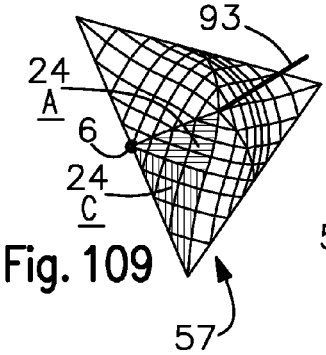
Fig. 109
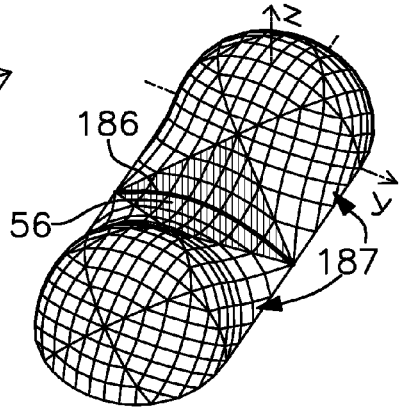
Fig. 111
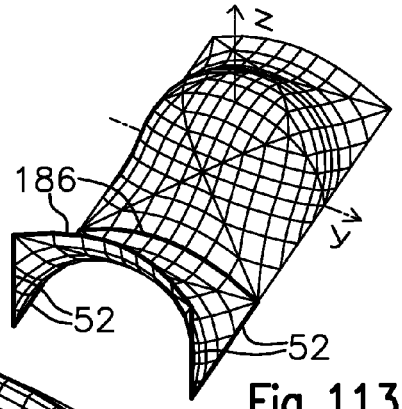
Fig. 113
Fig. 114
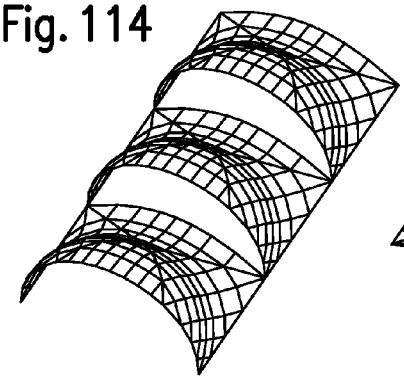
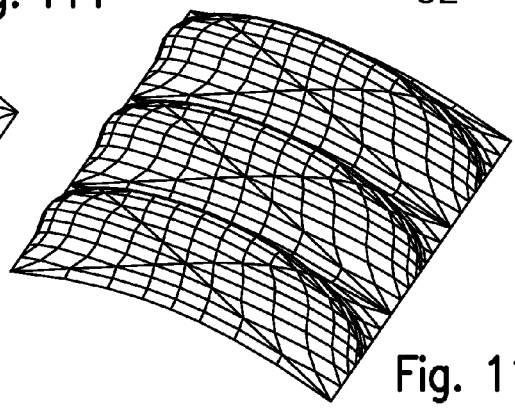
Fig. 115

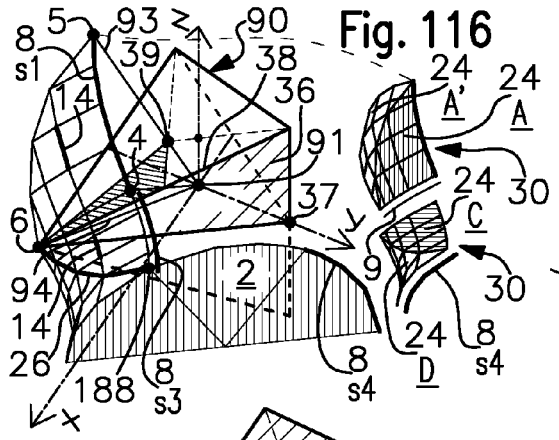
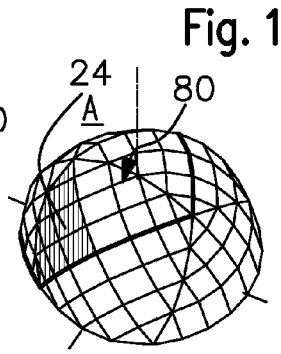
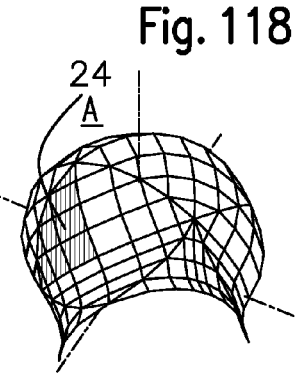
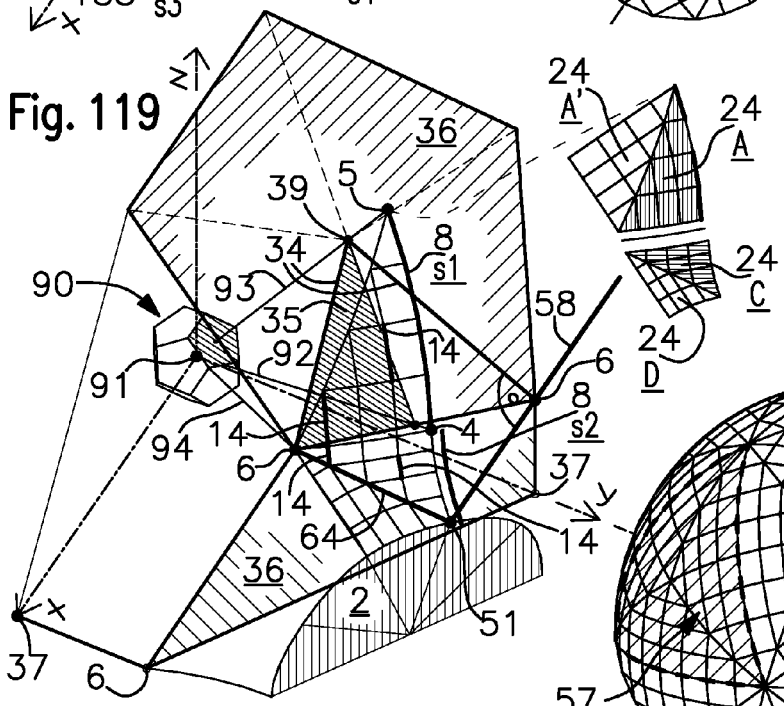
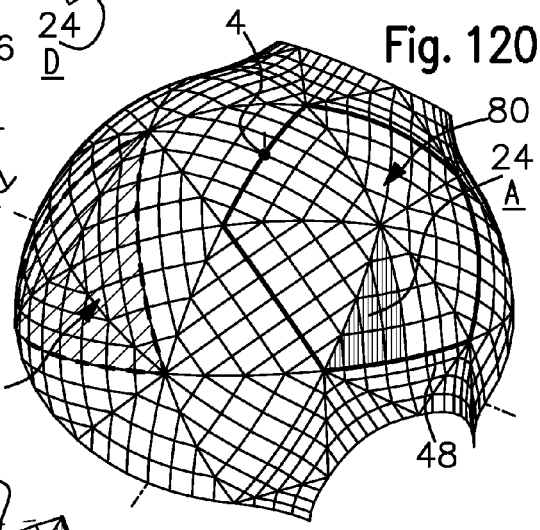
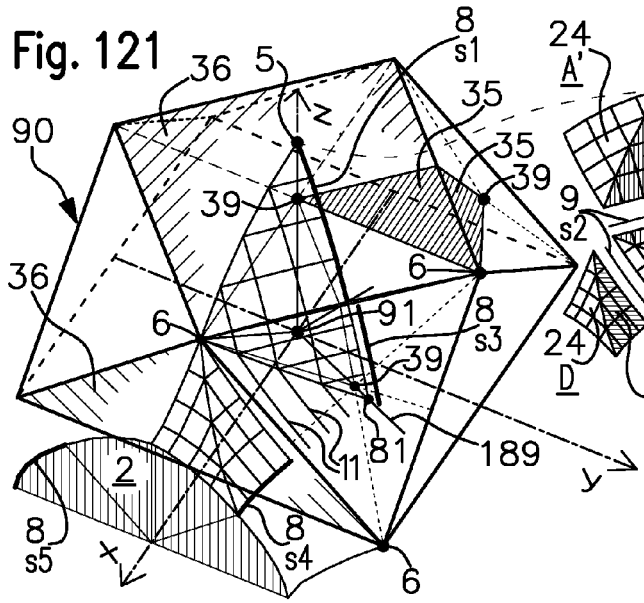
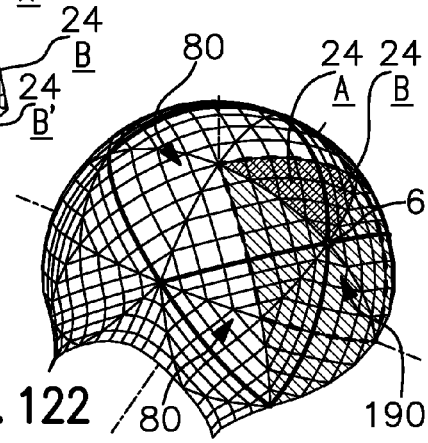
Fig. 122

Fig. 123
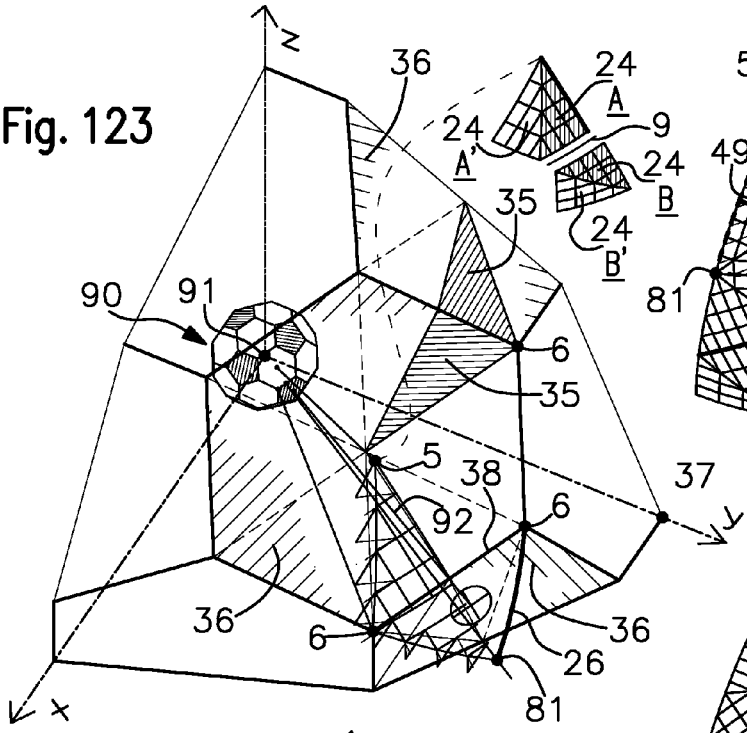
Fig. 124
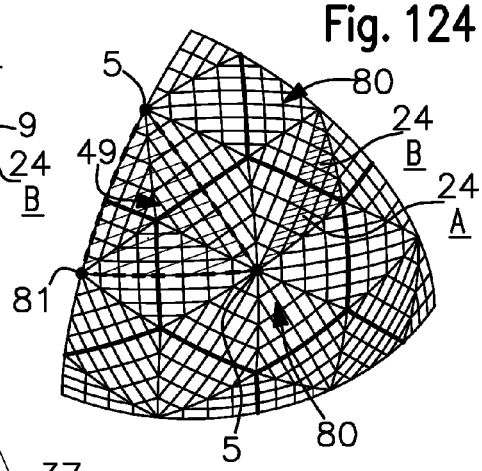
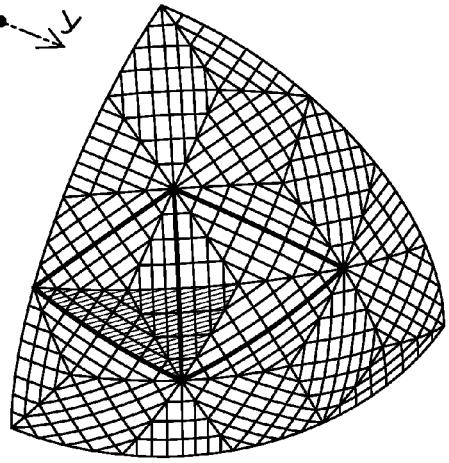
Fig. 125
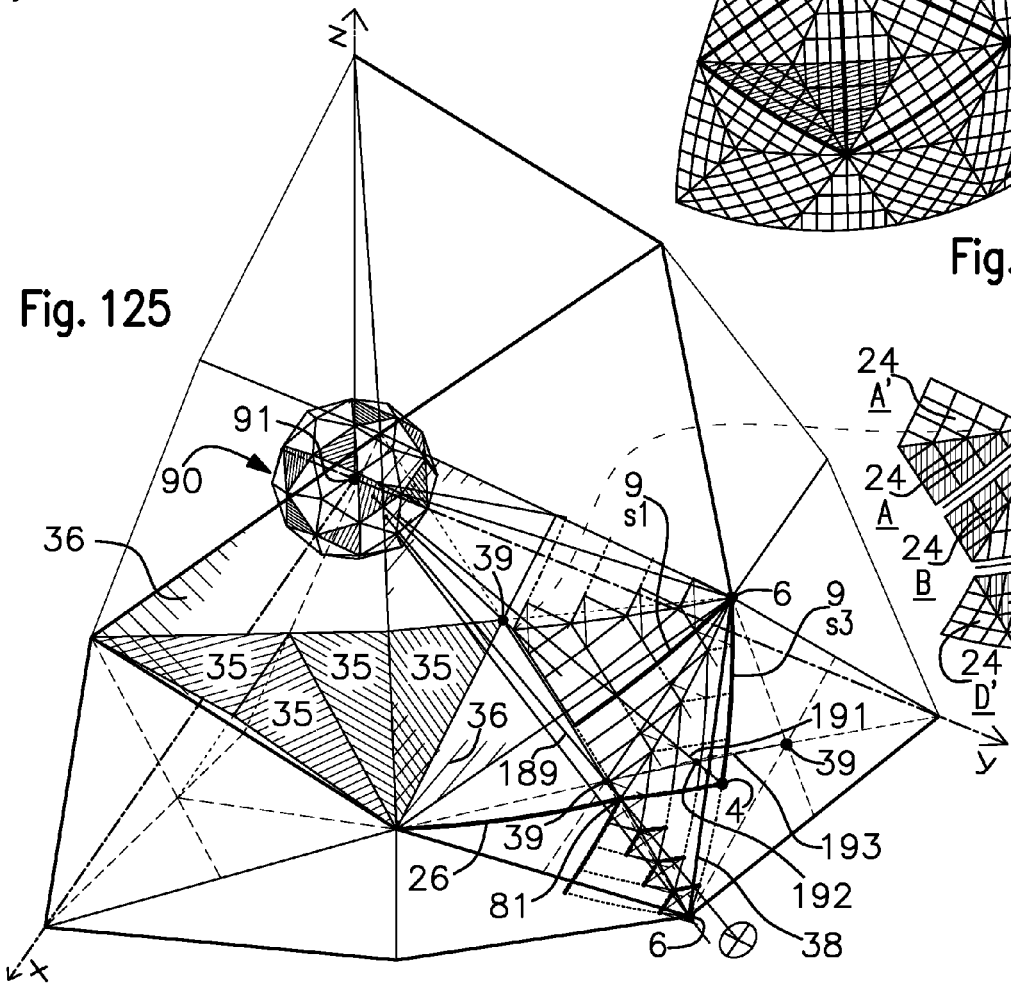
Fig. 126
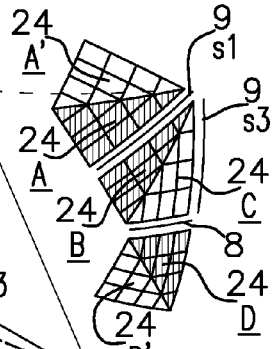

Fig. 127
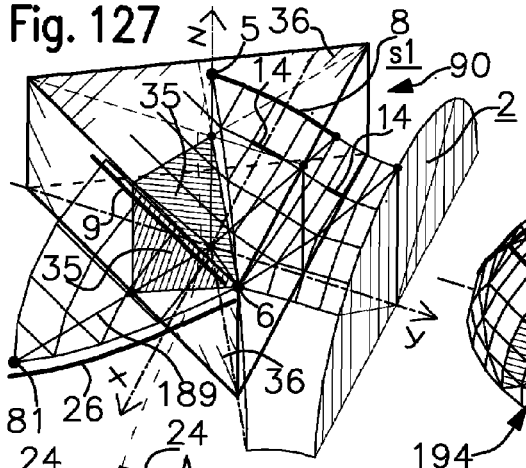
Fig. 128
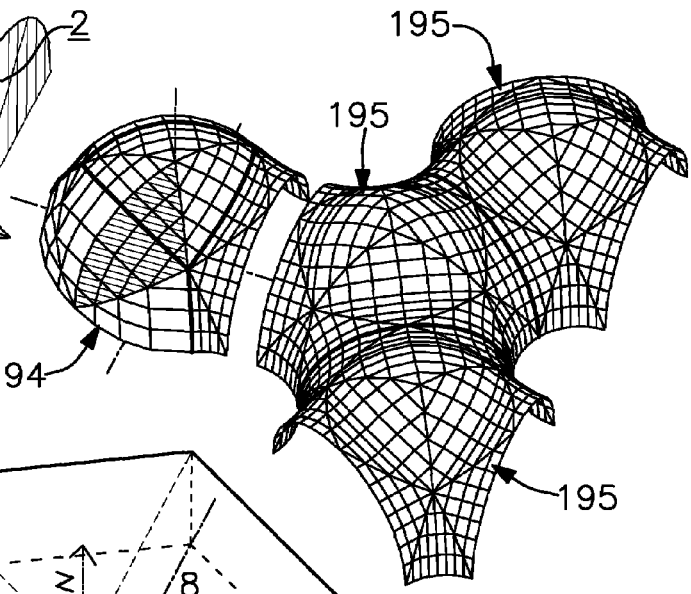
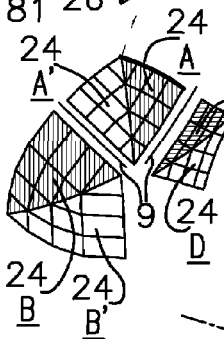
Fig. 129
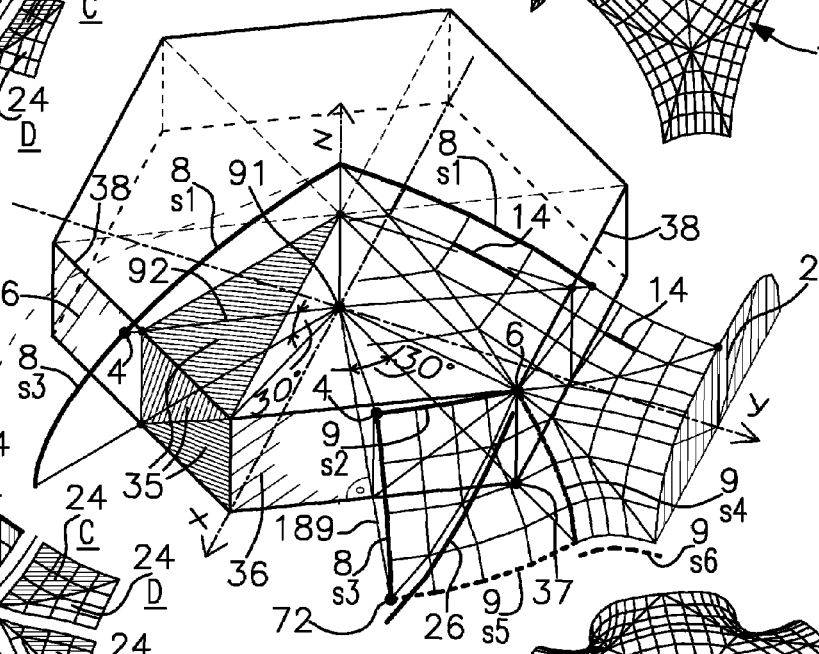
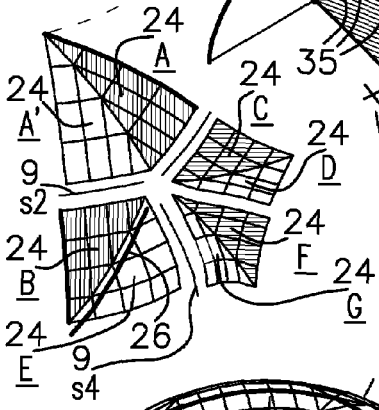
Fig. 131
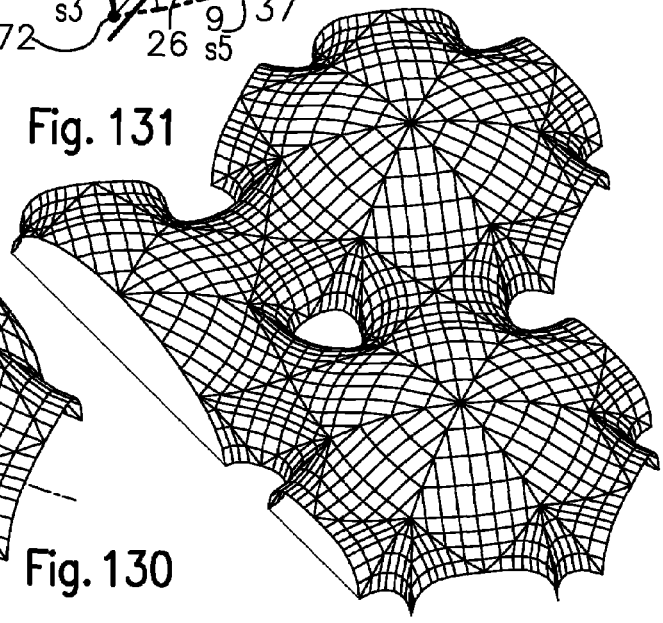
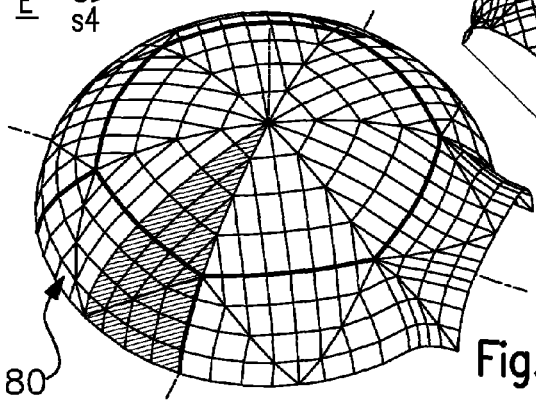
Fig. 130

197
y'
26
197
9
8
y
24
A
26
196
9
x'
x 8
5
24
y
26
A
199
9
200
x

36°
24
y
F
201
202
x

54°
24
y
I
203
204
x 13
y'
31
13
y
x'
x y'
5
y''
y
8
x'
x''
x 8
y'
y
x'
x 5
y'
y
8
x'
x
198
8
y
x 8
26
5
205
210
215
26
5
206
211
216
8
26
5
8
207
212
217
26
5
208
213
218
5
8
209
214
219

DOUBLE-CURVED SHELL

FIELD OF THE INVENTION

The present invention relates to a double-curved shell, in particular in the field of building construction. Such a shell is prefabricated of structural elements, it is custom-tailored or mass-produced. It can be purely synclastic, purely anticlastic, or mixed-curved (synclastic=curved toward the same side in all directions=in a Gaussian sense positively curved; anticlastic=having opposite curvatures=in a Gaussian sense negatively curved).

When commonly accepted and uniformly defined terms denominating well-known and especially recent shapes of shells and their parts hitherto were missing, imaginary or corporeal expressions are used within the text. They are highlighted by quotation marks, when they occur for the first time for their definition.

Each shell's piece consists of individual "meshes", that is, of small triangular, quadrangular or hexagonal units being arrayed without gaps. These units are bounded by linear load-bearing structural elements such as rods, or they themselves represent load-bearing structural elements being areal. These structural elements are straight-lined or curved, respectively. By this, the outside as well as the inside surface of a shell according to the present invention is either smooth or faceted everywhere. The surface is continuous by the reason that the rules of the composition of an individual shell's piece is continued within a neighbored shell's piece. An example of such a shell mostly having triangular meshes is a geodesic dome. It consists of a plurality of large triangular "caps" as shell's pieces being composed of a plurality of meshes. These caps can be assembled to caps being five times larger, and being named "icosa-cups" by their inventor, or, assembled even further downwards even over the extent of a hemisphere in order to result in a large and steeply sloped cupola.

BACKGROUND

However, as a disadvantage, the lengths of bars and joints of shells being subdivided fairly evenly into triangular faces, including Geodesic cupolas (U.S. Pat. No. 2,682,235), all together are large in relation to the envelope's surface. Besides, a lot of cutting waste arises during the production of the small triangular components. That is why shells of meshes having more than three corners are more favorable. Besides, the surface especially of these shells, having the same number of component faces, seems to be less rough, because the vertices, where several facets meet as plane meshes, are more obtuse.

Geodesic domes consist of usually triangular meshes within triangular shell's pieces with sides on net-lines in planes of great circles crossing each other. Usually, the side planes of their pieces include the edges of an imagined icosahedron. If, instead of this, they include the edges of a stellated cube as a determining polyhedron, the typical fine subdivision within a triangles grid of circle arc segments is extraordinarily irregular because of the strong curvature of the shell's pieces being extraordinarily non-equilateral triangular here. (P. Huybers, G. van der Ende: Polyhedral Sphere Subdivisions; in: G. C. Giuliani (Ed.): Spatial Structures: Heritage, Present and Future, International Association for Shell and Spatial Structures International Symposium, Milano, 1995, pp. 189, FIG. 13).

Triangular caps being formed of an eighth of a sphere being subdivided in such a manner, and having right-angled corners are implemented into computer programs in order to round off ashlars. Hitherto, meshes having a quadrangular form are unknown as an alternative for this. During modeling of computer programs by means of splines or nurbs or by two arrays of curves crossing at right angles to each other within the surface, the rounding-off of ashlars including cambering the remained plane faces results into not-plane meshes and causes a large amount of data.

Because of the acuteness of the meshes, a geodesic icosahedral dome of small plane quad rhombus or kite shaped meshes, each consisting of two combined adjoining coplanar component faces of two neighbored approximately equilateral triangular meshes having been stellated to result into very flat pyramids, has the same disadvantages like those consisting of the initial triangular meshes.

Beside the geodesically subdivided spheres, there are convex sphere-like polyhedra, consisting of a plurality of faces, of which faceted shells can be formed, which, by their manifold symmetries, recall geodesic domes but consist of more compact quad faces: so-called "Duals of Transpolyhedra" (H. Lalvani: Transpolyhedra|Dual Transformations by Explosion—Implosion, Papers in Theoretical Morphology 1, Published by Heresh Lalvani, New York, 1977, Library of Congress Card Number: 77-81420, FIG. 8 of "plate 27" on p. 67, p. 19 and p. 60).

However, the plane quad-meshes of the "Dual" of FIG. 8 in "Plate 27" on p. 67 never would be able to be curved in a definite manner keeping the node points unchanged, because this faceted shell has been developed by a recurring, all over happening insertion of new component faces and by a subsequent non-recurring removing all over of old, likewise always flat component faces. Besides, because of this developing process being rendered as an example ibidem on p. 19 and p. 60, the degree of subdivision of a faceted shell's piece, which is as small as possible, is situated within a spatial sector region of the polyhedron, and is repeated by mirroring, turning, and copying, is not free but restricted to 2, 4, 8, 16, . . . . Last but not least, each mesh-quad of such a unit has only disparallel sides (hardly to be recognized at some local areas of the hand-made drawings of Lalvani). As a consequence, there are: a lot of varying edge-lengths, a fundamentally irregular appearance, and a few options for reshaping. That is why not any built Duals of Transpolyhedra are known.

For the construction of assembled shells, translational shells, which, in a faceted design, consist of a plurality of parallelograms, are less wide-spread as geodesic domes. In contrast to the objects described before, they enable synclastic and anticlastic areas equally.

As a disadvantage, they are comparatively flat. Cause, within areas being more steeply sloped, the mesh-quads would be very acute-angled and stretched even within a very symmetrical, regular, that is, circularly round shape in plan of the shell as rotational paraboloid, whereby the portion of joints would be large likewise, and acute special nodes would have to be designed.

Yet unfortunately, even in the case of a flat rotation paraboloid, the advantage to have edge-lengths being as equal as possible is diminished by special lengths on the plane bearing border of the shell as well as by irregular cut-offs of faces there, which make arise accidentally and arbitrarily triangles and pentagons again.

Compared with conventional translational surfaces, so-called "scale-trans surfaces" enlarge the options to shape double-curved shells. (Annette Bögle: "weit breit-Netzschalen/floating roofs—Grid Shells" in: A. Bögle, P. Cachola Schmal, I. Flagge (Ed.): "leicht weit—Light Structures—Jörg Schlaich, Rudolf Bergermann", (exhibition of the DAM Frankfurt, 2004), Munich, 2003, p. 113-129; Hans Schober: "Glasdächer und Glasfassaden/Glass Roofs and Glass Facades" in: Sophia and Stefan Behling (Ed.): "Glas—Konstruktion und Technologie in der Architektur/Glass—Structure and Technology in Architecture", Munich, 1999, p. 68-73).

In contrast to a translational surface, shells of one scale-trans surface also enable in some cases shells that join to the ground in a steeply sloped or an outwards inclined way and that are at least in parts synclastic, hereinafter called "blobs", such as the upper shell 1 in FIG. 1 according to the state of the art, joining perpendicularly to the ground, and having a perpendicular plane opening 2, which is rigid in a self-supporting manner by an anticlastically curved free border region of the shell, hereinafter called "enlargement". The shape of the shell recalls the surface of a drop of water or oil hanging on a tap and starting to drip off, although being halved, turned 90°, and distorted.

In FIG. 1, the problematic nature of shells with a scale-trans subdivision into meshes is rendered comprehensively in order to distinguish a corresponding shell like in FIG. 151 according to the present invention in the best mode as clear and comparable as possible from the state of the art.

In contrast to translational shells, the upper shell 1 in FIG. 1 doesn't need to have meshes being arbitrarily cut off. A quadrilateral section 3 of such a shell, hereinafter called "ordinary quad section", will be described more in detail: It is located between four corner points 4, 5, 6, 7. It has a geometric net of two crossing arrays of long curved lines. These curves are aligned with the courses of two side's curves 8, 9, hereinafter called "array sides," that connect the corner points. Said long curved lines 10, 11, hereinafter called "array curves", form, in any desired quantity, quadrangular areal meshes 12, hereinafter called, "quad-meshes", whose corners are fourfold node points 13 being connected by straight lines 14, 15, hereinafter called "chords". Each time, four chords form the sides of a mesh. Only once, two opposites 14 of them are parallel. Thus, a plane mesh has the shape of a trapezoid. Mostly, the array curves are implemented in a structure as polygonal lines between a plurality of flat meshes having infills of a plane material, whereby the chords are sections of the polygonal line. As a shrinking in this context, the centric "stretching" (German: strecken=scale up) of the array side 8 that is located within a vertical plane resulted into array curves 10 of different sizes but equal shapes each time. It was proceeded from up reference-points within the spatially curved central reference-line 16.

Within the drawings, all curved sides 14, 15 of a mesh are replaced by chords 14, 15. As an exception, these side-curves are rendered only once also in a curved way in the case of an magnified mesh on the left It is possible to replace the chords by curved lines again, unless a faceted surface is meant explicit and exclusively. The flat curves between the node points 13 as endpoints of parallel chords 14 having differing lengths have the equal shape in a differing size.

The array curves of one orientation having parallel chords 14 are plane. Planes that include a plane array curve are called "array-curve planes" hereinafter. Here, these planes are parallel to the vertical plane of the array side 8. They slice here the shell like an egg-cutter the surface of an peeled egg. In the ground plane, they are represented by arrays of parallel straight lines like the cutter's cutting wires.

As a disadvantage of scale-trans shells, the array curves 11 running side by side but not in parallel, in one of both expansion directions of the net being generated here by a ruled scaling in centrepoints of the central reference-line 16, called "centric" by J. Schlaich and H. Schober, concur on their ends in one sole point 17, like the meridians of a globe on the pole or the ribs of a cupola on the zenith do. This causes yet regular but extremely acute angled triangular meshes 18 being hereby unfavorable here again. It was possible to mitigate this disadvantage only by drawing down the "pole" out of the shell surface and beyond the border at the ground plane. This has happened already to the shell 1. This causes once again cut meshes 19 having a triangular, quadrangular or pentagonal shape. The cut-off region below the x-y-ground plane is rendered by dashed lines.

Consequently, hitherto, the known realized shells of one scale-trans surface are restricted to mainly convex, mostly oblong, mostly synclastic examples being developed along a central reference-line 16. In contrast to the rather spherical shell 1 represented here, these shells have an opening 2 not only at one side, but they are open at two opposite shorter sides.

Hitherto, In the field of building construction, four kinds of shell-forms are able to be produced even of one scale-trans surface only insufficiently or not at all: Bohemian domes, "cushion-roofs", "inverted suspension-shells", or so-called "blobs". In respect of each of these four kinds of shell-forms, this fact will be showed section by section:

Bohemian domes are cupolas having border-arcs each being in a vertical plane. They are possible only above a quadrat, rectangle, parallelogram, or trapezoid, but not above any given straight-lined polygonal outline in plan. In the case of a four-sided plan, two sides have to be parallel. A Bohemian dome above an asymmetrical trapezoid must be generated by a scale-trans subdivision whereat each mesh or, at least in the case of alternation by meshes having the shape of a parallelogram, each second mesh occurs only once as a format. Another plans that are not quadrangular can arise only by dividing diagonally some meshes assigned to the border. If there are more than four corners, two sides have to be parallel once again. Even rectangular Bohemian domes have much formats of meshes.

"Cushion-roofs" are mainly synclastic shells being linearly supported upon a polygon and having anticlastically curved corner areas. (on formfinding of cushion-roofs, see: K. Bach, B. Burkhardt, F. Otto: Mitteilungen des Instituts für leichte Flächentragwerke, No. 18, (IL 18) Seifenblasen/Forming Bubbles, Stuttgart, 1987, p. 234, 235, FIGS. 22 and 25): Cushion-roofs of not twisted quad-meshes having coplanar vertices were not be assumed to be possible at all (H. Schober, p. 69, 70). The built roofs are cambered slightly only in order to avoid strongly twisted meshes. That is why they have to be trussed by cables below. Hitherto, cushion-roofs of twisted quad-meshes always have only four sides, as a rectangle or a square. Higher cushion-roofs are triangulated and show strong folds within the small corner areas probably being anticlastically curved.

"Inverted suspension-shells" are mainly synclastic shells with corner supports and only slight enlargements on the regions of the border-arcs being rigidified and self-supporting by their anticlastic curvature, like several shells of Heinz Isler (E. Heinle, J. Schlaich: Kuppeln, Stuttgart, 1996, p. 187, Fig. below, l. a. r., p. 222, picture. 94): These shells are not feasible in a pure scale-trans subdivision, because the inverse curvature in the cross-section of an anticlastically bent-up boundary region of the predominantly synclastic shell would cause an inverse curvature in the curve of the border-arc of a bent-up boundary region being situated in the transverse direction. This applies also to the next kind of shell-forms:

"Blobs" may have open enlargements in order to form floating transitions ($C^1$-transitions) not only into convex shells being situated one behind the other but into ones being located in various directions, in a manner being comparable to the surface of a drop of water or oil having been drawn apart upon a horizontal repellent plane surface by an acute tool into any diverse directions and hereby being connected to several other drops (for example: Multihalle Mannheim (E. Heinle, J. Schlaich: Kuppeln, Stuttgart, 1996, S. 169). Yet, the irregularly shaped Multihalle has twisted meshes. Hitherto, it would not be able to be produced approximately of elements between coplanar node points.

The problems dealing with blobs are discussed more thoroughly within the next sections:

Hitherto, the number of enlargement openings of blobs having a scale-trans subdivision is four at the most, if acute angled meshes are taken into account. One pair of opposite straight lines of openings or of plane borders in the plan has to be parallel here once again. In the case of a translational shell this concerns two pairs. It is not possible to achieve that straight lines, being aligned with these lines in plan, form an equilateral triangle or an equilateral or irregular polygon having more than four sides in plan. Even a pure translational cupola having four enlargements in a symmetric shape already would have the problem that high openings would implicate very large zenith's heights.

One sole enlargement is easy to implement indeed, as the scale-trans shell 1 shows in FIG. 1. If another enlargement having another plane opening 2 being situated not on the rear but on the left side and joining at a corner is needed, the shell must be changed into a shell 20 shown in FIG. 1 (bottom), having been modified within its left half. In principle, its additional enlargement can be produced only if the orientation of the array-curve's parallel planes being represented in a projection into the ground-plane, which is shown as lying below it, by a plurality of parallel straight lines each crossing several node points is turned 90° within the left half of the shell. Hereby, the shell is no longer homogeneous, but consists of two shell's regions: one on the left, the other on the right of the dividing curve 21 that was able to become plane by extending existing meshes in order to figure a new array side having been movable in parallel into the left direction and having been scalable.

But the border-arc 22 of the new additional opening 2 on the shell's left side is not useful because it joins too flatly to the ground. Besides, the old opening consequently having been changed has a statically unfavorable section 23 of the border-arc. This section has a destabilizing inverse curvature being caused directly by the bending-up of the surface, which initially has been synclastic within this region, to result into an enlargement. Intrinsically, said bending-up had been intended to stabilize the new opening.

Although the scaling in the left half of the shell is not regular, but an irregular, intuitive, and time-consuming stretching mesh by mesh, the degree of ductility has been too low to avoid this inverse curvature within the border-arc of the front opening. The necessary rotation of ca. 90° of the scaling direction has an additional disadvantage. It nearly disables an additional opening on the rear side, because each mesh of an enlargement there on the left of the dividing curve (21) consequently would be an irregular quadrilateral instead of a trapezoid.

Translational shells and scale-trans shells together are called "TST-shells" hereinafter because, according to the respective point of view, the translational shell, geometrically, is a more symmetric special case of the scale-trans shell, as well as the scale-trans shell, as a more advanced technical development, is a special case of the translational shell.

The known TST-shells are grid shells being glazed with flat panes. The design of their nodes often corresponds to DE 37 15 228 C 2, FIGS. 4, 5. Meanwhile, many variants of it have arisen, enabling subdivisions being more wide-meshed or acute angled. (R. Lehmann: "Knotensteifigkeit von Tragwerken" in: Sophia und Stefan Behling (Ed.): "Glas—Konstruktion und Technologie in der Architektur/Glass—Structure and Technology in Architecture", München, 1999, p. 74-77, Figs. on p. 75 and 77, each top left). Most of these shells are used for exceptional courtyards and conservatories only. Consequently, they form neither closed spaces nor independent spaces being accessible or usable without additional structures.

TST-shells of mesh elements that transfer loads within the area of the mesh, such as sandwich-panels, are unknown hitherto.

SUMMARY OF THE INVENTION

The present invention is based on the problem to subdivide fairly evenly a free-formed and individually tailorable as well as a regularly formed and mass-producible shell surface into quad-meshes having coplanar node points at its corners.

This problem is solved by combining the flexibility of a triangle net of shell-pieces in a large scale on one hand with the evenness of a quad net for meshes in a small scale on the other hand.

All the problems of arbitrary cuts of meshes and of very acute-angled regular meshes as well as those of missing abilities of implementation, concerning the four aforementioned kinds of shell forms, can be solved by the novel combination of several TST surfaces merging into each other in a novel way in order to result into shells which might be called "transitional shells".

The advantages attained by the invention consist in the possibility that shells with a free form or the form of a cupola as a self-supporting structure, no matter if as a trusswork or as a load-bearing plate structure, can be built of prefabricated, mostly flat elements without cutting quad-meshes arbitrarily into pieces.

Quad-meshes having all four points at one plane are advantageous not only for the production of flat panels. There are also advantages for the fabrication of areal structural elements being curved: So, the material block, for example, of rigid foam, of which the core of an insulating areal structural element with the extents of a mesh is milled out, may have a smaller height, Or, a metal sheet being deformed by pressing has less inner stresses, because it is being less stretched. Or, the plastic sheet being deep-drawn has less differences of thickness. Curved thick areal structural elements also can be extruded of an oblong curved stencil tool in a curved course, if translational surfaces are concerned.

Symmetrical quad Bohemian domes are able to be produced of a few formats of quad-meshes.

A Bohemian dome, an inverted suspension-shell, a cushion-roof, or a blob, all having a free form in plan, can be realized now by using quad-meshes. Only the borders of cushion-roofs and of regions of blobs ending as cushion-roofs still need triangular meshes, however in a regular arrangement only.

Because of their flat corner regions without a ridge, even in a steeply-sloped design, self-supporting cushion-roofs having diagonal bell-shaped cross-sections enable a freer sight. The extents of these flat regions can be varied.

Convex blobs according to the present invention can be considered as nearly spherical shells with been deformed. Vice versa, nearly spherical cupolas can be considered as a special case of blobs having a regular form. Finally, part regions of blobs on one hand and of cupolas on the other can be composed into one shell.

Domes are able to be produced of less parts and element formats even than comparable geodesic domes. Especially having a cubic symmetry, the shell according to this invention is very advantageous.

As a weekend home or an emergency shelter, It facilitates neat junctions of partition-walls and floor slabs standing at right angles to each other. In the case of observatory cupolas for example, it facilitates openings having parallel sides. Yet even domes, which already are geodesically divided conventionally based on an icosahedron, are able to be subdivided more finely into TST-surfaces. Compared to the "Duals of Transpolyhedra", the degree of subdivision is free; and the approach of the vertices towards the sphere's surface is more intense.

The aforementioned shell-shapes are able to be combined to form compounds: On one hand, Bohemian domes are able to be conventionally joined to each other in order to result in vaults having roof's valleys acting as transverse arches. On the other hand, inverted suspension-shells are able to form a seemingly floating vault having transverse arches being rounded off. This vault consists of a single coherent continuous double-curved surface; it is suitable for exhibition or waiting halls. Cushion-roofs can be enlarged by another cushion-roofs being turned upside down to become undulated roofs. Blobs can be connected to each other fluently by plane openings of any number and any orientation. By removing shell-pieces locally, blobs also can be reduced to cushion-roofs; or, by an additional removing, they can be reduced to be Bohemian domes or caps. Enlargements can be added, removed or closed. The cushion-like grid shell roofing an inner courtyard being open at one side can switch, at its open side, into a shell reaching to the ground in order to form a large winter garden being useful for the building's climate (FIG. 150).

The selection and combination of shell-pieces is possible during the planning process. It can be modified at a justifiable expense during several years later because of enlargement, diminution, or of a small extension by exchanging and adding shell-pieces.

If they are transparent, the novel shells are not restricted to close large-scale interstices or openings of buildings. Also without auxiliary structures, they are able to act as the second envelope of a conventional solid building, reaching to the ground.

Furthermore, they can be produced in order to be the building itself as an opaque or not-transparent heat-insulating panelized structure of load-bearing composite layers suitable for roof and wall regions. Thus, also straight-lined angular buildings can be rounded off like a suitcase on the edges and vertices in order to avoid a superfluous volume to be heated and heat losses by large surfaces as well as a cooling-off of the corners being exposed to wind turbulence. If the building's edges being rounded in cross-section do not run outwards in a straight-lined but a bent manner, whereat the faces of the facades and the roof are slightly cambered and their shape as a whole is similar to a piece of soap or a melting ice-cube, the load-bearing effect of a shell is combined with a suitable clearance profile in the cross-section (see FIG. 87, 88).

The building's degree of roundness can be defined as desired by various curvatures. Thus, a building envelope of glass or a large span factory building can be less round than a sports hall being able, by additional facilities like stands, to get the shape of a pebble.

Like spherical cupolas, on the ground, blobs are able even to pass downwards beyond the plumb, in a manner being comparable to a pebble in the sand or the body of a ship in the water.

This possibility, combined with that one of freeforming, has the effect that the application of the shell according to the present invention is not restricted to the area of building construction for self-supporting regions of walls and roofs, for building's climatic envelopes, or for a building complex.

BRIEF DESCRIPTION OF THE DRAWINGS

Several exemplary embodiments of the invention are shown in the drawings and will be described in further detail below. Then, the examples range from simple symmetrical arrangements to complicated asymmetric arrangements. Some further possibilities are mentioned only. Also these are not exhaustive according to the essence of the invention Bars and nodes mostly are shown as a wire frame only. Besides sometimes, for a better comprehension, networks of bars are rendered as a paper model, or areal structural elements transparently or without a thickness. Everywhere, the abstract mesh-net of center-lines is common. It is hereinafter called "virtual net", when the material thickness is rendered.

Finally, it occurs that similar parts are numbered equally then if the same function is given to them within the explained context. Geometric construction-lines and construction-points have the same number like various objects being possible on this place (bars, sides, nodes, vertices). So far as a better distinction of individual parts that join or overlay to each other but differ by their number is necessary, they are drawn apart along a large-dashed line.

Figures 2, 3, 4, 5, 6, 7, 8, 9, 10:
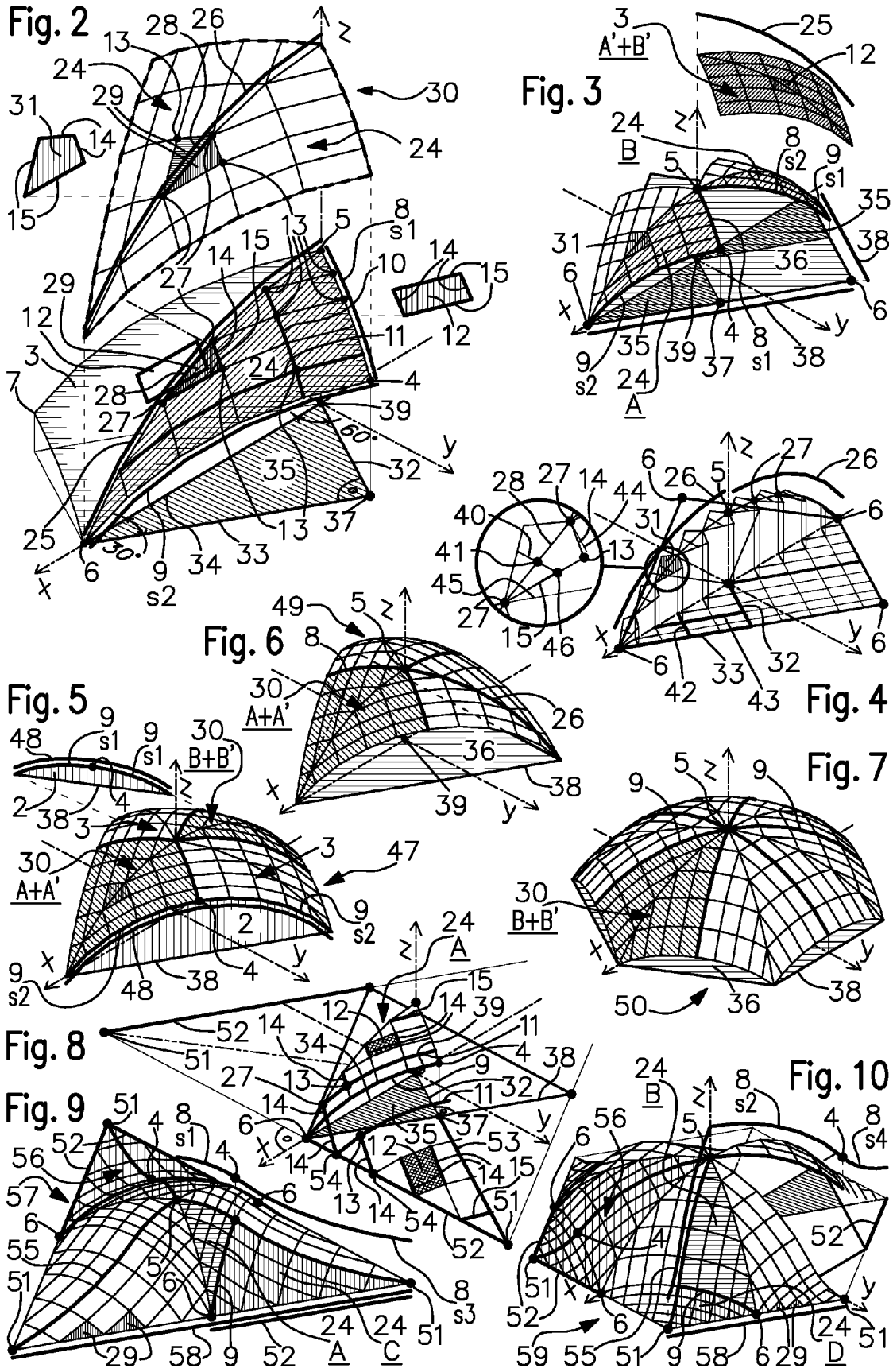

Objects having varying shapes but being substantially equal are distinct from each other by letters or combinations of a letter and a number for their different formats. Going from each described assembly-kit construction-set or unit-construction-system to the next one, they start again anew by A or s1.

All spatial representations within the figures are parallel projections, never central perspectives. Thus, lines being disparallel on the drawing paper, nowhere represent lines being intended to be in parallel and seemingly concurring by the perspective-reduction.

In order to achieve a better sense of orientation, nearly all drawings have a Cartesian co-ordinate system with dash-dotted axes whose origin is located within a shell, in a reference-point being able to be the gravity point, midpoint or centrepoint of the shell's ground area. The quadrant respectively being rendered in a position in the front, has positive x and y values, those of x being increasing. The rendered shells lie upon the x-y-ground-plane. To elucidate some drawings, a vertical projection of the shell upon this plane or upon a plane below in parallel is laid below as a plan-view's plane.

At the end of the description, you can find a list with reference signs of elements and drawings' objects called by specific terms.

Figures 11, 12, 13, 14, 15, 16, 17, 18, 19, 20, 21:
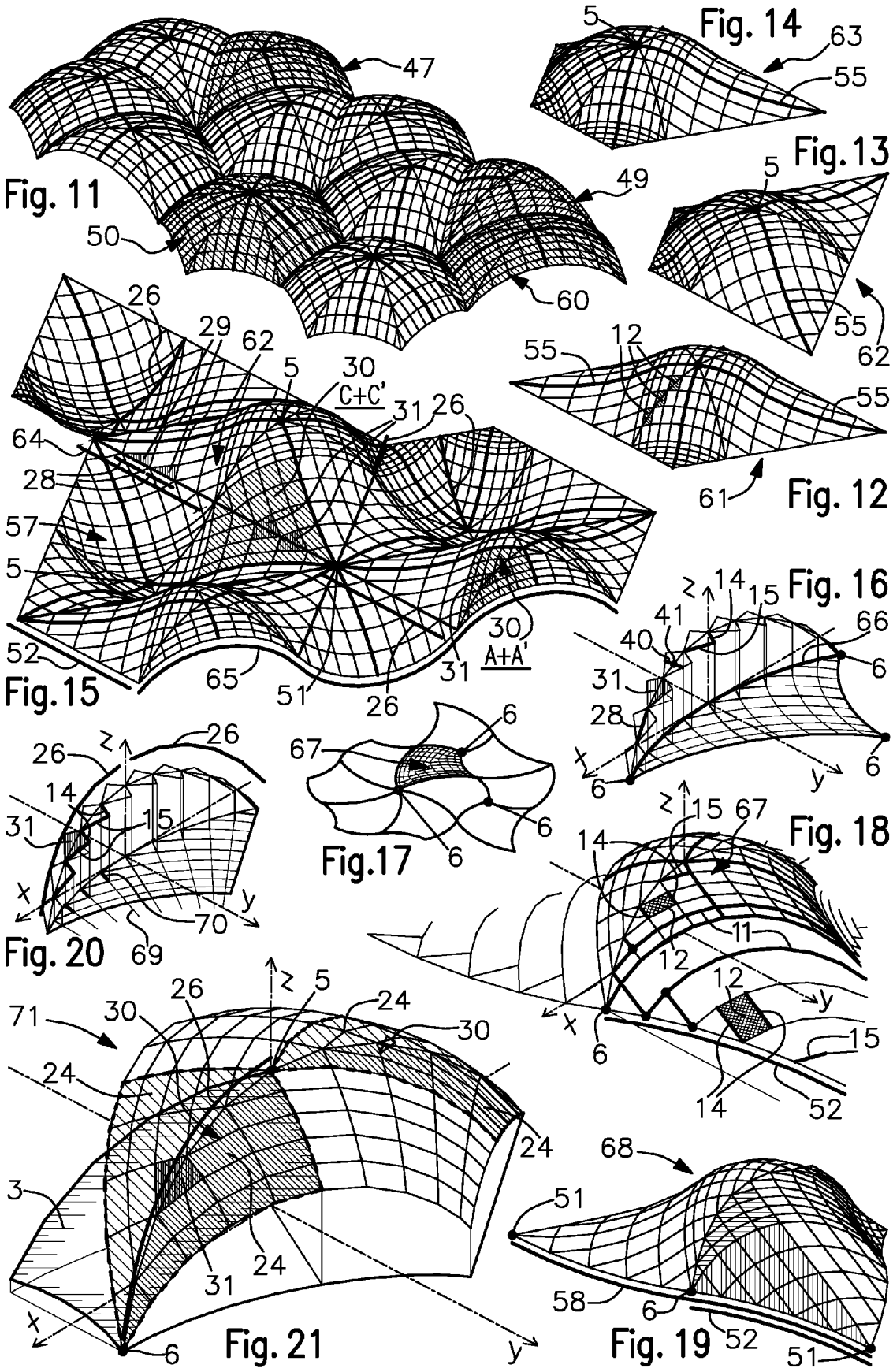
Figures 32, 33, 34, 35, 36, 37, 38, 39, 40, 41, 42:
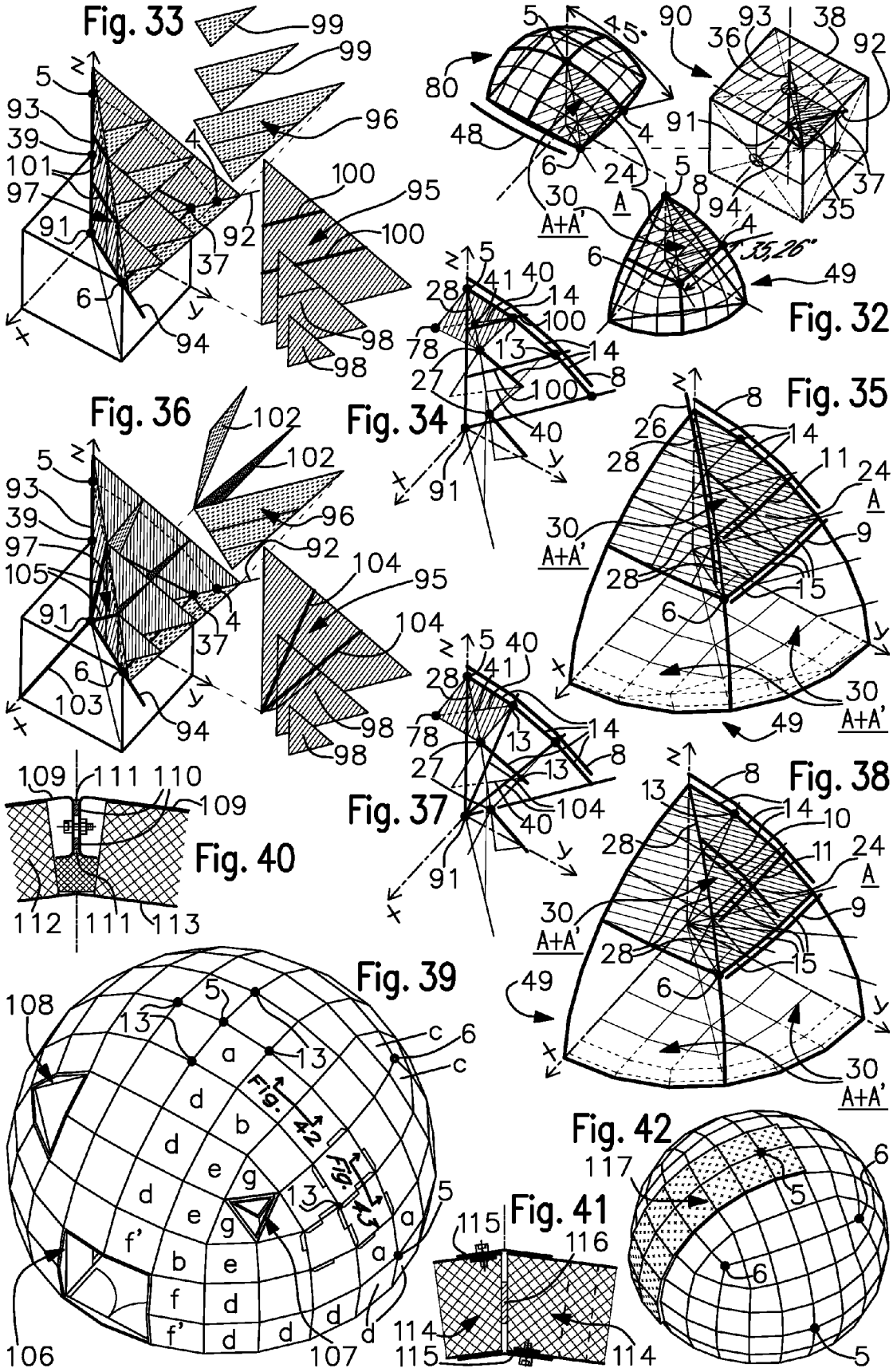
Figures 43, 44, 45, 46, 47, 48:
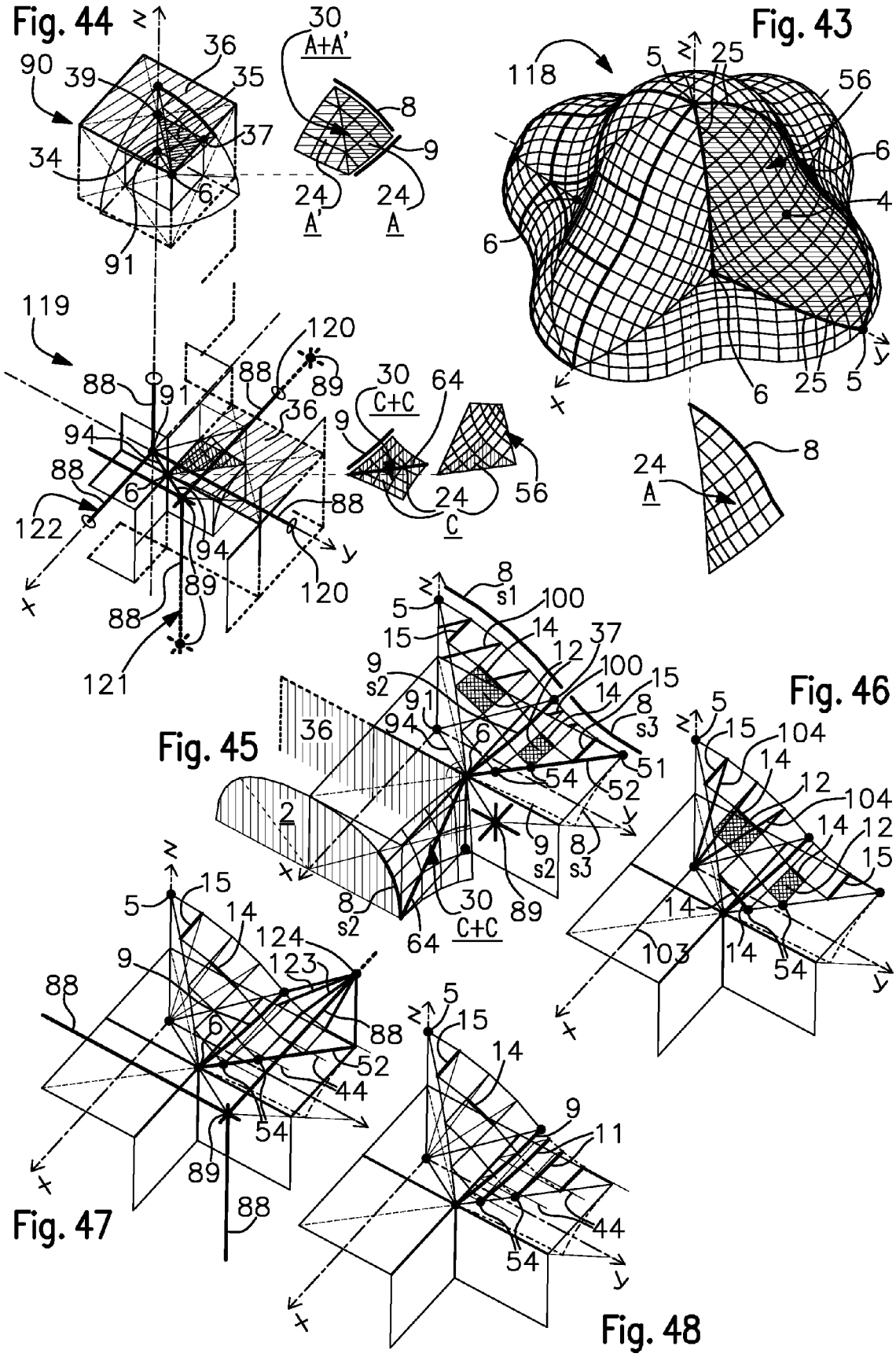
Figures 49, 50, 51, 52, 53, 54, 55, 56, 57, 58, 59, 60, 61, 62, 63, 64, 65:
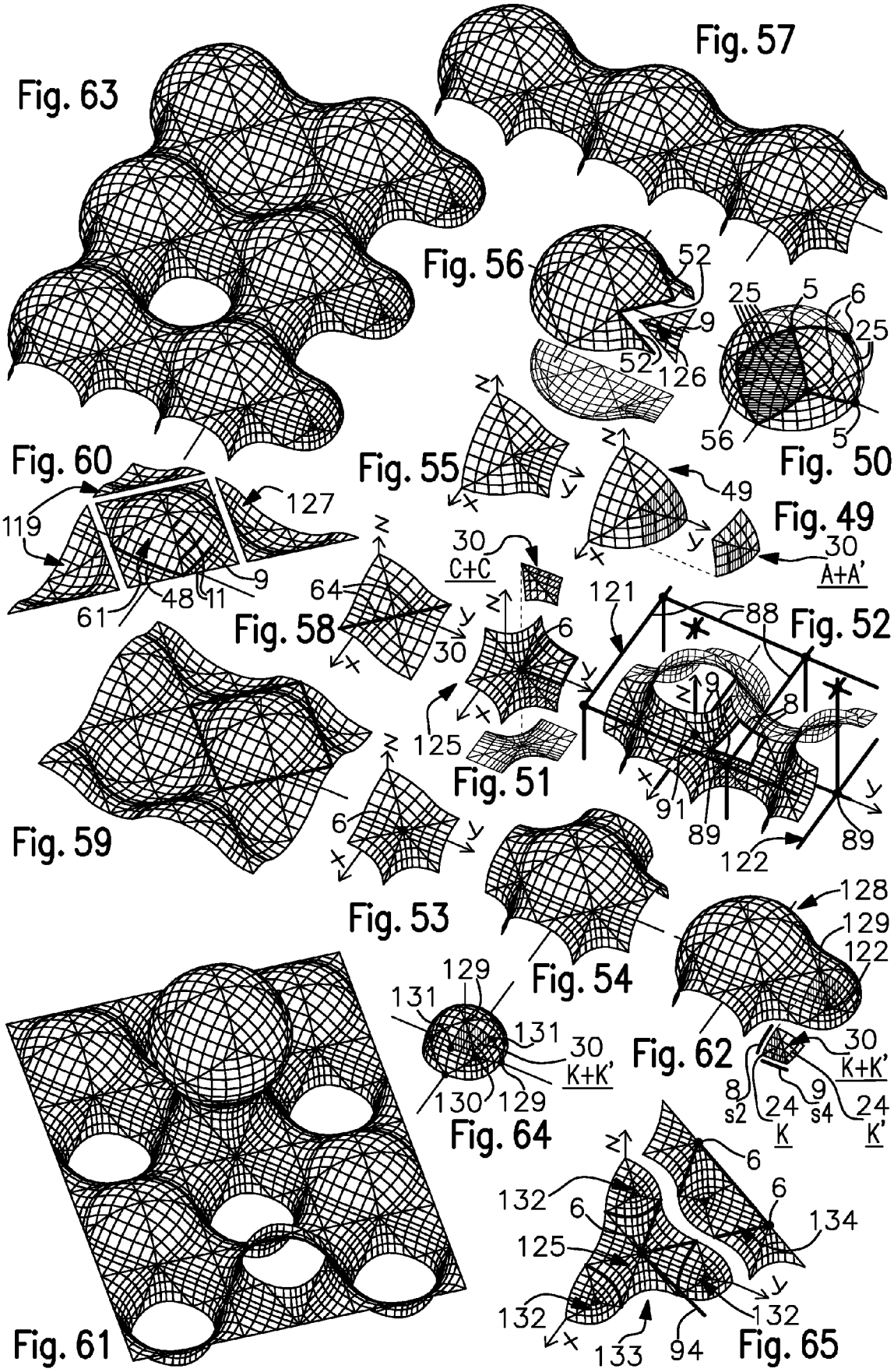
Figures 66, 67, 68, 69, 70, 71, 72, 73, 74, 75, 76, 77, 78, 79:
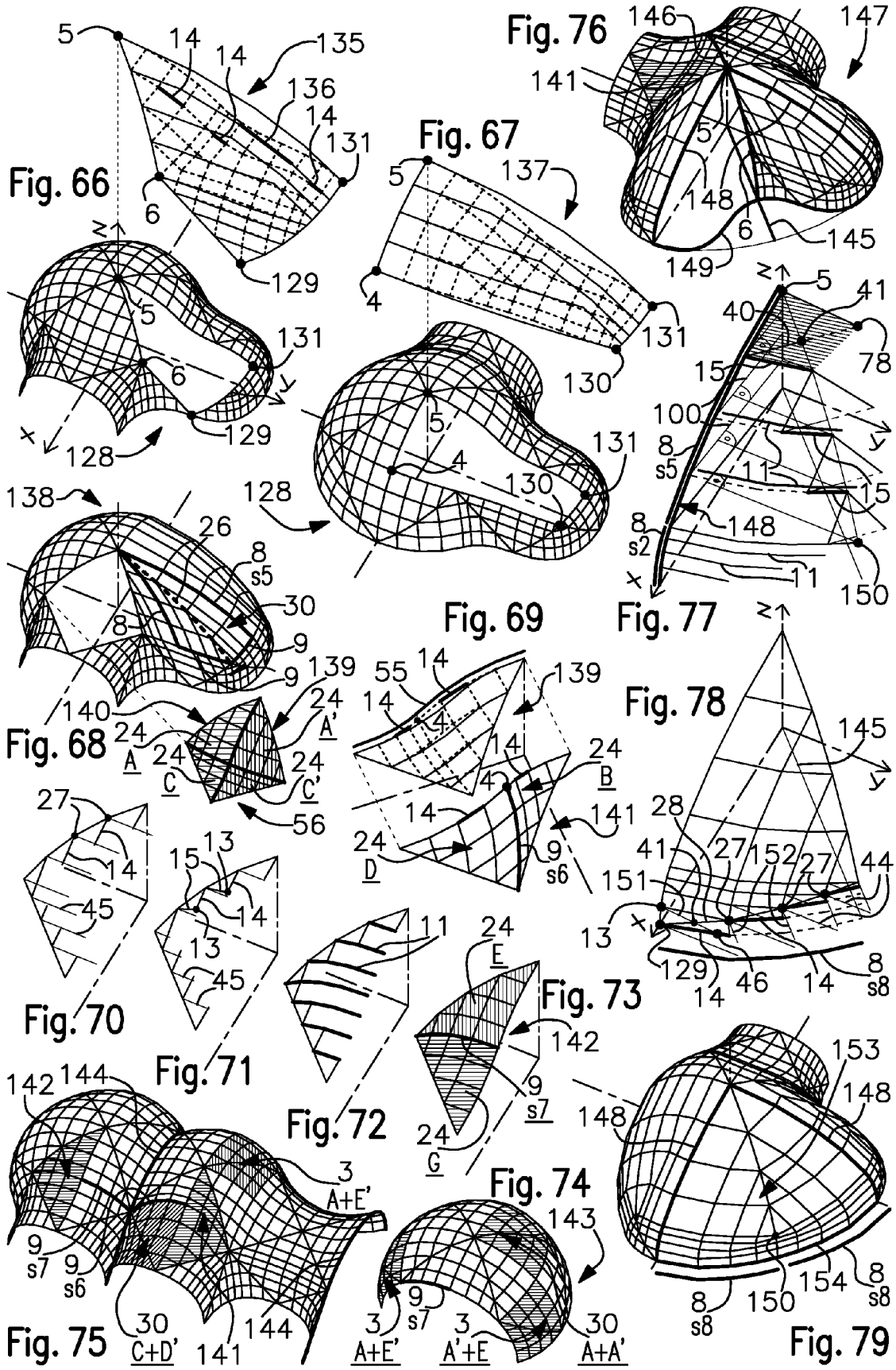
Figure 80:
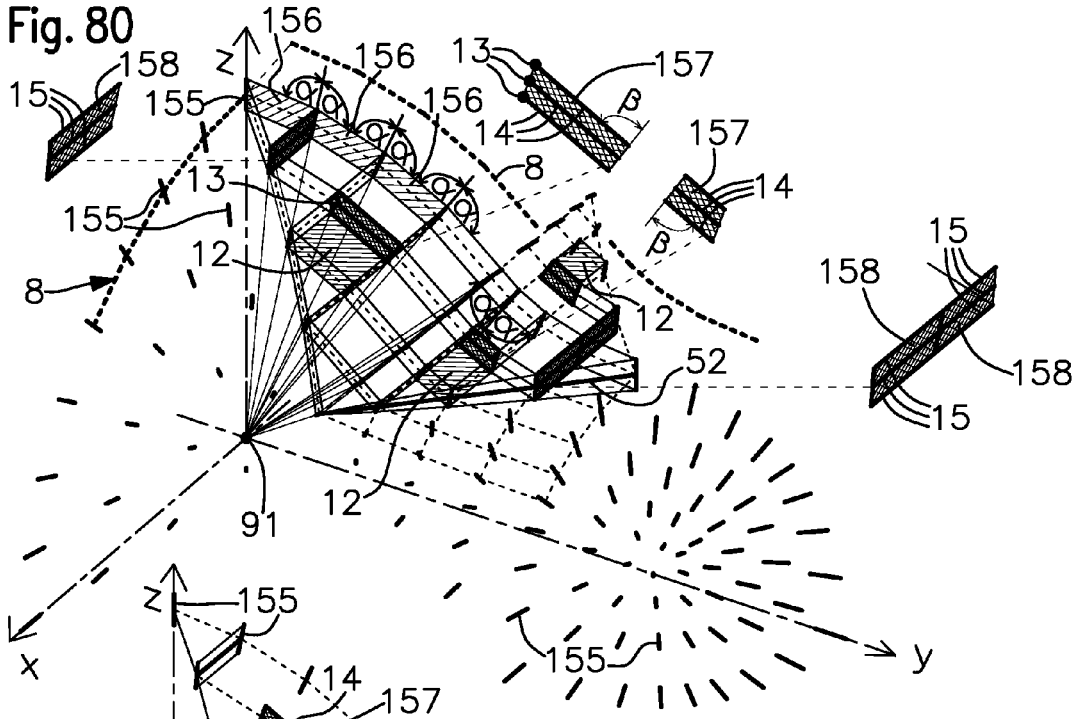
Figure 81:
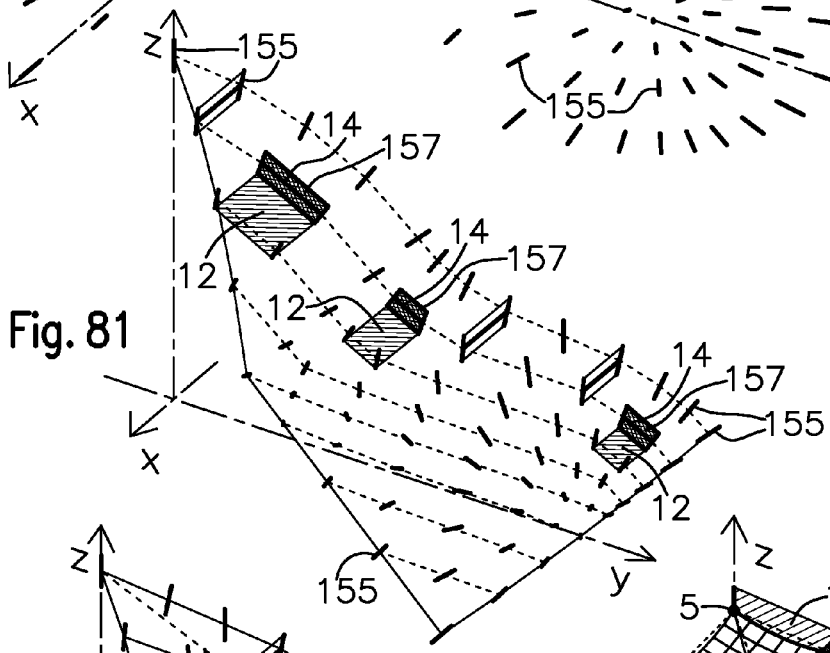
Figure 82:
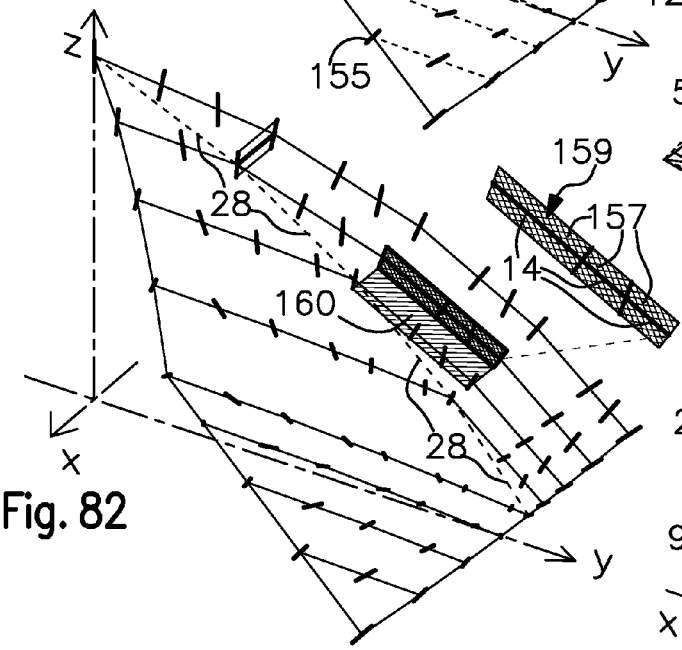
Figure 83:
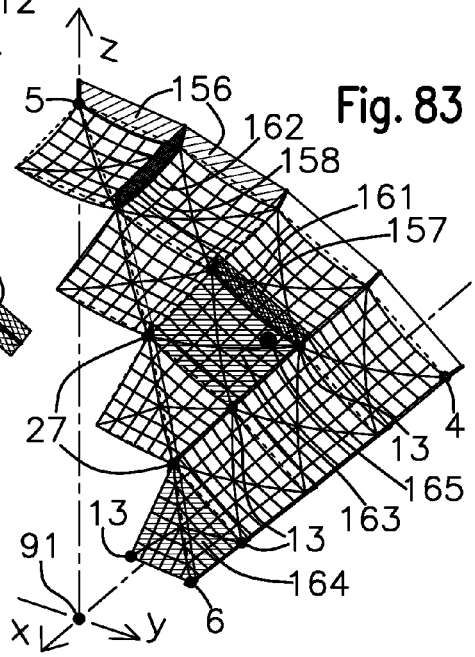
Figure 84:
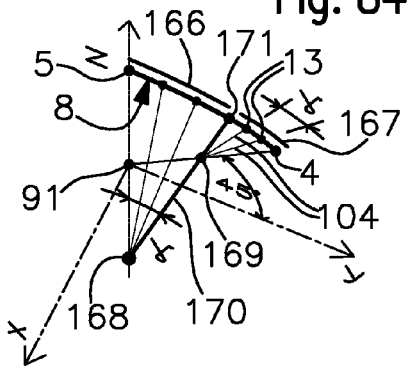
Figure 86:
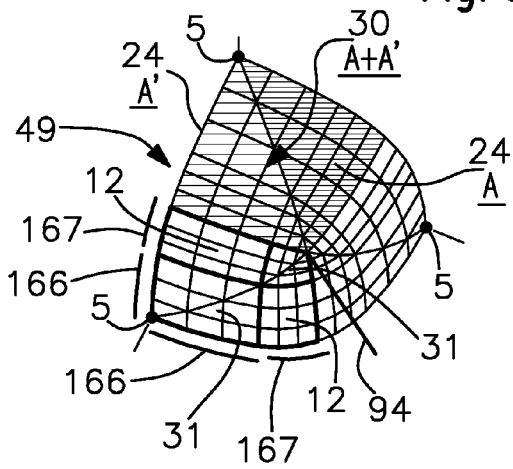
Figure 85:
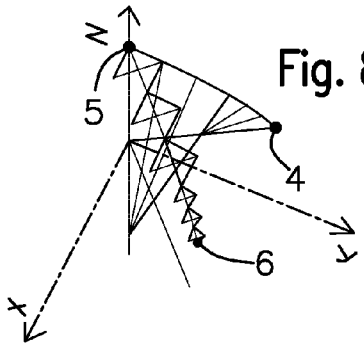
Figure 87:
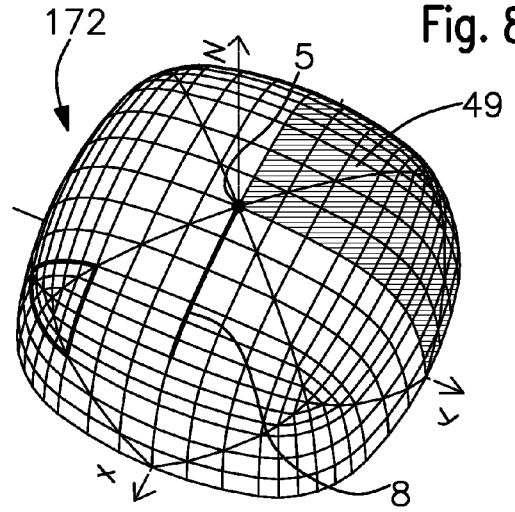
Figure 89:
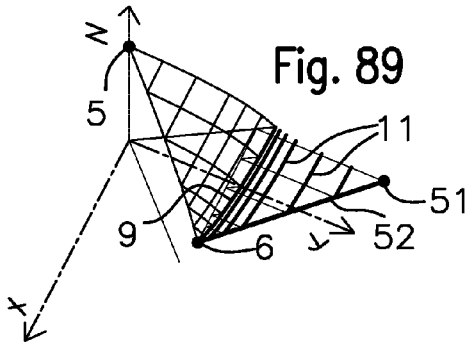
Figure 88:
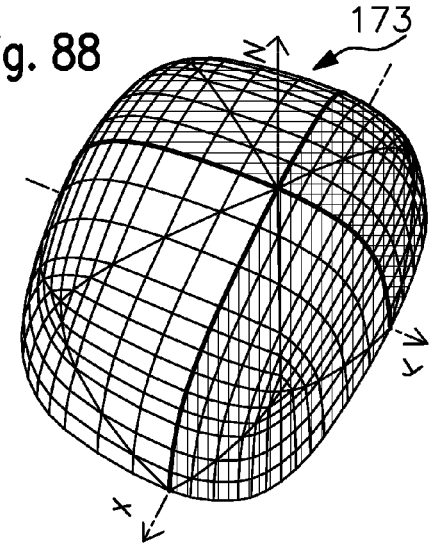
Figure 90:
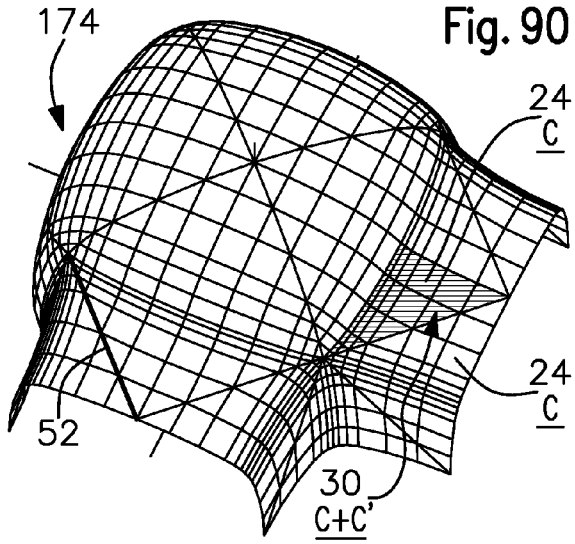
Figure 91:
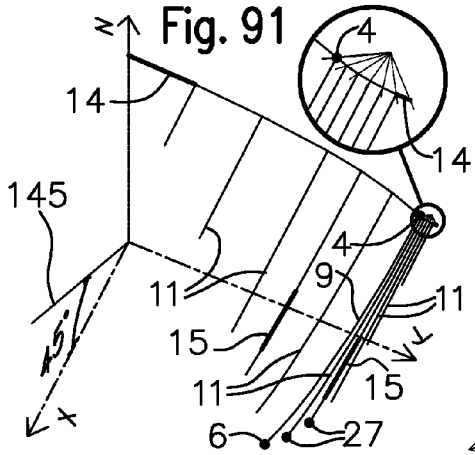
Figure 93:
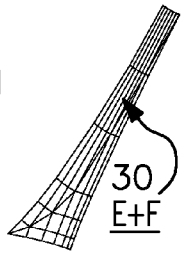
Figure 94:
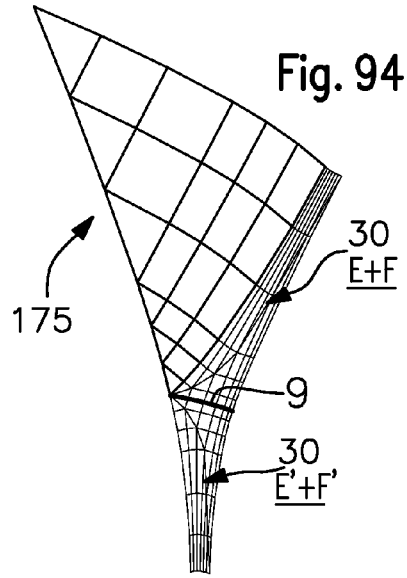
Figure 92:
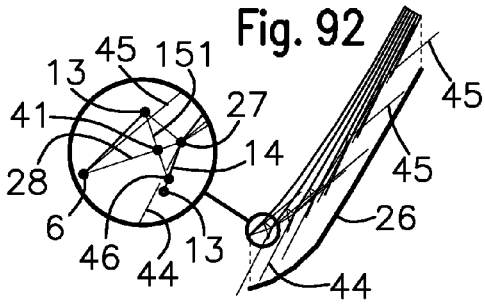
Figure 97:
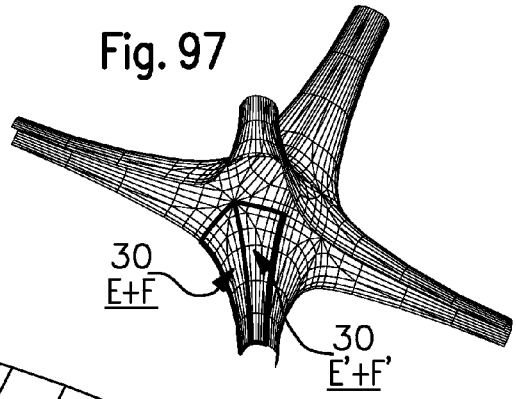
Figure 95:
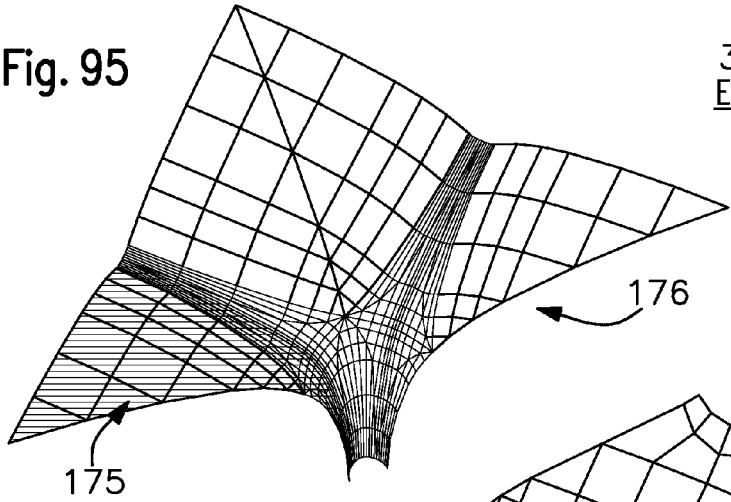
Figure 96:
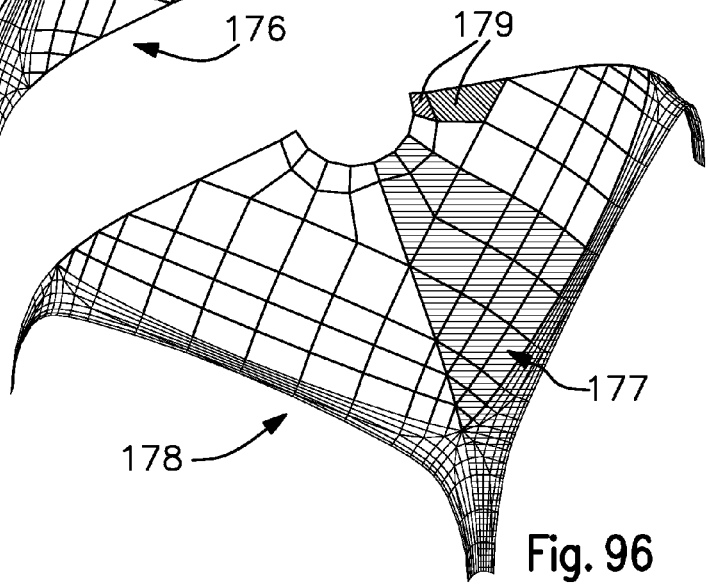

In the drawings:

FIG. 1 shows a shell with one plane lateral opening (top), according to the state of the art, which, as can be seen below, has been provided with a second opening;

FIG. 2 shows a triangular shell's piece, hereinafter called "sherd", of a TST-surface's quadrilateral section, whereat this sherd repeatedly rendered above it, along with another sherd, forms a quadrangular shell's piece according to the present invention, hereinafter called "double sherd", that includes special plane meshes, hereinafter called "seam meshes", of two triangular meshes hereinafter called "cut triangles";

FIG. 3 shows the double sherd of FIG. 2 and another double sherd with a different format and meeting the first one on the zenith by one of their corners;

FIG. 4 shows the geometric construction of the double sherds of FIG. 3;

FIG. 5 shows a shell of the two double sherds of FIG. 3 and of two usual quadrangular surfaces of sherds with the same formats like those of the invented double sherds;

FIG. 6 shows a Bohemian dome of three double sherds with the first format of FIG. 3:

FIG. 7 shows a Bohemian dome of three double sherds with the second format of FIG. 3:

FIG. 8 shows the geometric construction of an anticlastic sherd seeming to slide away from a synclastic sherd of the triangular Bohemian dome of FIG. 6;

FIG. 9 shows a cushion-roof of sherds with formats of FIG. 8 and of their mirror images;

FIG. 10 shows, on the right, the geometric construction of an anticlastic sherd seeming to slide away from a synclastic sherd of the hexagonal Bohemian dome of FIG. 7, as well as, on the left, a half cushion-roof of sherds with the formats there and their mirror images;

FIG. 11 shows a vault of triangular, quadrangular, and hexagonal Bohemian domes;

FIG. 12 shows a cushion-roof upon the ground area of a parallelogram;

FIG. 13 shows a cushion-roof upon the ground area of a trapezoid;

FIG. 14 shows a cushion-roof upon the ground area of a pentagon;

FIG. 15 shows an undulated roof of cushion-roofs;

FIG. 16 shows the geometric construction of a Bohemian dome having spatially curved sides;

FIG. 17 shows the sloping view upon the plan projection of a Bohemian dome within a vault, having arisen according to FIG. 16;

FIG. 18 shows an accomplished quadrangular Bohemian dome having spatially curved, that is, not-plane sides, which is going to be extended on each side to result into a cushion-roof;

FIG. 19 shows as a result of the extension of FIG. 18: a cushion-roof upon the ground-plane of a triangle, having flat curved sides;

FIG. 20 shows the geometric construction of a Bohemian dome having plane and not-plane sides;

FIG. 21 shows a Bohemian dome being generated according to FIG. 20, having a scale-trans mesh-subdivision;

FIG. 22 shows a Bohemian dome having plane sides above a triangular ground area, consisting of trapezoid-shaped meshes of only a few different formats;

FIG. 23 shows the geometric construction of a sherd with a scale-trans mesh-subdivision of the Bohemian dome from FIG. 22;

FIG. 24 shows the geometric construction of a Bohemian dome above a ground area of an irregular straight-lined quadrangle;

FIG. 25 shows the extension of the Bohemian dome of FIG. 24, being rendered as a net, to result in an asymmetrical cushion-roof;

FIG. 26 shows a shell with bent-up border regions and plane free border-arcs, upon a quadratic ground area;

FIG. 27 shows the geometric construction of an eighth of the shell from FIG. 26;

FIG. 28 shows a shell with bent-up self-supporting border regions and plane openings upon the edges of an equilateral triangle;

FIG. 29 shows the geometric construction of a sixth of the shell from FIG. 28;

FIG. 30 shows a shell with a topologically equal mesh-net like the shell in FIG. 28 but with another shape;

FIG. 31 shows a plane, rounded-off tunnel-system of shells of FIG. 30;

FIG. 32 shows a spatial sector region including a sherd having been vaulted on a cube acting as a convex basic polyhedron, as well as two different caps of several double sherds on this cube, being moved apart in the representation;

FIG. 33 shows the intersecting sections of the planes of curved sides of a sherd that have a translational subdivision into meshes, on or rather above a cube's portion;

FIG. 34 shows the geometrical construction of a sherd of a net of mutually crossing curves within the planes according to FIG. 33;

FIG. 35 shows a triangular cap of three double sherds with tripartite sherd sides and a translational subdivision into meshes, situated on a cube's vertex;

FIG. 36 shows the intersecting sections of the planes of curved sides of a sherd that have a scale-trans subdivision into meshes, on or rather above a cube's portion;

FIG. 37 shows the geometrical construction of a sherd of a net of mutually crossing curves within the planes according to FIG. 36;

FIG. 38 shows a triangular cap of three double sherds with a scale-trans subdivision, on a cube's vertex;

FIG. 39 shows a small house having a subdivision into meshes of a few formats shaped according to FIG. 38 and of special mesh-formats on the building's openings;

FIG. 40 shows the cross-section of a butt-joint between two canted metal sheets each having a mesh's size;

FIG. 41 shows the cross-section of a butt-joint between two sandwich-panels each having a mesh's size FIG. 42 shows the cupola of an observatory;

FIG. 43 shows a dome being generated around a cube, having a hatched spatial quadrilateral that resembles to a rhombus and consists of four large mixed-curved sherds whose one additionally is shifted apart downwards;

FIG. 44 shows an anticlastic sherd (bottom) within an infinite polyhedron being represented by a section thereof, and a synclastic sherd on a convex polyhedron being inserted in the infinite polyhedron, which is represented only by a small section and which, higher up, is only sketched by some broken lines, both sherds also being parts of a double sherd;

FIG. 45 shows a synclastic and an adjacent anticlastic sherd, having a translational subdivision into meshes, as well as an anticlastic double sherd;

FIG. 46 shows a synclastic and an adjacent anticlastic sherd, having a scale-trans subdivision into meshes and having an equal orientation of and mirror-like arranged corresponding chords and meshes within both sherds;

FIG. 47 shows a synclastic and an adjacent anticlastic sherd, having a scale-trans subdivision into meshes, both being centrically scaled;

FIG. 48 shows a synclastic sherd with a scale-trans subdivision into meshes, and an adjacent anticlastic sherd with a translational subdivision;

FIG. 49 shows a triangular cap of sherds with quadripartite sides;

FIG. 50 shows a nearly hemispherical shell of four caps of FIG. 49;

FIG. 51 shows a part region consisting of six anticlastic double sherds and their projection in plan;

FIG. 52 shows a continuous complex anticlastic shell that is stretched within the section of an infinite polyhedron of cubes;

FIG. 53 shows a shell's part region consisting of four anticlastic double sherds and of one synclastic sherd;

FIG. 54 shows a shell with four lateral vertical plane open enlargements and consisting of four part regions from FIG. 53;

FIG. 55 shows a shell's part region consisting of two synclastic and two anticlastic double sherds;

FIG. 56 shows a shell that consists of two caps according to FIG. 49 and of one part region according to FIG. 55 as well as of Its mirror-image and that is enlarged and open only on one side, as well as said shell's halved projection in plan;

FIG. 57 shows three shells adjoining to each other via two fluent transitions, each shell having a different number of enlargements;

FIG. 58 shows a part region consisting of two upper regions of FIG. 53;

FIG. 59 shows an undulated roof of nine part regions according to FIG. 58;

FIG. 60 shows a quadratic cushion-roof surrounded by three of these copied quarter-regions;

FIG. 61 shows a spectacular combination of sherds with formats of FIGS. 49 and 51;

FIG. 62 shows a shell with one open enlargement and one enlargement being closed by a concha of sherds with a smaller format;

FIG. 63 shows a continuous complex mixed-curved spatial shell with an undulated roof, a courtyard, as well as open or closed enlargements;

FIG. 64 shows a deformed small hemispherical shell of sherds with the format having been created for the concha in FIG. 62;

FIG. 65 shows a quarter-shell, that is, an undulated roof with a threefold symmetry;

FIG. 66 shows the transformation of a shell with a repeatedly changing curvature within a region that: has to be "bulged", is situated on its front, and is rendered in a magnified and pulled-out manner;

FIG. 67 shows the transformation of a shell being the mirror-image of FIG. 66, within a region that has to be "bulged" and is situated on its rear side being mirrored to the front;

FIG. 68 shows as the result of the transformations in FIGS. 66 and 67: a shell with two taken-out shell's pieces, hereinafter called "sherds' pairs, each consisting of two sherds but each being triangular;

FIG. 69 shows a sherds' pair to be changed, and, as the result, the sherds' pair being changed by the exchange of equally sloped chords;

FIG. 70 shows a sherds' pair being reduced to one single side of each of both sherds of FIG. 69, and to chords only directly joining to this side;

FIG. 71 shows the chords of FIG. 70, being shortened in vertical planes, and the first chords across them;

FIG. 72 shows the new array curves that are located within vertical planes and that are formed of parallel copies of the chords of FIG. 71;

FIG. 73 shows the completely changed new sherds' pair as a replacement for one in FIG. 68;

FIG. 74 shows a synclastic shell of ordinary quad sections and of double sherds according to the present invention, with a shell's opening that doesn't belong to an open enlargement;

FIG. 75 shows two interconnected shells with formats from FIGS. 49 and 51 and those from FIGS. 69 and 73;

FIG. 76 shows a shell of a part region of the shell from FIG. 68, and of its mirror-image;

FIG. 77 shows the geometrical construction of a mixed-curved region having to be bulged, by starting on both equally shaped and vertically plane border-curves, to result in a triangular synclastic cap;

FIG. 78 shows the continuation of the geometrical construction of the cap, which has been started in FIG. 77, until its horizontal border-curve below;

FIG. 79 shows the accomplished cap, inserted into a shell formed of a shell from FIG. 78, and consisting of sherds of a half cap from FIG. 78 and of its mirror-image;

FIG. 80 shows three different adjacent thick sherds with, equally oriented corresponding edges and faces in each sherd as well as having likewise corresponding lines connecting the outside and the inside surface;

FIG. 81 shows the region to be transformed, of the shell from FIG. 66, rendered only with one direction of curves but provided with the connecting lines from FIG. 80 for the determination of the construction thicknesses;

FIG. 82 shows the region from FIG. 81, transformed after the bulging-out, having interchanged corresponding chords of equal orientation;

FIG. 83 shows a sherd of large meshes including the large seam meshes that are formed as caps of small meshes;

FIG. 84 shows the geometrical construction of a basket arc shaped array side, for sherds in a building envelope having the shape of a rounded-off ashlar;

FIG. 85 shows the geometrical construction of a sherd with an array side of FIG. 84;

FIG. 86 shows a triangular cap of three double sherds of sherds that are generated according to FIG. 85;

FIG. 87 shows a load-bearing building envelope consisting of four triangular caps of FIG. 86;

FIG. 88 shows a load-bearing building envelope consisting of differently scaled caps;

FIG. 89 shows a synclastic sherd with the basket arc shaped array side, and an adjacent anticlastic sherd;

FIG. 90 shows a shell with two open enlargements of sherds having the formats of FIG. 89 and of their mirror-images;

FIG. 91 shows the start of the geometrical construction of a unidirectionally shrunken sherd with a short array side within a vertical plane and having mirror-symmetrically arranged corresponding chords being oriented in parallel;

FIG. 92 shows the geometrical construction of the seam meshes at this sherd with a scale-trans subdivision into meshes;

FIG. 93 shows a unidirectionally shrunken double sherd, which includes a completed second unidirectionally shrunken sherd with a translational subdivision;

FIG. 94 shows two unidirectionally shrunken anticlastic double sherds for bent-up free shell-border regions, and a synclastic sherd, all used in an eighth region of the half shell in FIG. 95;

FIG. 95 shows the diagonally cut-off half of a roof cantilevered from a central column, the half consisting of four eighth regions of FIG. 94;

FIG. 96 shows the diagonally cut-off half of an open pavilion having four corner columns and bent-up free shell-border regions, the half consisting of four eighth regions modified from FIG. 94;

FIG. 97 shows unidirectionally shrunken anticlastic double sherds, composed to result into a piece of a hollow skeleton with a continuous surface;

FIG. 98 shows a synclastic and an adjacent anticlastic sherd on a tetrahedron in a twofold symmetry in plan, as well as reduced double sherds thereof;

FIG. 99 shows an all-around closed boundless synclastic shell consisting of 24 synclastic sherds of FIG. 98;

FIG. 100 shows a continuous complex anticlastic shell that is stretched within the section of an infinite polyhedron of tetrahedra and octahedra;

FIG. 101 shows three triangular cushion-roofs, grouped around a tunnel's piece;

FIG. 102 shows a shell, seen from above, that consists of parts of FIGS. 99 and 100 and that has two inclined plane straight-lined acute-angled frame-shaped sides of trumpet-like shaped enlargements and a third opening consisting partly of sherds of another format;

FIG. 103 shows the shell of FIG. 102, seen approximately from the side;

FIG. 104 shows a shell lying upon its side and formed like a pistil's grip, whose thickly outlined one-third region is taken out from the shell in FIG. 102;

FIG. 105 shows a synclastic shell having two open enlargements and being formed of parts of FIGS. 99 and 100, to be considered also as a strongly bulged barrel-vault;

FIG. 106 shows a synclastic and an adjacent anticlastic sherd on a halved octahedron in a twofold symmetry in plan, as well as reduced double sherds including these sherds;

FIG. 107 shows a hemispherical shell of sherds with the synclastic format of FIG. 106;

FIG. 108 shows a continuous complex anticlastic shell that is stretched within the section of an infinite polyhedron of cubes in an inclined position and that consists of sherds with the anticlastic format of FIG. 106;

FIG. 109 shows a triangular cushion-roof;

FIG. 110 shows a mainly synclastic shell with a low opening;

FIG. 111 shows a shell that consists of two

Figures 132, 133, 134, 135, 136, 137, 138, 139, 140, 141, 142:
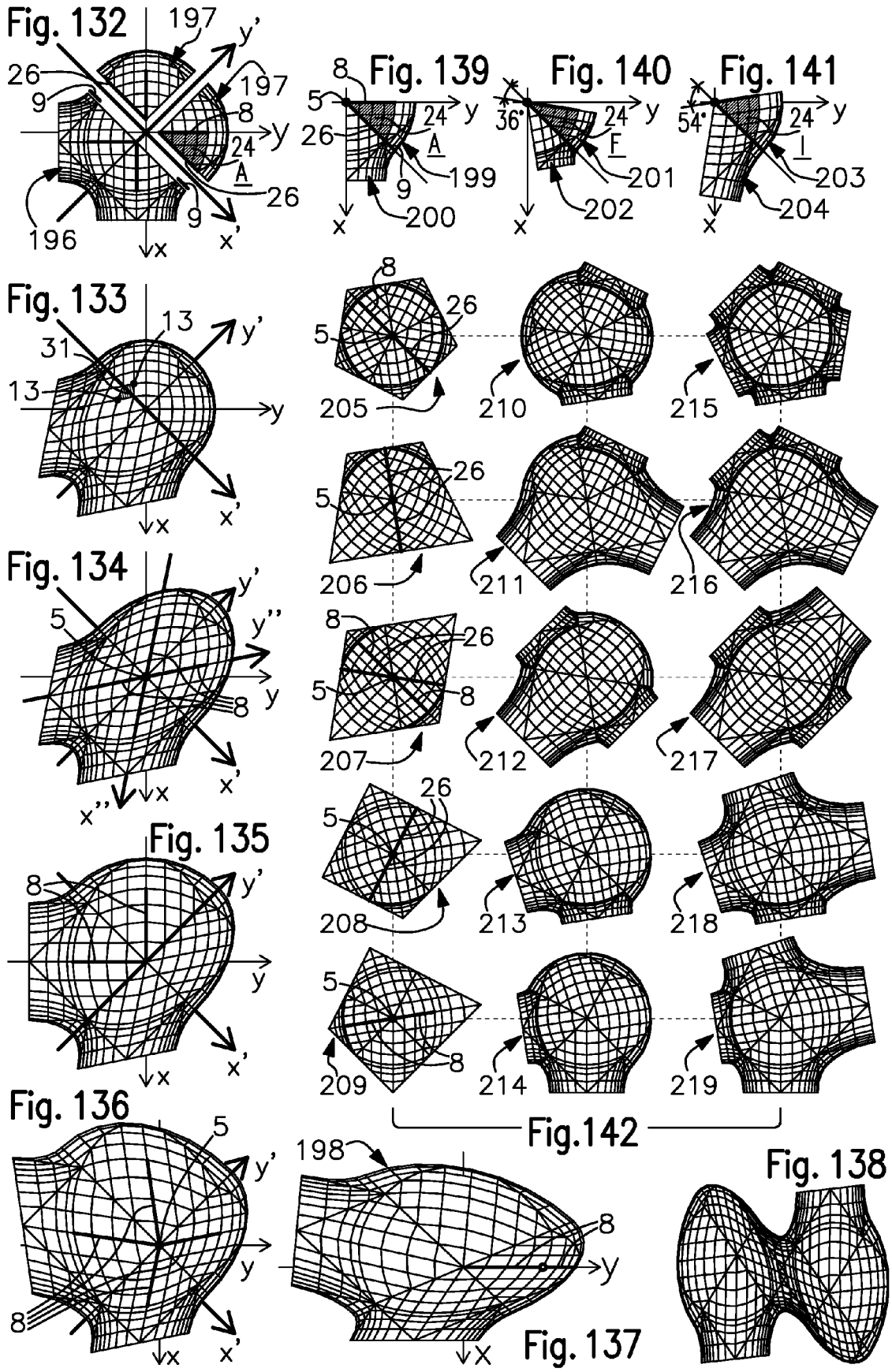

FIG. 112 shows a synclastic shell provided with enlargements and consisting of two part regions in the front of FIG. 110, to be considered as a whole also as a slightly bulged barrel-vault;

FIG. 113 shows a shell from FIG. 112, enlarged in the front by a thickly outlined anticlastic part region from FIG. 108;

FIG. 114 shows a roof having a serrated longitudinal section and consisting of three copies of the rear part region from FIG. 112;

FIG. 115 shows a bulged undulated barrel-shell consisting of three scaled copies of the shell from FIG. 112;

FIG. 116 shows a synclastic, an adjacent anticlastic as well as another anticlastic sherd, on a tetrahedron in a onefold symmetry in plan, as well as two reduced copies made thereof;

FIG. 117 shows a closed synclastic shell consisting of synclastic sherds with the format of FIG. 116;

FIG. 118 shows a shell with one open enlargement, consisting of double sherds with the two formats of FIG. 116 and one mirrored anticlastic format;

FIG. 119 shows a synclastic, an adjacent anticlastic, as well as another anticlastic sherd on a one-eighth piece of a pentagonal dodecahedron in a twofold symmetry in plan, as well as two reduced copies made thereof;

FIG. 120 shows a dome provided with one open lateral enlargement and one enlargement at the top and consisting of double sherds with a synclastic and an anticlastic format of FIG. 119 and an anticlastic format mirrored from the latter one;

FIG. 121 shows two synclastic and two anticlastic sherds on a halved cuboctahedron, as well as three reduced double sherds made thereof;

FIG. 122 shows a dome with one open enlargement, consisting of double sherds with the three formats of FIG. 121 and one mirrored anticlastic format;

FIG. 123 shows two adjacent synclastic sherds on a one-eighth piece of a truncated icosahedron, as well as two reduced double sherds made thereof;

FIG. 124 shows the quarter of a closed synclastic shell, consisting of double sherds with the two formats of FIG. 123 and another format mirrored from the smaller one of them;

FIG. 125 shows four different synclastic sherds on a one-eighth piece of an inflated icosahedron or on a quarter-piece of a geodesic dome, as well as three reduced double sherds made thereof;

FIG. 126 shows the quarter of a closed synclastic shell, consisting of double sherds with the three formats of FIG. 125 and one mirrored format;

FIG. 127 shows a lateral synclastic sherd adjacent on the incompletely drawn mirror-image of an upper synclastic sherd, as well as an anticlastic sherd adjacent to the upper sherd, and another anticlastic sherd adjacent to it, all on a triangular prism, as well as three double sherds made thereof;

FIG. 128 shows a shell with one open enlargement, consisting of double sherds with the three formats of FIG. 127 and one mirrored anticlastic format, whereat this shell, along with three trilaterally opened shells, is going to form a complex shell with a continuous surface;

FIG. 129 shows a synclastic sherd adjacent to the incompletely drawn mirror-image of an upper synclastic sherd, and additionally, another, not mirror-symmetrical synclastic sherd below, as well as an anticlastic sherd adjacent to the upper synclastic sherd and three other interconnected anticlastic sherds of different formats, all these sherds on a hexagonal prism; as well as four double sherds made thereof;

FIG. 130 shows a flat shell with an open enlargement, consisting of double sherds with the four formats of FIG. 129, besides of double sherds of one laterally inserted, mirrored format being synclastic and of two mirrored formats being anticlastic;

FIG. 131 shows a comprehensively extended shell, consisting of two shells opened all sides and of a half of such a shell, all of it consisting of sherds with formats being used in FIG. 130;

FIG. 132 shows as an object for a partial scaling in FIG. 133: a shell around a cube, shown in top view and consisting of sherds being shaped like in FIGS. 50 and 52

Figure 143:
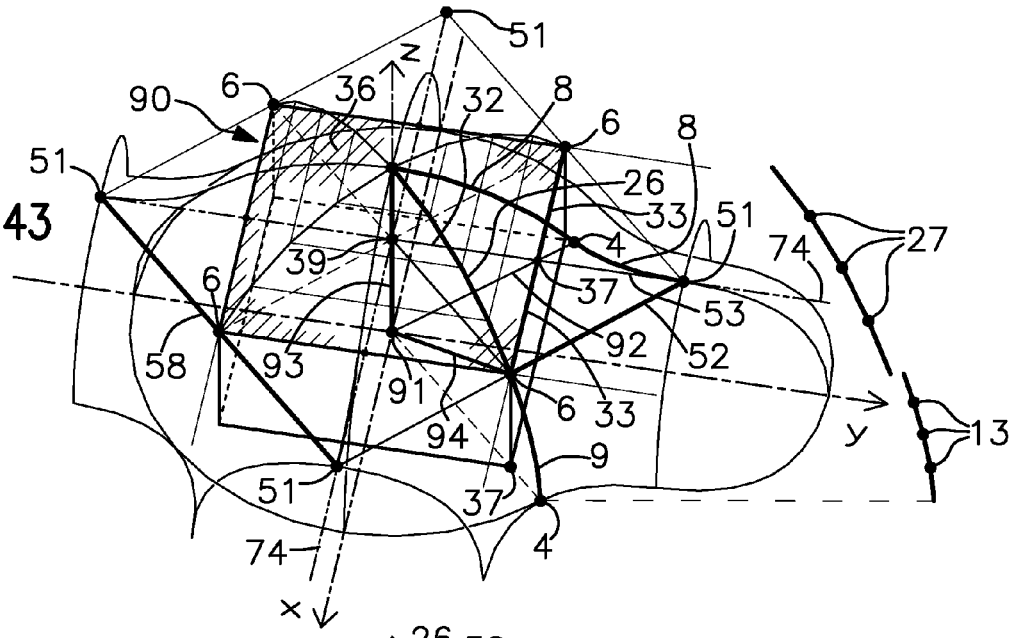
Figure 144:
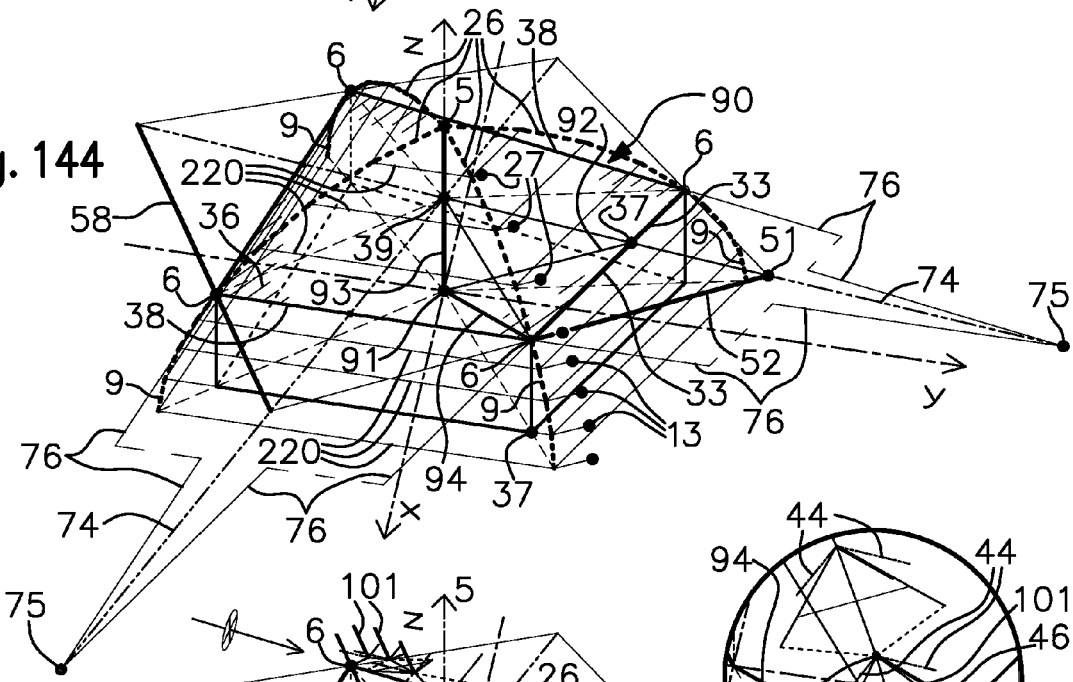
Figure 145:
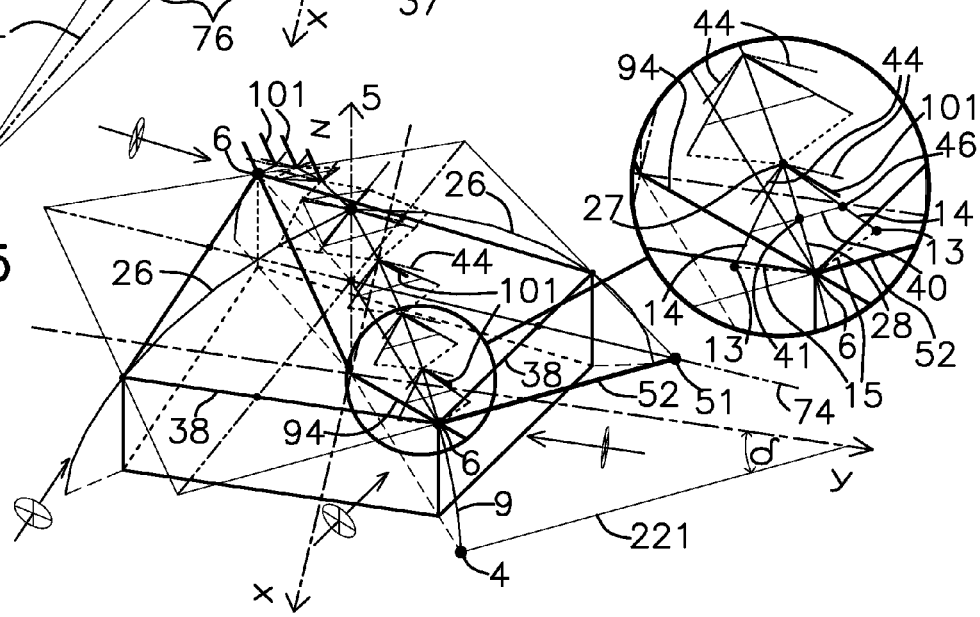
Figure 146:
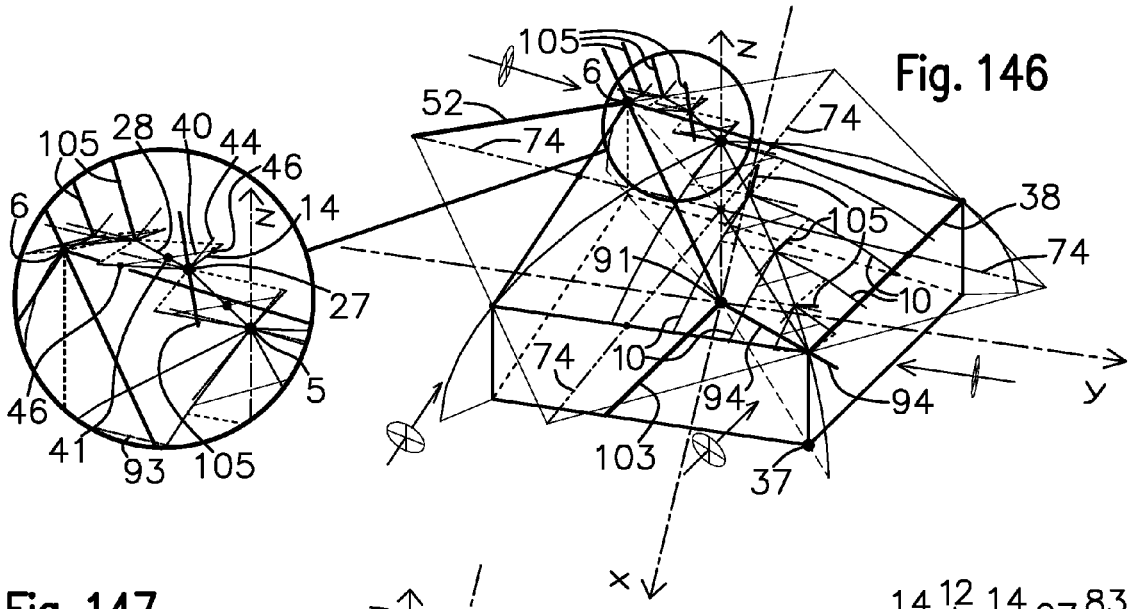
Figure 147:
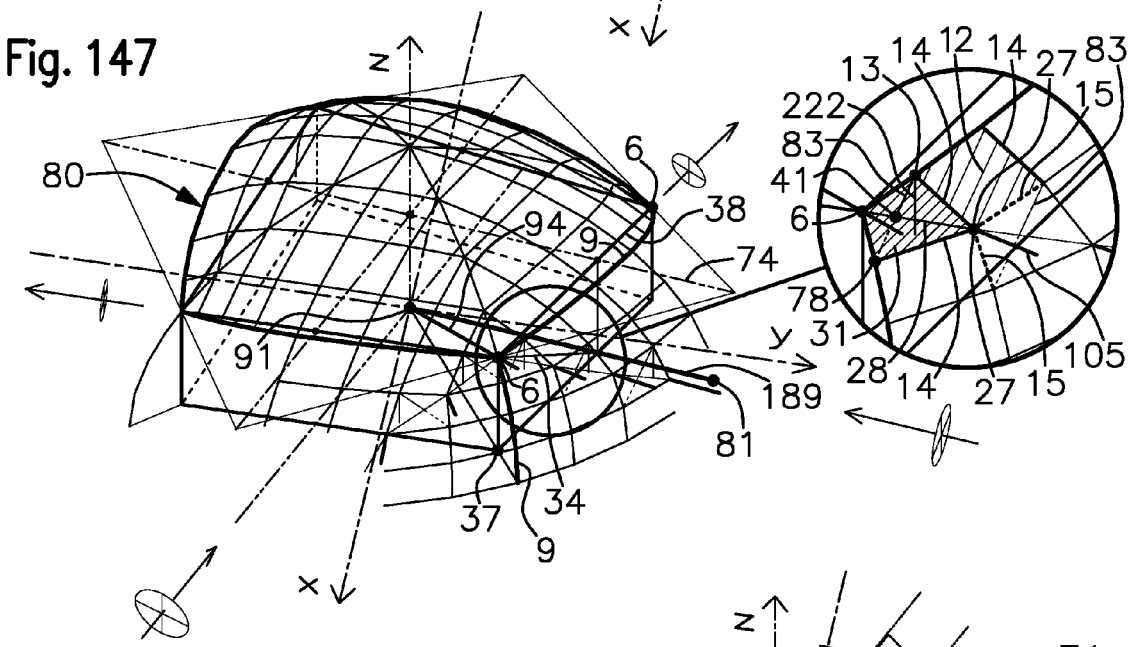
Figure 148:
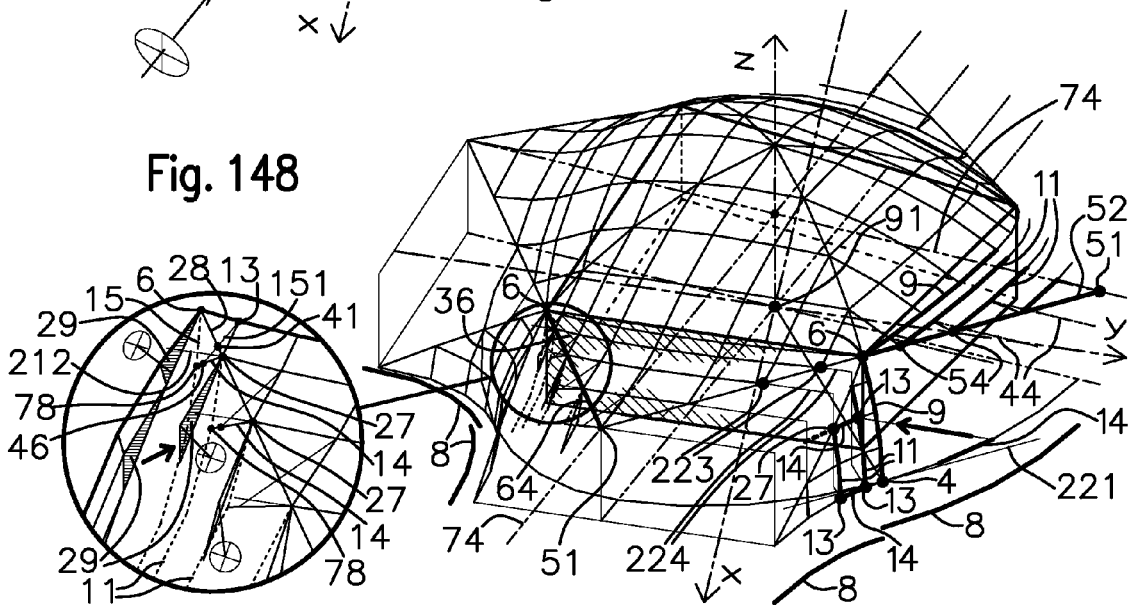
Figure 149:
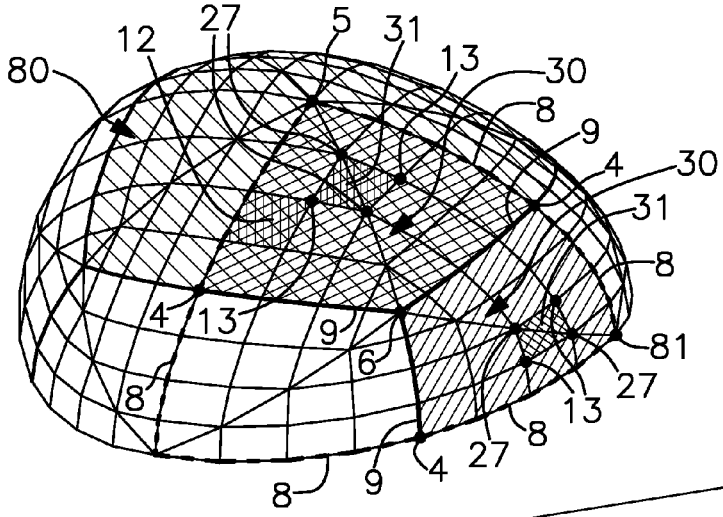
Figure 150:
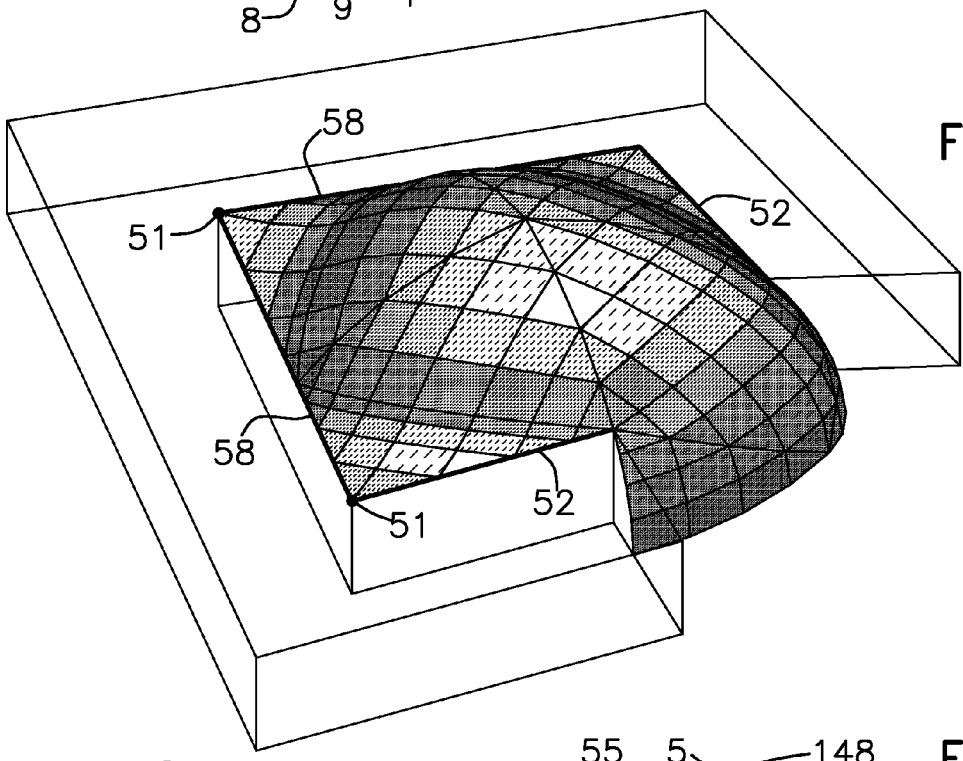
Figure 151:
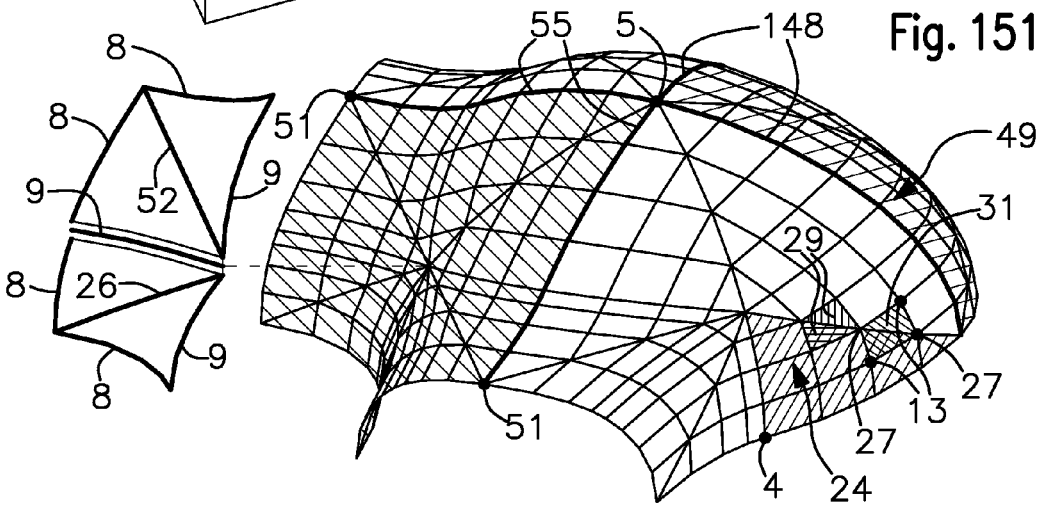
Figure 152:
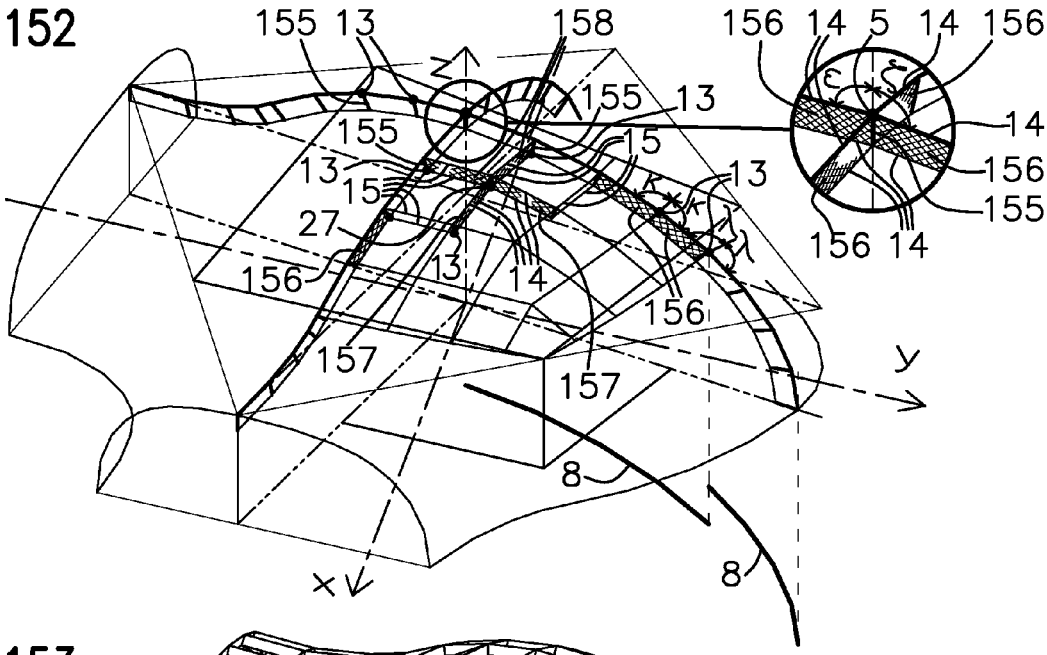
Figure 153:
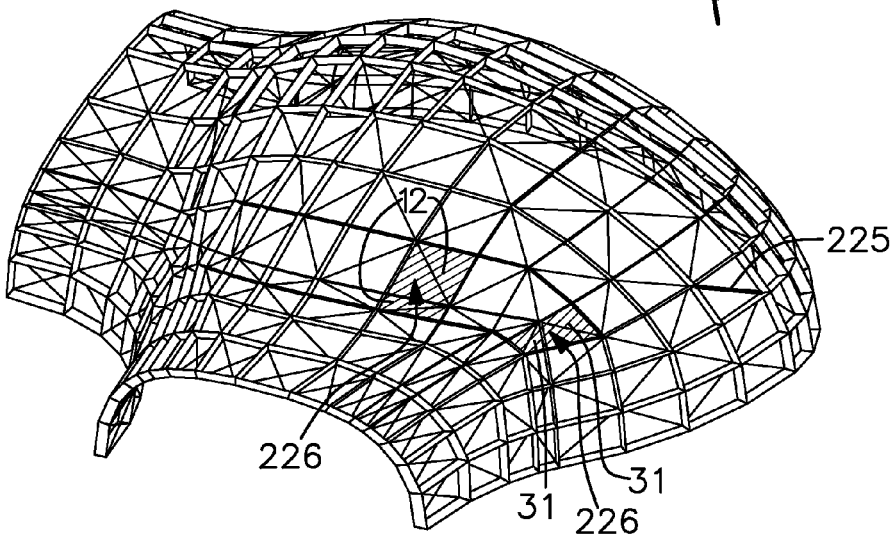
Figure 154:
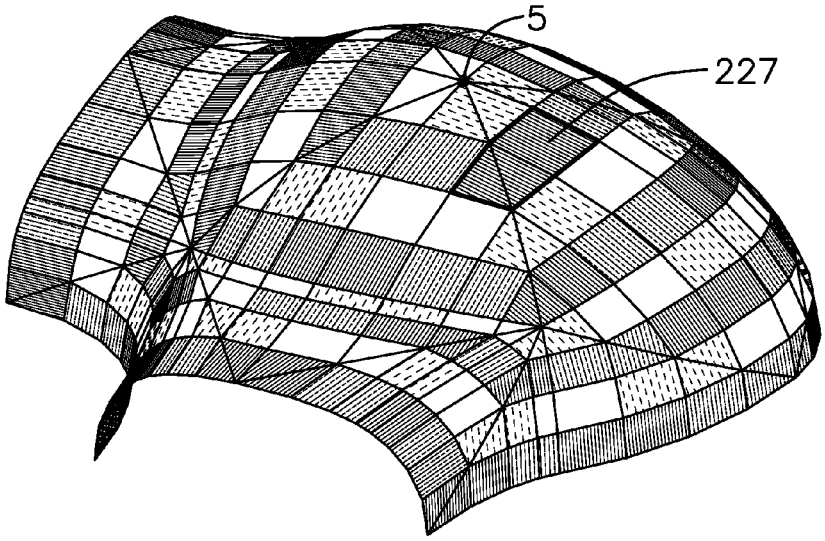

FIG. 133 shows a shell like in FIG. 132, having been stretched in the lower left region;

FIG. 134 shows a shell like in FIG. 133, having been stretched in the upper right region;

FIG. 135 shows a shell like in FIG. 134, having been stretched in the upper left region;

FIG. 136 shows a shell like in FIG. 135, having been stretched in the upper left region once again;

FIG. 137 shows a shell like in FIG. 135, having been scaled and stretched as a whole;

FIG. 138 shows two shells like in FIG. 136, having been interconnected and forming a continuous shell surface;

FIG. 139 shows a part region in the lower right x-y quadrant, from a shell like in FIG. 132 with angles of 45° between the vertical planes of two curved sides of a sherd;

FIG. 140 shows a part region of a shell with angles diminished as against FIG. 139, between the vertical planes of two curved sides of a sherd, whose one is unchanged;

FIG. 141 shows a part region of a shell with angles increased as against FIG. 139, between the vertical planes of two curved sides of a sherd, whose one is unchanged;

FIG. 142 shows several cushion-roofs with different plane border-polygons and several shells with open enlargements differing by their number and their orientation, being formed of sherds with the formats of: FIGS. 139, 140, and 141, and of their mirror-images;

FIG. 143 shows the geometrical wireframe of a shell circumscribing a cube;

FIG. 144 shows the geometrical wireframe of a shell circumscribing a prism having an irregular footprint;

FIG. 145 shows the geometrical construction of seam meshes of an upper irregularly quadrilateral cap with a translational subdivision into meshes;

FIG. 146 shows the geometrical construction of seam meshes of an upper irregularly quadrilateral cap with a scale-trans subdivision into meshes;

FIG. 147 shows the completed net of the upper quadrilateral cap, according to FIG. 146, and the geometrical construction of two synclastic sherds adjacent to it, that proceeds mesh by mesh from the common corner point on the right in the front;

FIG. 148 shows the upper cap's net already enlarged completely to result in a cushion-roof, as well as the net of three anticlastic sherds on the lower shell-border, and additionally, magnified on the left: the geometrical construction of seam meshes strung on a straight segment of a cushion-roof's side, for one of two still missing anticlastic sherds of the frontal enlargement;

FIG. 149 shows a closed synclastic free-formed shell that is generated according to FIG. 147;

FIG. 150 shows a free-formed shell to roof and close a courtyard mostly being enclosed laterally by a conventional building;

FIG. 151 shows a free-formed shell with two open enlargements adjoining at a corner, as the best mode to solve the problems of the shell in FIG. 1 (bottom);

FIG. 152 shows the geometric construction of the shell of FIG. 151, with material thickness;

FIG. 153 shows the shell according to FIG. 152, shown as a framework, with intransparent faces being approximately oriented perpendicularly to the shell surface and representing bars or abutments of plates, and with transparent mesh faces;

FIG. 154 shows the shell according to FIG. 152, of alternately dark and bright rings of successively mounted rows of meshes, roofed with thin areal elements comprising two or three meshes.

DETAILED DESCRIPTION OF THE INVENTION

An aspect of the invention includes the interconnection of spatial triangles, which already were called sherds, having a TST-subdivision into meshes. In FIG. 2, such sherds 24 are shown.

In FIG. 2 (bottom), there is, like in the curved surface of the shell 1 according to the state of the art in FIG. 1 (top), an ordinary quad section 3, which is hatched on the four sides. But this time, it is the section of only a simple translational surface, which besides is not mixed-curved but purely synclastic. Nevertheless here, this ordinary quad section between the corner points 4, 5, 6, 7 is formed of a net of two array curves 10, 11 crossing each other in node points 13. The ordinary quad section is composed of quad-meshes 12 of equal number in the longitudinal and the transversal direction and being located between four coplanar node points 13. On two sides, it is bounded by array sides 8, 9, offset in the drawing. At the same time, the array side 8 ending on the uppermost corner point 5 runs in the direction of the array curves 10 running from the front to the background. The other array side 9 ending at the lowest corner point 6 runs in the direction across it.

As a difference to the ordinary quad section 3 in FIG. 1 (top), the ordinary quad section in FIG. 2 is diagonally divided by a continuous "cutting curve" from the lower corner point 6 to the upper corner point 5. Within each bisected mesh, this curve passes through mutually diagonally positioned and hereby special node points 27 of the node points 13, that are called "cut-seam nodes" hereinafter. Hereby, each of the quad-meshes 12 that have been subjected to the dissection has been divided by a segment 28 of the cutting curve, being called "cutting chord", into two triangular meshes 29, hereinafter called "cut triangles". To distinguish them from the cutting chords, the chords remaining from the quad-mesh are called "array chords" hereinafter:

The diagonally hatched one, situated on the corner point 4 (bottom right), of the both parts of the known ordinary quad section 3 visible completely only concerning the outline accompanied by the border hatching has been kept, and the other, upper part, situated on the corner point 7 (top, right), has been removed. The kept part between the both array sides 8, 9 and the cutting curve 25, and between three corner points 4, 5, 6 is a sherd. Its three corner points are: an unchanged corner point 4 of the formerly quadrangular TST-surface section, hereinafter called "array corner", and the both corner points 5, 6 of the diagonal cutting curve, hereinafter called "cut corners" of the sherd. All three curved sides of the sherd 24 are plane here in order to able to be interconnected after having been multiplied simply by mirroring.

In FIG. 2, the lower, hatched sherd 24 was copied upwards and mirrored in the plane of its cutting curve, hereinafter called "cutting-curve-plane", and copied, to result into a quadrangular, thickly dashed outlined double sherd 30. Double sherds consist of two sherds passing gapless and continually into one another on their common cutting curves fused into a "cut-seam curve 26. This continuous transition results from the fact that all node points 13, 27 being corners of two cut triangles 29 adjoining on a common cutting chord 28 are located in one plane, whereby these both triangles were able to be combined to give a novel, quadrangular mesh 31, called "seam mesh", shown in a pulled-apart position in FIG. 2 (top). On its four sides, such a seam mesh has not even longer only one pair of array chords that are parallel. Conforming with the shape of the double sherd as a whole, it is kite-shaped likewise.

Despite these seam meshes according to the present invention occur in nearly each accomplished building according to the present invention, they are mostly shown bisected in the figures. Mostly, also known parallel-sided meshes of two cut triangles that are fused again remain bisected in the rendering. Hereby, the cutting curves of the sherds remain visible. Thus, the geometric composition of a shell of sherds, which hardly is perceptible on an accomplished building, can be recognized in the drawing.

On site, the sherds without areal cut triangles can be completely pre-assembled on the ground in order to be brought into their final position with a crane. After this, the seam meshes are mounted. These meshes are either areal coverings upon four lattice bars or areal load-bearing components.

However, the assembly of a shell can be processed differently, as will be shown in FIG. 154. Then, only still from a geometrical point of view, the sherds and double sherds are the pieces of a shell. Yet, double sherds can be pre-assembled in principle too. According to the size of the double sherd, this can happen in the workshop, in the factory, or on the site's ground.

In FIGS. 2-11, the three side planes of each sherd are perpendicular to the x-y-ground-plane and are represented in FIG. 2, concerning the hatched sherd, as three straight intersection-lines 32, 33, 34. These intersection-lines bound a face 35, hereinafter called "sector".

In FIG. 3, you can see that this sector is a finely hatched portion of the coarsely hatched face 36 to be covered by a Bohemian dome, hereinafter called "basic polygon". The sector is situated between: the polygon's vertex, that is, the bearing point 6, and a point 37 at a basic-polygon's side 38, located here in its middle, and a special reference-point of the basic polygon, which is located here in the origin of the co-ordinate system x, y, z.

To be able to use a sherd as a module of a construction kit for vaults and Bohemian domes, the angles between respectively two of the three vertical side planes of each sherd were chosen in such a way that they result into 360° if they are multiplied with a determined integer number. Thus, in the array corner 4, these side planes have a right angle to be gathered from FIG. 2, in the lower cut corner 6 an angle of 30°, and in the upper cut corner 5 an angle of 60°. The lower cut corner 6 of the sherd 24 shall become the bearing point of a Bohemian dome, whilst the upper 5 shall become its zenith. The planes of the array sides, are called "array-side planes" hereinafter.

In FIG. 3, to this upper corner point 5 of the sherd 24 with a format A of FIG. 2 joins, by its corner point 5, to another synclastic sherd 24 with the format B of a vaults' construction kit that is shown up to FIG. 15, including its combination possibilities. This other sherd has equally shaped array sides like those 8, 9 in FIG. 2. Yet, the equally shaped array sides have interchanged positions. That implies that a sherd with the format B has no longer, like a sherd with the format A had, an array side 8 that joins to the zenith, with the format s1, but one with the format s2, as well as no longer an array side 9 that joins to a future shell-support 6. with the format s2, but one with the format s1. Besides, two angles are exchanged. The both planes of the sides have now, in the case of the sherd of the format B, an angle of 30° to one another in the zenith 5, whilst those on the bearing point 6 have now an angle of 60° to one another. The new sherd B vaults another sector 35 that has the same shape like the former one indeed, but whose other, more acute corner lies in the point 39 in the co-ordinate-system's origin below the zenith 5.

In FIG. 3, after having been copied, each of the both different sherds with the formats A and B has been mirrored in its cutting-curve-plane as well as in one respective of its array-side planes. The mirrored specimens, one with the Format A' and one with the Format B', shifted upwards here, together result into a mirrored image of the ordinary quad section 3, which is known from FIGS. 1 and 2, with twice two array sides 8, 9. The format of this quad shell-piece is called A'+B'. In pairs, the cut triangles 29 have become a known quad-mesh 12 here again.

Within an accomplished shell, the number of chords per sherd side is uniform and can freely be chosen. But in the case of a faceted implementation, each of the three sherd sides should consist of at least three chords in order that a curved surface can still recognized, whose individual components show not too strong miters at their ends and edges, in the case of a faceted implementation.

FIG. 4 shows how the sherds were generated. There, within the vertical x-z plane as a mirror-plane, each of the both cut-seam curves 26 meeting at the zenith 5 is the curved side to be determined for two sherds of a double sherd. Up to FIG. 7, each cut-seam curve 26 is shown as a polygonised circle arc subdivided equidistantly by cut-seam nodes 27. It might have any other shape as well. Two sherds' arcs of sides lying after one another, that lie upon the same circle, provide most simply for regularity an continuous surface-transitions. This still applies by the way even if the equidistant subdivision is abandoned by a stretching of the circle including node points and inflexion points, to result into an ellipse, and if, within the curse of the arc, the amounts of the chords' fold-angles increase regularly whilst the chord-lengths decrease regularly.

Than, in FIG. 4, the seam meshes 31 were designed along the two cut-seam curves 26. At first, the orientation of each of the planes wherein their four corners as node points 13, 27 have to lie has to be fixed.

As can be seen in a loupe-like section on the side, this has happened by a horizontal line 40, hereinafter called "horizontal traverse line", through an arbitrary point 41 at the cutting chord 28. Than, this line has been cut off within planes of array curves, hereinafter called "array-curve planes", that are represented in the x-y-ground-plane by parallels 42, 43 of the sector-edges 32, 33 or by these edges themselves. From up the lower of both cut-seam nodes 27 within the loupe-like section, the auxiliary lines 44, 45, which are likewise parallel to the sector-edges, have been drawn.

Than, at one symmetry-half, the longer array-chord 15 has been fixed here, at first concerning its orientation, by drawing a line from the lower of both cut-seam nodes 27 up to and endpoint 46 of the horizontal line. This endpoint is located perpendicularly above the auxiliary line 45. Then, this chord has been completed by lengthening it to the next array-curve plane. This plane includes also the short auxiliary line 44. The endpoint of the array chord 15 within this plane is the node point 13 which has been to be geometrically constructed. After this, the shorter chord 14 of the seam mesh has been drawn from the upper cut-seam node 27 to the net's node point 13.

Here, the array-curve planes cross each other at right angles like the cardboard-partitions of a cardboard box for wine, yet with distances varying from one mesh to the other.

Finally, quad-meshes with parallel chords 14, 15 with equal lengths have been joined to the array chords 14, 15 of the seam meshes. The result thereof was anticipated already in FIGS. 2 and 3.

The Bohemian dome 47 that is kite-shaped in plan is shown completely in FIG. 5. Each of its four plane vertical openings 2 has a border-arc 48 that is curved only in one direction, that consequently has not a disadvantageous turning point, and that consists of two equally shaped array sides 9 meeting in the apex 4. Each border-arc of the both smaller openings consists of array sides of the sort s1, each border-arc of the both larger openings consists of array sides of the sort s2.

By the way, the Bohemian dome in FIG. 5 of two sherds 24 with the different formats A, B, A', and B', which are assembled to result into two double sherds 30 according to the present invention and into two conventional ordinary quad sections 3, can be considered as one sole large double sherd.

In FIG. 6, a Bohemian dome 49 of three double sherds 30 with the format A+A' was formed. Each of these double sherds consists of a synclastic sherd with the format A and its mirror-image A'. Here, the double sherds are obtuse-angled at the top. The basic polygon 36 of the shell is an equilateral triangle. Each sherd covers a sixth of the of the basic polygon. The reference-point 39 of the shell lies in the centrepoint of the basic polygon having three sides 38. In this shell, each cut-seam curve 26 is located at the same plane like a thickly drawn, another double-sherd's array side 8 joining at the top in the zenith to this cut-seam curve. This is implied by the odd number of the polygon's sides.

In FIG. 7, a Bohemian dome 50 of six double sherds with the Format B+B' was formed. Each of these double sherds consists of a synclastic sherd with the format B and its mirror-image. The double sherds with this format are acute-angled at the top. The basic polygon 36 of the shell is an equilateral hexagon. Each sherd covers a twelfth of the basic polygon. Three times, respectively two thickly drawn array sides 9 that are located within the same plane meet in the zenith 5 of this shell. Correlatively three times, the cut-seam curves of two double sherds meeting in an opposed position on the zenith are located in one plane. This is implied by the even number of the polygon's sides. A plane of a cut-seam curve is called "cut-seam plane" hereinafter.

The surface-transition from one sherd to another one, across a shared array side 8, 9, is continuous because the respective adjacent sherds have been generated by starting from the same circle curve hitherto in order that both sherds can be considered geometrically as a part of one sole homogeneous translational surface.

In contrast to those of the cut-seam curve 26 in the hitherto presented examples, the node points between the chords of the array sides 8, 9 are not located at circle arcs. Thus, they are less regular. Because they have arisen nevertheless according to rules, the degree of folding between the chords and the length of the chords increases or decreases consistently in the case of a faceted implementation. This causes a regular impression.

The sherds in FIGS. 2-7 are triangular sections of translational surfaces. It was demonstrated how a basic polygon, here a triangle, a hexagon, or a kite, can be vaulted by a Bohemian dome of sherds with a few formats.

A triangular Bohemian dome 49 can be enlarged to result into a triangular cushion-roof. In FIG. 8, this enlargement process, representative of all sherds of the Bohemian dome, happens to only one sherd 24 with the format A situated above the most anterior sixth-sector 35. From this purely synclastic sherd, the shape of a purely anticlastic sherd is derived. By the array side 9 lying above the edge 38 of the basic polygon 36 of the Bohemian dome 49, this sherd shall adjoin to the existing sherd. The geometrical construction runs from a cushion-roof's bearing point 6 towards a future cushion-roof's corner point 51. This point is located in the intersection point of: a straight-curve 52, hereafter called "train-side curve", lying at a right angle to the longest side (hypothenuse) 34 of the sector 35, and of: an extension 53 of the side (kathete) 32, here as the shortest side of this sixth-sector, lying at a right angle to the basic-polygon's side 38.

To the lowest short array chord 14 of the existing sherd 24, a new array chord 14 has been joined below, having the same orientation like this one. But this one has another length. It ends at a first new node point 54 within the x-y-ground-plane and exactly within the straight train-side curve 52. Along with another train-side curve, such a side curve forms the border of an acute, cat-slide-roof like, sliding extension of the Bohemian dome roof. This extension being the corner region of a cushion-roof is shaped like the train of a dress, That is why this side curve is called "train-side curve". Then, to this first new node point 54, hereinafter called "train-node", a copy 11 of the lowest and most long array curve 11 of the synclastic sherd is joined by its lower endpoint, which, at the original, is a cut-seam node 27. At its lower endpoint, the short array chord 14, lying in the Bohemian-dome's sherd 24 with the format A, of the next higher situated cut triangle meets the lowest inner node point, that is, inflexion point 13 of the array curve 11 of the Bohemian-dome's sherd. As a copy 14 with exactly the same orientation, this array chord is joined to the equal place, that is, to the lowest inflexion point 13 of the copied array curve 11 within the Bohemian-dome's sherd. After the lengthening downwards also of this chord-copy, in analogy to the first new train-node 54 at the train-side curve 52, another new train-node 54 results on the right before the first one at this train-side curve. Then, to this one, a copied array curve is joined again, and so on.

By this, each of the quad-meshes 12 and each of the chords 14, 15 of the initial sherd 24 of the Bohemian dome receives a counterpart 12, 14, 15 with the same orientation within the new sherd, but in a mirrored sequence or distribution of seats, whereas the shared array side 9 is the mirror-line. Thus, starting from up the common, right-angled array corner 4, the both existing chords 14 for example, which respectively bound a hatched mesh 12 in parts, and their new corresponding, equally oriented counterparts 14 have the equal seat-numbers; in the shown example, these are the seats No. 2 and No. 3 in the row No. 3. The one hatched quad-mesh 12 has also a parallel, that is, equally oriented counterpart 12 with coplanar node points at the corners indeed. But this counterpart has another format and, in the case of a curved implementation, an inverted curvature, that is, a curvature with an inverse Gaussian sign. After the completion of the anticlastic sherd of a format C, the neighboring sherds, on their transition along the shared array side 9, have meshes lying in pairs side by side, whose surfaces are coplanar in the case of a faceted implementation.

In FIG. 9, the completed new sherd 24 with the format C is shown within an accomplished, equilateral triangular cushion-roof. As a circumpolygon, the triangle of its outline circumscribes the basic polygon of the Bohemian dome.

In analogy to the triangular Bohemian dome 49 shown in FIG. 6, also the hexagonal Bohemian dome 50 shown in FIG. 7 can be enlarged into a cushion-roof. In FIG. 10, this has happened in parts by a condensed analogy to FIGS. 8 and 9. Like in FIG. 9, a synclastic Bohemian-dome's sherd 24, with the format B this time, and a new anticlastic sherd 24 with a format D are highlighted here respectively several times by hatching.

The array sides 8 with the sorts s1 and s3 of the cushion-roof in FIG. 9 and with the sorts s2 and s4 of the cushion-roof in FIG. 10, that are not fused into a shared array side 9 of the both inversely curved sherds, but lying after one another, form a continuous curve 55 between the zenith 5 and a cushion-roof's corner point 51. This curve has a turning point in the corner point 4. It resembles the cross-section passing through a bell from its suspension point to its border. At the lower endpoint, as a rounded-off shape, this cross-sectional curve 55 has no gradient. Thus, there, it runs tangentially relative to the plane of the basic polygon and the cushion-roof's polygon, here within the x-y-ground-plane. Here, each train-side curve 52 runs within the x-y-ground-plane. In the sherd's corner 51 being one of the both endpoints of each train-side curve 52 and being likewise a sherd's corner point, the x-y-ground-plane lies tangentially to the curved surface of this sherd.

The slope of the cut triangles 29 along each train-side curve of the cat-slide-roof sherds with the formats C and D decreases from the middles 6 of the bearing shell sides towards the cushion-roof's corner points 51.

Within the accomplished cushion-roof 57 in FIG. 9 as well as in FIG. 10, the array corners 4 of four sherds meet at a single point. Together, these four sherds form a larger quadrilateral section 56 of a TST-surface, hereinafter called "composed quadrilateral", being bounded by four cutting curves 25 between altogether four cut corners 5, 6, 6, 51 and similar to a deformed rhombus. Here, this composed quadrilateral has two straight-lined and two curved sides.

In FIGS. 9 and 10, the bearing corners of the Bohemian dome are the middle of a side 58 between two corner points 51 of the straight-lined circumpolygon.

Bohemian domes 47, 49, 50 and cushion-roofs 57, 59 are able to be combined to give larger buildings. In FIG. 11, seven Bohemian domes 47 with a kite-shaped, two Bohemian domes 50 with an equilaterally hexagonal and one 49 with an equilateral triangular plan have been composed into a vault that includes also a conventional rectangular Bohemian dome 60 in the front on the right. Indeed, this rectangular Bohemian dome is composed of sherds with the equal formats A, A', B, and B' like the other cupolas. But it has to be considered again as only one sole homogeneous translational surface, which can be made of two ordinary quad sections 3 shaped according to FIG. 2 and of its mirror-images 3 shaped according to FIG. 3.

By means of the anticlastic sherds derived from the Bohemian domes and seeming to be cat-slide-roofs of them, also other cushion-roof's shapes with another, that is, a modified plan can be formed.

So, in FIG. 12, a cushion-roof 61 with the plan of a rhombus has resulted from two thirds of a triangular cushion-roof 57 and two sixths of a hexagonal one 59. This cushion-roof does not include double sherds in one embodiment of the present invention, because adjoining cut triangles are united everywhere only to result into a conventional quad-mesh 12, like in the conventional Bohemian dome 60. Nevertheless, the cushion-roof 61 includes continuous curves 55, according to the present invention, shaped like a half bell's cross-section according to an embodiment. Here, respectively two long ones and respectively two short ones of them are located together in one vertical plane. The both planes are at a right angle to one another.

In FIG. 13, a triangular cushion-roof 57 is reduced into a trapezoidal cushion-roof 62, by removing one third of it and replacing it by one third of a hexagonal roof 59. In FIG. 14, a hexagonal cushion-roof is enlarged into a pentagonal cushion-roof, by removing one third of it and replacing it by one third of a triangular roof. Twice in FIG. 13 and once in FIG. 14, respectively one curve 55 consisting of two array sides and having a half bell's shape is located in one plane with a cut-seam curve beyond the zenith 5. In contrast to that 61 in FIG. 12, the shells 62 in FIGS. 13 and 63 in FIG. 14 include again double sherds according to the present invention.

Differently shaped cushion-roofs like that 57 from FIG. 9 or that 62 from FIG. 13 are multiplied in FIG. 15 and composed, in a fluent, $C^1$-continuous transition to each other, to result into a novel undulated roof. Also in this process here again, respectively two cut triangles 29 fuse many times into one seam mesh 31, this time within a hatched anticlastic double sherd with the format C+C' and a not highlighted sherd with the format D+D'. Each of the both sherds of each such double sherd belong to another cushion-roof included in the undulated roof. The both straight-lined train-side curves 52 of this both sherds have lost their marginal position and hereby are fused at the same time into a straight cut-seam curve 64 being special among the cut-seam curves 26 and hereinafter called "train-seam line".

Within an anticlastically curved double sherd 30 with the format C+C', the planes of the meshes 31 filed one after the other on the train-seam line 64, that means more exactly, the planes that include their respective four node points are slightly turned against each other from mesh to mesh, around the respective horizontal cutting chord 28 as a rotation-axis. In contrast to this, within a synclastic double sherd 30 like that with the format A+A', the planes of the meshes 31 are turned slightly to one another from mesh to mesh around the respective horizontal traverse line 40 from FIG. 4, as a rotation-axis crossing the respective cutting chord 28 and running in parallel to the other horizontal traverse lines.

The undulated roof can also be cut off in a perpendicular plane including several former Bohemian-dome's border-arcs, whereby, as the roof's side, an undulated curve 65 appears. Around a common corner point 51 of cushion-roofs, the cushion-roofs are vaulted alternatingly upwards or downwards. In the case of those being vaulted downwards, the zenith 5 turns into a nadir 5.

Hitherto, that is, in FIGS. 5-15, only shells of sherds with array sides 8, 9 being straight-lined in plan and such ones with straight-lined train-side curves 52 were shown. The shells succeeding now have array sides or train-side curves being curved in plan at least in parts.

In the geometrical construction in FIG. 16, the formats of the seam meshes 31 with their cutting chords, their horizontal traverse lines 40 and the latter's intersection points 41 are exactly transferred from FIG. 4. Nevertheless, each seam mesh with an unchanged slope, was turned additionally around a respective axis oriented in parallel to the z-axis. This happened in such a way that the cut-seam-curve's projection 66 in plan shows fold-angles being equally large everywhere between the individual chords. The process of putting the cutting chords 28 one behind the other to result into the new cut-seam curve has been started from up the zenith 5. That is why all future bearing points 6 lie still within the x-y-ground-plane indeed, but at other places therein.

This time again, starting from up the seam meshes 31, their array chords 14, 15 being multiplied one-to-one had to be joined to each other towards both sides. Hereby, a shell 67 with four bearing points lying within the ground-plane has arisen, which is rendered in FIG. 17 as a parallel projection, as if it had been pressed into the ground-plane. This shell has four spatially curved border-arcs. Nevertheless, it can be enlarged by copies to result in a vault shown here only by the outlines of other equal shells. Then, the disposition of shells around one of its bearing points 6 is only rotational-symmetric indeed.

In analogy to FIG. 8, the free-formed shell 67 generated according to FIG. 16, which has border-arcs spatially coursing everywhere, is enlarged in FIG. 18 into a cushion-roof on a plane ground area. In a mirrored arrangement of seats, each mesh 12 of a synclastic sherd of the Bohemian-dome region has an equally oriented counterpart 12 within the anticlastic, cat-slide-roof corner-region of the developing cushion-roof. Likewise, each array chord 14, 15 has an equally oriented counterpart 14, 15. In FIG. 18, the mesh-formats and the orientations of mesh-faces and array chords are obviously not identical to those in FIG. 8.

The accomplished cushion-roof 68 is shown in FIG. 19. Its four sides 58 altogether lie within the x-y-ground-plane indeed but are curved now. In this context, the bearing points 6 of the included cushion-roof are turning points within the curvature of the horizontally plane sides of respectively two train-side curves 52 with a different direction of curvature. Each train-side curve 52 has another shape, whereby modular additions of several exactly equally shaped cushion-roofs resulting into undulated roofs are not possible.

Hitherto, only translational subdivisions into meshes were described in order to represent TST-subdivisions into meshes. The creation of a shell of sherds with a scale-trans subdivision into meshes happens hereafter by straightening the plan projection of two of the four border-arcs of a Bohemian dome 67 of FIG. 17. In terms of format and orientation, the seam meshes 31 in FIGS. 20 and 21 are identical to those in FIG. 16. As a new matter concerning all other meshes, that is, the normal quad-meshes, the chords of that array curves that are the longer ones here, during the process of moving parallel from mesh to mesh, are shortened, or, in a position beyond, behind the both cut-seam curves 26, extended. Only the shortened chords are shown in FIG. 20 also as a projection in plan. The changes of lengths shall be determined by the straight-lined extension line 69 of the plan projection 70 of a seam-mesh's respective array chord 14 being short here. In a view perpendicularly from above, the long array chords 15 copied as parallels are extended or shortened up to this line 69.

By this, within the shell accomplished in FIG. 21, each of the shorter array curves made of the shorter chords lying one after another is plane again indeed. But the array-curve planes are not again parallel to each other like in FIG. 5. The shell 71 cannot at all be composed to result into a vault, with other identical shells. Not all of its bearing points lie within one plane.

The anterior left double sherd 30 is asymmetric. It consists of two differently shaped synclastic sherds 24; the rear right one being likewise asymmetrical consists of a synclastic and of a mixed-curved sherd.

Also, the ordinary quad section 3 of the most anterior one of all sherds is shown hatched on its four curved sides from where it might have been gained.

Bohemian domes 67, 71 with spatially curved free border-curves as well as such ones 67 with spatially curved transverse arches within vaults can be suited by artistic or functional reasons. However, because of its diminished options for adding as well as from a static point of view, they are less favorable if the border-curves are not supported by closed walls, but free and self-supporting. That is why such bent Bohemian domes are not further described. They shall apply only there, where they result efficiently from an uneven ground or from uneven wall's surfaces.

In the examples following later, sherds with a scale-trans subdivision into meshes shall not develop by a spatial curving of cut-seam curves like in FIG. 21, but by a centric stretching of plane array sides.

Compared to the subsequent representations, the degree of subdivision of the previous sherds is rather high. In the further representations, the sherds have a lower degree of subdivision in order to be able to show the principle more clearly. The subsequent drawings can be imagined as having developed by omitting node points. Vice versa, it is also possible to insert other node points respectively. Then, subdivisions of any desired fineness have developed from the spatial surface produced in a more and more finely faceted manner into a completely rounded surface that is represented by the facetting in the drawings. A shell being rounded according to the present invention has always a fluent, that is, a tangential transition ($C^1$-transition) to a gapless joined neighboring sherd. Consequently, the drawn representation of faceted surfaces is a geometric special case being representative for the described general case.

All previous shells as well as the still following cushion-roofs can get the necessary construction thickness by copying their virtual net and shifting it perpendicularly upwards by one and a half times of the desired plate thickness or profiled bar's height. Then, the copy represents the net of the edges of an outside, faceted shell surface, while the initial virtual net itself represents the lower surface.

The sherds of the regular Bohemian domes in FIGS. 5-7, and especially of that one 60 in FIG. 11 have a translational subdivision into meshes. That is why the array chords 14, 15 lying side by side there within a sherd always are of equal length here.

If the sherds of such Bohemian domes, individually as a part of an assembly set for only one single shape of a cupola and no longer as a part of a building construction kit for various shapes of a cupola, were determined starting from up a equidistantly subdivided array side instead of a cutting curve, then, their translational subdivision into meshes would be suited especially for shells according to the present invention that are grid shells, because half the bars would be of equal length.

In FIG. 22, a Bohemian dome 49 that is triangular like that in FIG. 6 is shown. But this time, their sherds have a scale-trans subdivision that especially is centric.

The scale-trans subdivision into meshes in FIG. 22 has not to be confused with that in FIG. 21 wherein the planes of one array of curves, that are located side by side not in parallel and vertical there, intersect in numerous vertical lines completely without rules. Instead of this, in FIG. 22, these planes of the one array of curves of a sherd are inclined and intersect all in one horizontal line 72 now.

By fixing especially a circle arc to be the array side 9 to be determined, being an array curve to be stretched then differently, the number of mesh-formats of such a shell can be reduced considerably. Compared to the translational subdivision into meshes, described just before, more different chord lengths occur altogether indeed. But in each case, the number of different mesh-formats is lower. That is why a special kind of the centric subdivision into meshes of the sherds is better suited here for shells, according to the present invention, of load-bearing components for the meshes, that are areal such as sandwich-elements, than the translational subdivision into meshes.

The finer the subdivision becomes, the more numerous equal elements lie in a row, and the larger is the saving in formats of mesh-faces of an shell, according to the present invention, of sherds with a special, centric scale-trans subdivision into meshes, compared to a shell of sherds with an equally fine translational subdivision into meshes.

Something special is the mirror-symmetrical shape of the trapezoids of the filed, areal, uniformly mitered mesh-components with an equal format. This special quality excludes also the need for additional mirror-symmetrical formats that must exist in the case of trapezoids, each being asymmetric, for sherds with any centric scale-trans subdivision into meshes, and in the case of the parallelograms for mirror-symmetrical sherds with a translational subdivision into meshes.

The Bohemian dome in FIG. 22 without any construction thickness can become a shell of components being areal mesh by mesh and having a load-bearing and heat-insulating material thickness, by slightly scaling it down or up, from up the endpoint of the imagined reference-line 72, in contrast to the previous shells, whereby the outside and the inside surface are fixed. Hereby, equal mesh-formats result into equal components with equal miter-angles at numerous edges indeed.

In FIG. 22, the array curves 11 of all sherds like the hatched one with a format A are located within planes parallel to that of the array side, which are further on vertical, whilst the planes of the other array curves 10 being transversely oriented to them and crossing them are differently inclined relative to the x-y-ground-plane and intersect altogether in the imagined reference-line 72. In contrast to that one 16 in FIG. 1, this reference-line is completely horizontal and straight. The planes of the array curves 10 being inclined here are represented here by rectangular faces that concur in the imagined reference-line 72 in a fan-like manner. This reference-line is located within the further on vertical plane of that array side 8, which ends at the top in the zenith 5 perpendicularly above the midpoint 39 of the basic polygon.

In the case of a shell above a symmetrical basic polygon like here, this line is oriented normal to the vertical array-side plane. Consequently, the differently inclined planes of the array curves 10 are oriented perpendicularly to the vertical plane of the shell's border-arc, like the not inclined planes of the analogous curves 10 from FIG. 2 for the triangular shell from FIG. 6 with a translational subdivision into meshes are.

The hatched sherd 24 being situated in the front in FIG. 22 is geometrically constructed in parts in FIG. 23. This time, not the cutting curve was the sherd side being fixed at first and determining hereby, but the array side 9 with node points at a circle arc within the plane of the shell's border-arc. A chord 15 of this one had been copied and joined to a cut-seam node 27. The copied chord has been extended up to a node point 13. Hereby, it has become a chord 15 for the future side of one of the both symmetrical cut triangles of a future seam mesh. This node point 13 is located within one of the array-curve planes that intersect within the reference-line 72. In an imagined view aligned with the reference-line 72, these planes appear as radial lines. Then, a horizontal traverse line 40 has been joined to the node point 13. This line 40 ends in a point 41 within the plane of the cutting curve, here within the x-z-plane; it is oriented normal to this plane of a cutting curve. The chord 28 of this cutting curve, having been drawn then, includes the lower cut-seam node 27 and the point 41 at the end of the horizontal traverse line 40. At its top, this cutting chord ends at another inclined, radially arranged array-curve plane that includes also the chord 14 having been drawn immediately after this. A third thickly drawn chord 15 within a vertical array-curve plane has been copied likewise from the array side in parallel, has been joined to a node point of the next lower hatched cut triangle 29, and has been extended up to a point within an inclined, radially arranged array-curve plane.

It was not possible to start the geometrical construction in FIG. 23 of the sherd from FIG. 22 from up the cut-seam node 27 being shown as an example. It was necessary to start it from up the lower cut corner 6 of the sherd in the bearing point where the both lower array sides of the completed symmetrical double sherd meet.

In the same manner, the sherd with a new format B can be drawn in order to form a Bohemian dome being hexagonal like in FIG. 7.

However, if two sherds having different formats A and B shall have congruent cut-seam curves in order to be able to form an asymmetrical double sherd for Bohemian domes with a kite-shaped or rectangular basic polygon, not the sherd with the format B but still the fist drawn sherd with the format A can have the advantage of the special centric scale-trans subdivision into meshes. This advantage consists in the fact that many times there are several meshes with the same format.

Hitherto, Bohemian domes bounded in plan by straight lines and their fluent extensions being corner regions of cushion-roofs were described only above a regular or axial-symmetric ground-polygon. Yet likewise, the vaulting of an irregular ground-polygon is possible, as FIG. 24 shows. Moreover, the zenith 5 at the z-axis needs not be located above a point of the basic polygon as a reference-point being geometrically constructed in any ruled way. The deviation of the reference-point 39 from the gravity point can be recognized distinctly in FIG. 24. In this Figure, a Bohemian dome above an irregular quadrilateral of four straight lines 38 between four bearing points 6 is being geometrically constructed. These bearing points shall lie again upon long straight lines between the corner points 51 of a circum-quadrilateral as an outline of the cushion-roof developing by extending the Bohemian dome in FIG. 25. At first, the cushion-roof's first straight bearing border-curve 58 of two straight train-side curves 52 whose lengths differ here had been free to be turned around the most anterior bearing point 6 of the Bohemian dome. The three other straight bearing border-curves of the cushion-roof resulted then because the shapes of the Bohemian dome's basic polygon and of the cushion-roof's circumpolygon are mutually coupled firmly. This is because each corner point 51 of the cushion-roof shall lie at a hatched and double pointed "orientation-line" 74 that starts in the origin of the co-ordinate system and ends in the intersection point 75 of two extensions 76 of the edges 38 of the Bohemian dome's basic polygon. Each of these extensions is shown interrupted and shortened. Also the kathete, that is, a non-diagonal side 32 of a basic-polygon's sector 35 and its extension 53 lie upon this orientation-line. Here, these both lines lie no longer at a right angle to the adjoining side 38 of the basic polygon and no longer in its middle joining to them. Each orientation-line crosses a basic-polygon's side in an eccentric point 37.

In FIG. 24, the both orientation-lines 74 joining from behind to the reference-point 39 lie at one straight line along with the respective anterior orientation-line because imagined extensions of basic-polygon's edges 38 cannot intersect there behind because they diverge. For at least two sherds, an orientation-line 74 determines by parallels the exact orientation of those vertical array-curve planes that cross those that are aligned with the Bohemian dome's respective border-arc. In the plan projection onto the x-y-ground-plane, the array-curve planes are rendered here as dashed parallels 42, 43. The ones 42 thereof run in parallel to the orientation-lines, the others 43 in parallel to the basic-polygon's edges.

To enable to draw these lines, a determining array side 9 being thickly shown-off had to be fixed yet. This array side is one of two parts of a Bohemian dome's border-arc within the vertical plane above the side of a basic-polygon's edge, it starts at the anterior bearing point 6 and ends without any slope in an array corner 4 perpendicularly above the intersection point 37 of the underlying part 33 of the basic-polygon's side 38 with an orientation-line 74. The node points 13 of this array side lie at a circle arc. Now, they determine directly the next crossing array-curve planes and indirectly all other planes in parallel to the array-side plane. The plan projection of these node points has fixed directly the position of the dashed lines 42 parallel to the orientation-line. These parallels end at a straight connecting line 34 between: a corner point 6 of a Bohemian-dome's polygon and: the reference-point 39 in the origin. Hereby, the endpoints of the dashed lines 43 parallel to the part 33 of the basic-polygon's side 38 had been fixed. To the connecting line 34, other dashed parallels were joined, and so on. In the connecting line 34, the vertical plane of the cut-seam curve intersects the horizontal x-y-ground-plane.

The node-points' density, of the array side to be determined (9), might be varied also by increasing the shortening of their distances towards the upper end 4 in order to avoid a leap of the meshes' density from the developing sherd to the differently shaped sherd being not yet indicated in FIG. 24, adjacent on the right and being part of the differently shaped neighboring double sherd. But this hasn't happened here and wouldn't be conspicuous in a plate construction.

The drawing construction of the curved surface of the anterior double sherd has been happened by the constructing of the individual cutting chords of the cut-seam curve one after the other. As can be seen in the loupe-like section top left, it has started at the second-lowest node point 13 of the already determined array side. There, a horizontal traverse line 40 has been joined to. It runs in parallel to the both parts 52 of the future anterior cushion-roof's straight bearing border-curve 58 running through the anterior bearing point 6. This horizontal traverse line had had an undefined length. At first, it has been cut off at a point 41 being the intersection point with the cutting chord 28 still having been to be drawn, perpendicularly above the connecting line 34 between the bearing point 6 and the origin. By extending it, a straight line between the bearing point 6 and the already defined point 41 at the horizontal traverse line 40 became a cutting chord 28 ending in a cut-seam node 27. This cut-seam node is located perpendicularly above an intersection point 77 wherein four of the dashed parallels 42, 43 meet.

Thus, the right-hand cut triangle of the first seam mesh was fixed. Then, the left-hand one, now being asymmetric, has been made as follows: As a dashed line, the horizontal traverse line 40 has been extended again in order to end now in a point 46 perpendicularly above the second side 38 of the Bohemian dome's basic polygon, which adjoins to the bearing point 6. The line drawn between this point 46 and the bearing point 6 has been extended still up to the node point 78 within the next crossing array-curve plane in order to become the resulting chord 79 of a first asymmetrical seam mesh 31, which is shown hatched in FIG. 25.

Then, in FIG. 24 a thickly drawn copy of the second chord of the determined array side 9 has been joined in a parallel position to the top 27 of the completely defined quadrangle for the first seam mesh.

In parallel to the first horizontal traverse line, again a horizontal traverse line 40 has been joined to the top of this copy. In analogy to the first seam mesh, these processes have been continued and twice again repeated, until the zenith 5 was reached. From there to the rear downwards to a Bohemian dome's bearing point, the drawing process was continued then.

After this, it has been easy to complement the rest of the Bohemian dome by copying chords as parallels accordingly until their net of meshes has become complete like in FIG. 25. Being completed there as a net, the irregularly quadrilateral Bohemian dome 80 has been extended to be a cushion-roof, like it had happened in FIG. 8 to the triangular one 49 from FIG. 6.

In the same way like in FIGS. 24 and 25, an irregular Bohemian dome or a cushion-roof with more than four corners might arise.

Hitherto, all sherds of a shell have met exclusively in the zenith. The shell with a quadratic outline in plan in FIG. 26 has four corner points 81 wherein the cut corners of several double sherds meet. Because these do not meet in the zenith but somewhere far beside, such corner points hereinafter are called "by-zeniths". Here, at each by-zenith meet the corners of: an anticlastic asymmetrical double sherd 30 with the format A+B; a double sherd, mirror-symmetrical to this one, with the format A'+B'; and a synclastic symmetrical double sherd with the format C+C'. The four double sherds on the zenith 5 at the top together form a small conventional translational Bohemian dome.

The shell in FIG. 26 has a ground area consisting of not only one basic polygon but of four basic polygons. Each basic polygon has the shape of an isosceles rectangular triangle between the origin and two bearing points 6 that can be seen in FIG. 27. The six sectors of the isosceles rectangular triangle, which are not shown, meet in a point 82 perpendicularly below the by-zenith 81.

An eighth region of the whole cupola shell from FIG. 26, above a half basic polygon, is rendered in FIG. 27. There is also shown how an anticlastic double sherd 30 with the format A+B with the plane curved sides, which are shown as thick straight lines in the plan projection, and their parallels 42, 43 are developed at first.

The cut-seam curve 26 of this double sherd includes the most anterior bearing point 6. It is already determined. It is drawn thickly and is extended. It is straight-lined but sloped. It has acted as a rotation-axis for the seam meshes 31 turned against each other. The orientation of the planes of these seam meshes has been defined by inclined traverse lines 83 passing perpendicularly through the cutting chord 28 in an intersection point 41 as a rotation point. The angles of the distortion of the seam meshes differ slightly. This is shown by the parallel projection of the seam meshes that are reduced to a line, the projection being aligned with the straight cut-seam curve, downwards to the circle's face normal to it. All four cutting chords 28 are of equal length. The position of both lower array chords 15 of each seam mesh of this double sherd is fixed by the fact that both are located within a respective array-curve plane intersecting the x-y-ground-plane in a parallel 43 of a sector's edge 33 located on the shell's border. So, the side planes of this double sherd are at angles of 45° and of 135° to one another one time respectively, and of 90° two times, that is, angles of (360:n)°.

For the double sherd with the format C+C' drawn after that, a resulting, thickly dashed cut-seam curve 26 between the by-zenith 81 and the zenith 5 has been drawn at first. In the plan projection, its cutting chords are of equal length. The gradient of each individual actual cutting chord resulted again by its intersection point 41 with a horizontal traverse line 40 in the middle between two symmetrical array chords 15 of a seam mesh. The array chords are adopted from the uppermost array chord 9 of the anticlastic sherd with the format A+B. For the double sherd of the sort A+B, having been fixed at first, this array side 9 is only a resulting side; but for the double sherd of the sort C+C' at the top in the zenith, it is the determining side.

The geometric construction itself, shown in FIG. 27, does not yet guarantee fluent continuous transitions between two sherds with different formats on a shared array side 9. The specific distortion of the seam-meshes' planes is completely random. A regular visual impression results only from a repeated, partly or completely new geometric construction process. The surface-curvature of the shell's corner-regions on the supports is comparatively slight.

Also the shell in FIG. 28 with three enlargement openings is formed in a similarly free manner. Here, three double sherds 30 with the format A+B and three mirror-symmetrical ones 30 with the format A'+B' meet again at a single point 5, the zenith. Three array-side planes of each double sherd again stand upright on the ground area, whilst the fourth one recently lies within the x-y-ground-plane itself.

Each double sherd consists of a smaller, exclusively anticlastic sherd with the format A or A' and of a larger, mixed-curved sherd with the format B or B' being anticlastic on its lower corner point 6 and on its array corner 4, but synclastic on its upper corner point 5.

FIG. 29 shows the geometric construction of a double sherd with the format A+B. The anticipated resulting cut-seam curve does not run within a plane here, not even in an inclined one. The plan projection (84) of the cut-seam curve is shown as a curved line at the x-y-ground-plane.

At first, the determining array side 8, located within a vertical plane, of the left sherd 24 with the format A had been fixed as a quarter ellipse resulted from the regular stretching of an evenly subdivided quarter circle. Derived from a circle-arc's shape, the array side 9, lying within the ground-plane, as a bearing curve, has been composed temporarily of equally long array chords. In this state, within the other sherd with format B, only one single direction of curvature had resulted within the thickly dashed upper array side 85. As a consequence again, not anyone bending-up of the free supporting border-area of an enlargement for an intended continuous transition to a neighboring cupola of the same kind had developed. Thus, the resulting array side 85 for the apex curve of a shell enlargement had to have the shape of a curve whose initial and final gradient is zero and that has one turning point. To achieve this, the lower, horizontal array side 9 had to be bent to and fro sometimes.

Finally, the last resulting array side 86 within the vertical plane for the half of the opening's border of a shell enlargement necessarily has the gradient 0 at its upper endpoint in the apex point 4 whereby an acute arc as an opening's border-arc and surface-transitions being hereby discontinuous within the enlargements are avoided.

In an imagined view perpendicularly from above, the parallel auxiliary lines 44, 45 joining to the endpoints 27 of the cutting chords and being aligned here with the x and y direction show the planes wherein the array chords going to be geometrically constructed have to end. Also the inclined traverse lines 83, which cross the cutting chords 28 in an arbitrary point 41, run up to this plane again. These inclined lines start from up a node point 13 of a seam mesh.

A shell being curved in such a manner like in FIG. 28 can have also another shape, like the shell 87 becoming a part of a rounded-off tunnel-system in FIG. 31, shown in FIG. 30. Within a honeycomb-shaped plane grid-pattern, its central axes 88, hereinafter called "tunnel-axes", meet in grid-nodes 89 in each center of a shell 87.

The geometrical constructions in FIG. 27 and FIG. 28 are time-consuming. Besides, the shape of a cupola's border-arc and cross-section are still strongly coupled to one another. It is mathematically imprecise to manipulate individual facets or meshes like a sculptor or tailor. This implies the danger to cause individual folds that are too strong, that is, the danger of any discontinuity within the curved or seemingly curved surface as a whole.

Therefore, ruled proceedings are applied hereafter that facilitate to develop a suited shell shape being able to be generated then by software.

In doing so, more shell's pieces, which end at more corner point 5, 6, are used in a shell on one hand. On the other, the array-curve planes need no longer be only vertical or horizontal, but can take any orientation in space. To avoid to loose the spatial imagination for all that, regular or simple shell shapes are chosen as basic shapes being able to change into more irregular shapes as well as to be opened or closed simply along with fluent transitions.

Now, the previous proceeding for the development of more steeply-sloped shells and blobs becomes more spatial. Now, the basic polygon, that is, the polygon upon which sherds are spread is no longer a part of the x-y-ground-plane of the shell, but, as a plane face preferably lying horizontally, becomes now a part of a polyhedron 90, hereinafter called "basic polyhedron", visible indeed in FIG. 32 but conceived as a geometrical basis only. Hereby, no more than one only of the both array-side planes of each sherd based on it still stands perpendicularly to the respective basic polygon.

For the present, such a basic polyhedron 90 is convex and regular, for reasons of simplicity, that is, mirror-symmetrical, preferably a cube as it can be seen here, lying with its centre-point as a spatial reference-point 91 in the origin of the co-ordinate system and oriented in parallel to its axes.

At first, a right-angled triangular eighth-sector 35 of the quadratic, upper, horizontal face of a cube, as a basic polygon 36 was covered over with a spherical triangular surface belonging to a sphere's surface having the cube's midpoint as centrepoint. The curved sides of this section of a sphere's surface are located within the side planes of the sherds to be developed.

In this side planes as mirror planes, the sherds can be multiplied like in a kaleidoscope to result in a whole shell. In this case, the kaleidoscope's mirrors have to be imagined not to be arranged in parallel as usual, but to be running always through said centrepoint 91. Like the spherical right-angled triangle shown as an outline, also the sherd 24 with the format A, occupying this place with slight deviations from the sphere's surface and being included within the cap having been drawn in a position shifted to the side, has the corner-angles of 30° and 60°. Likewise, locally at each of its three corner points 4, 5, 6, it has a surface lying normal to one of the radial lines 92, 93, 94 between the respective corner point and the polyhedron's centrepoint 91.

Like before, two sherds 24 with the formats A and A' for example are composed into a double sherd 30, thus with a format A+A' here. Even if the double sherds deviate from spherical surfaces in principal, they approach to them very close, in most of the examples, still to be demonstrated, with a high degree of symmetry. Cause, the node points of the longer one array side 8, being vertical here, as a determined side, are the points that lie at a circle arc.

Several double sherds can be composed into a "cap" 49, 80. Here, the planes of the four border-arcs 48, each consisting of two array sides, of the quadrangular cap 80 are not perpendicular to the basic polygon like in the case of a Bohemian dome, but inclined at an angle of 45° with respect to its face-normal being here the z-axis. Thus, a Bohemian dome 80 according to the present invention is the special case of a cap 80, according to the present invention, with an incline of 0° of the border-arc's planes relative to the basic-polygon's normal.

While Bohemian domes can be composed into vaults via only discontinuous transitions, the caps, like the pieces of a ball, can be set to each other according to the aforementioned conditions in order to form the finely meshed surface of a steeply sloped convex shell like in FIGS. 39 and 42 via inconspicuous fluent transitions. Such a shell has now sherd's corner points 5 as "zeniths" at the z-direction as well as at the positive and negative x-direction and y-direction. It can also be subdivided differently into triangular caps 49 with other "zeniths" 6. The triangular cap 49, shown likewise in FIG. 32 in a position shifted away from the basic polyhedron like a quadrangular cap 80, has one plane border-arc being horizontal here and two plane border-arcs standing upright here. This cap spreads "above" a, or on a basic polygon lying sloped now and having the shape of an equilateral triangle, this time with an incline of 35.26° to the triangle's face-normal being the spacediagonal 92 of the cube. This triangle is the polygon of the side of an octahedron, the polyhedron dual to the cube. But we remain for some time at the cube as a convex basic polyhedron If you persist in the imagination that the node points of the determined, longer array sides 8, which form here the border-arcs of a triangular cap 49 of sherds with a translational or a scale-trans subdivision, lie exactly at the surface of a circum-sphere of the cube, than, the corner points 6 of the sherds deviate slightly from the cube's vertices towards the centre-point 91. Within all drawings, this confusing deviation between a sherd's corner and a basic-polygon's vertex is removed by enlarging the sherd very slightly from up the origin.

In FIG. 33 at first, we remain at a single sherd related to a cube being shown reduced there into an eighth. The special quality of the sherds 24 "above" polyhedra consists in the fact that their both array-side planes and their cut-seam plane do not intersect in parallel lines, like the mirror-plane of a kaleidoscope do, but meet by their intersection-lines 92, 93, 94 in the reference-point 91. The both array-side planes or the sections 95, 96, visible in FIG. 33, of these planes of a sherd 24 intersect at a right angle in the line 92 that connects the reference-point 91 to the array corner 4 of the sherd and intersects a basic-polygon's side 38, that is, a basic-polyhedron's edge in the edge's midpoint 37. In a vertical line 93 running through the basic-polygon's middle 39 at the z-axis, the section 97 of the cut-seam curve intersects the section 95 of the vertical array-side plane. Besides, in the spacediagonal 94 running through the cube's vertex 6, it intersects the section 96 of the inclined array-side plane.

Within the spatial sector region bounded by the three side-plane's sections 95, 96, 97, sections of intersecting array-curve planes are shown that are oriented parallel to one of the both sections 95, 96 of the array-side planes. Additionally, all plane's sections are rendered once again in a pulled-out position. In the example, the future sherd shall have three chords per curved side. For that reason, there are respectively two sections 98 of array-curve planes in a vertical position and two sections 99 of inclined array-curve planes being inclined 45°.

The sections 96, 99 of inclined array-curve planes intersect a vertical array-side plane within the y-z-plane in parallel lines 100 and a vertical section 97 of a cut-seam curve in parallel lines 101 that are parallel to the spacediagonal 94.

Starting from up the vertical x-z-plane including the section 95 of the array-side plane that is oriented here normal to a basic-polygon's side or polyhedron's edge 38 being largely hidden in FIG. 33 and that includes its side's middle, the generating process of the meshes is defined In FIG. 34. Within this vertical plane, that is, the y-z-plane, the determining array side 8 of equally long array chords 14 has been determined. Through its node points 13 run the parallel lines 100, wherein this plane intersects the array-curve planes crossing this array-curve plane.

From this array-side's uppermost node point 13 lying next to the zenith 5 and representing an inflexion-point, a horizontal traverse line 40 has been drawn into a direction oriented normal to the section 97 of the vertical plane of the cut-seam curve. This line 40 ended temporarily in a face's point 41 within this plane's section 97. Then, from the upper cut corner 5 of the sherd going to be generated, being identical, in this position, with the zenith of the future shell, a line 28 has been drawn to the face's point 41. As a cutting chord, this line has been extended to the cut-seam node 27 at which it meets the upper, crossing array-curve plane inclined 45° and represented, in an imagined view aligned with the x-axis, as the uppermost of the parallel lines 100. This cut-seam node 27 is the lowest node point of the uppermost seam mesh 31, accentuated by hatching, of a synclastic sherd 24, which already is included in FIG. 32, being anticipated in a finished state. The finally still missing fourth node point 78 of the mesh, on the left, resulted by the dashed extension of the horizontal traverse line 40 to the left, to the next array-curve plane, which belongs to the other sherd of the double sherd and which is located here directly within the x-z-plane and, in the case of other seam meshes, in a plane in parallel to the x-z-plane. Because of the cubic symmetry, this fourth node point 78 might result here yet more simply by mirroring the uppermost node point 13 of the determining fixed array side 8 in the cut-seam plane as a mirror plane. Because of the mirror symmetry of the basic polygon, the finished seam mesh 31 has, as well as the seam meshes joining to it, the shape of a kite. The other seam meshes were geometrically constructed in the same manner like the first one. In doing so, in parallel, a copy 14 of the array chord 14 belonging to the fixed array side and joining below to the uppermost inflexion-point 13 has been joined to the lower node point 27 of the upper seam mesh.

Within a triangular cap 49 in FIG. 35, the complementation by all other parallel chords of a synclastic sherd 24 being accentuated by a dense hatching has already happened. Additionally, the chords of the upper, hatched double sherd 30 are projected onto the x-y-ground-plane as thin continuous lines, and the chords of the both other equally constructed double sherds, as dashed lines.

As intended, the planes of the four array sides 8, 9 and of the cut-seam curve 26 of each double sherd meet in one common reference-point 91 that is here the centrepoint of the basic polyhedron, of the cube 90. The cutting chords 28 of the cut-seam curve 26 have different lengths—as well as the chords 15, lying after one another, of a resulting array side 9 within the plane inclined 45°.

But here, array chords 14, 15, lying side by side in a mesh's distance, of each of the both curves' arrays of a sherd respectively are of equal length. This is typical of the translational subdivision into meshes.

Like a single basic polygon in FIG. 22, also a regular polyhedron can be vaulted by sherds that have a special centric scale-trans subdivision into meshes and that manage hereby with only a few mesh-formats.

In FIG. 36 for example, the geometric construction of a sherd is prepared as a section of the surface of a convex solid with a rotation-symmetrical subdivision into fine meshes similar to a globe with parallels of latitude and meridians, whose node points deviate from the spherical surface yet. The poles have to be imagined to lie at the x-axis. So, the three perpendicular plane's sections 95, 98 represent the parallels of latitude, while the planes of the three plane's sections 96, 102 of the meridians converge and meet in the x-axis as a reference-line 103. Among the latter ones, only the section 96 of the plane of the inclined array side 9 is still the same, concerning format and incline of 45°. The equator curve within the plane oriented vertical, in the y-z-plane, and including the determined array side is wisely far away from the polar region being disadvantageous by the condensed subdivision into meshes.

Here, the reference-line 103 of a sherd, for the stretching of parts of an array side, is located, relative to this sherd, differently from the reference-line 72 in FIG. 22. Here, this reference-line 103 is not located within an array-side plane of the respective sherd, but normal to an array-side plane.

In FIG. 36, the radial intersection-lines 104 of the sections 96, 102 of the inclined array-curve planes, which comprise the section 95 with the vertical array-side plane, are shown in analogy to the parallel intersection-lines 100 in FIG. 33. Likewise in analogy to FIG. 33, the intersection-lines of the inclined sections with the section 97 of the vertical cut-seam plane are shown. But like the spacediagonal 94, these lines radiate from the origin as radial lines 105 Thus, they are no longer parallel to this spacediagonal.

The geometric construction of a sherd in FIG. 37 corresponds to that of FIG. 34. However additionally, all array chords 14 being copied in a parallel position from the array side 8 within the y-z-plane towards the sherd's surface have to get a stretching, that is to say, with a negative sign, thus a shortening. Thus, by their hereby new endpoints 13, they quite really already end at a respective section 102 of an inclined array-curve plane or at a section 96 of an inclined array-side plane and they do not remain too long. In a view aligned with the x-direction, the shortening, not yet having happened in FIG. 37, of the array chords 14 has to happen by the radial lines located within the y-z-plane. The joining to each shortened chord is the same like in FIG. 34. Merely the node points 13 within the sherd to be geometrically constructed and the cut-seam nodes 27 are at somewhat other places than the analogous node points in FIG. 34.

A triangular cap 49 is shown also in FIG. 38. Indeed, this cap has the same border-arcs and the other features like those described in the first both sections of the exact explanation for FIG. 35. But the scale-trans subdivision into meshes, being applied here, causes other shapes within the sherd accentuated by a fine hatching.

The chords 14 that lie one after another on a node point 13 in each individual curve 8, within a plane being normal to the basic polyhedron's edge, that is here, consequently within the vertical plane, still are of equal length indeed. But each such curve has another uniform sides' length. And the chords 15, lying side by side in a mesh's distance, of different curves 9, 11 within inclined planes are still equally long indeed but disparallel.

In FIG. 38, the differences of the area's sizes between the smallest and the largest mesh-format are larger than in FIG. 35. But the approach of the node points to the spherical surface is closer.

FIG. 39 shows a small house whose cupola's shape exceeds a hemispherical shape below by one row of meshes, whereby the insertion of vertical openings in the ground floor is facilitated and the attic story is efficiently usable. The mesh-formats a, b, c, d, and e come up exactly to the shapes of the version in FIG. 38. Additionally, there are three other formats f, f' and g for the other meshes. Partition-walls can be installed in the vertical array-curve planes. In a horizontal array-curve plane, a floor-slab can be installed neatly. The deviation of the node points 13 situated around the zenith from such a plane disappears within the material thickness of wall and ceiling. In the position on the base's border and on the lateral zenith 5, two kite-shaped seam meshes with the format a were replaced simply by trapezoidal meshes with the format d.

Instead of two kite-shaped seam meshes with the format a and two trapezoidal quad-meshes of the format d on the foremost zenith, a glassed double-door's vertical quadratic opening can be made, with a door-reveal's frame 106 running all the way around, provided for the connection to the surrounding mesh-panels and comprising also the threshold. Inevitably, this frame has a varying depth. That is why it has needed to have at least the same thickness everywhere. Because of this, the initially symmetrical, trapezoidal shape of each surrounding areal element adjoining immediately to it by an array chord, videlicet, by a flange has been changed in order that the end of the longer one of the parallel chords, differing by their lengths, of the trapezoid has been extended in a straight line to the opening. Thus, the both mesh-formats f and f', being new, opposed to FIG. 38, have become necessary. Into these domes, also a small 107 and a large 108 frame of a reveal of a roof window is inserted. The smaller one thereof belongs to a skylight than can be tipped up. Because of this skylight, the third mesh-format g being additional, opposed to FIG. 38, and being an isosceles triangle has become necessary for the three surrounding components. In FIG. 39, two cross-section symbols refer to two construction types, shown in FIG. 40 and FIG. 41 in the edge's cross-section, for shells with an areal load transfer.

In FIG. 40, two metal sheets 109 being folded twice inside on the border and being load-bearing, waterproofing elements enclosing space are abutting and bolted to one another within the butt-joint. The tightness is achieved by means of rubber profiles 110, jammed within the butt, with permanently elastic sealing bands 111 above and below them. Insulating panels 112, whose interstices are stuffed or foamed, are glued onto the inner side of the load-bearing canted metal sheet elements 109. Finally, facing plates 113 are glued onto the inside.

Because of the varying sizes of the scale-trans mesh-components from different rows of meshes and because of the low degree of subdivision of the dome, there is the advantage that several canted metal-sheet components of differing sizes can be laid one into another for transport. Instead of metal sheet material, also GRP or polymeric glass without insulation might be imagined.

In FIG. 41, the second areal construction type is shown. Two sandwich-panel elements 114 having reinforced borders are bolted to one another via butt straps 115 added unilaterally to them on the outside and inside. The pattern of the outer butt-straps can be seen schematically within the anterior right-hand region of the house in FIG. 39. There, only those halves of the butt-strap's profile are shown that stand out from the element and serve for bolting on site. The halves of the butt straps being attached fixedly to the element are not figured. The pattern of the butt straps' layout is rotation-symmetric equally around each node point 13. By means of infills 116, performed by self-expanding sealing bands, only tightness against wind can be achieved in the butt-joint between two panel elements 114. The tight roofing against rain has to be achieved with a not figured, separate layer.

This construction type from FIG. 41 is suited especially for the observatory cupola in FIG. 42 with the same mesh-formats a to f and f' like the house in FIG. 39. Here, the kind to subdivide this cupola exceeding downwards the approximated hemisphere within the lower region even by two rows of meshes enables easily the parallel-sided slit opening in the roof for the opening's cover 117 movable in a circle course. Despite the large, long opening, the opening's border of the observatory's cupola shall be stiff without a special reinforcement. For this, the construction type from FIG. 41 is the better one because it is more rigid because of the sandwich-layers' composite effect and because of the additional element-connection on the inside of the cupola.

Like the previous, purely synclastically curved shells in FIGS. 39 and 42, the mixed-curved shell 118 in FIG. 43 is generated around a convex polyhedron. It shows a homogeneous symmetrical composed quadrilateral 56 accentuated by hatching, similar to a rhombus, and located within four cutting curves 25 between four corner points 5, 5, 6, 6. This composed quadrilateral is composed of four sherds 24 located around a common array corner 4.

Also here, altogether three whole or halved composed quadrilaterals 56 meet on each respective trivalent corner point 6 located on the cube's vertex, whilst four composed quadrilaterals can meet here on each of the both other, n-valent corner points 5. If the regular basic polygon is not a cube, as will be shown later, than, the number n can vary.

In FIG. 43, the corner points 5, 6 of a rhombus-shaped composed quadrilateral lie nearly in a plane whereby their position approaches very closely to the vertices of a rhombic dodecahedron.

In FIGS. 39 and 42, the longer array side of each sherd had the shape of one single circle arc only. Here in FIG. 43, each sherd has synclastic as well as anticlastic surface regions. One such sherd has been copied here from the shell and has been pulled out downwards. Its array side 8, rendered with eight chords and located within a plane being vertical here or, that is to say, more generally speaking, within a plane being normal to a basic-polyhedron's edge, has a turning point, that is, a change of the direction of curvature or, in the case of a faceted implementation, a change of the folding direction. The uppermost four sherds of this array side are derived from the quadripartite array side of a sherd with a format A, intended for a purely anticlastic shell, which sherd can be seen on the top in FIG. 44.

With its comparatively numerous meshes, the mixed-curved shell 118 in FIG. 43 can be composed also of purely inventive, synclastic double sherds, of conventional, purely anticlastic quad surfaces, as well as of an inventive, purely synclastic triangular cap vaulted to the inside, with its zenith 6 in the cube's spacediagonal. In the representation of the shell, on the left above the negative x-y-quadrant, such shell's pieces are distinct from each other by thick curves.

Nearly all examples following now are reduced again to sherds with defined sides being unidirectionally curved already in the geometric generating process above a convex basic polygon.

Exclusively synclastic and exclusively anticlastic sherds are standardized hereafter for a modular use in such a manner that they fit to each other.

The beginning is, in FIG. 44 on the top, a cube as a convex basic polyhedron 90 like in FIG. 32, with a sherd 24 subdivided this time somewhat more finely into meshes and with the formats A used in a construction-system in FIGS. 49-79, above an eighth-sector 35 of a quadratic basic polygon 36 of this basic polyhedron.

As everybody knows, cubes can be packed closely, that is, arrayed and stacked without gaps. When you omit now, in a chessboard-like manner, from a close packing of hollow cubes, in each direction in space, each second cube, and when you open then completely two parallel polygons of each remained cube, as shown here only one time, whereat each time, the openings of six opened cubes face to a void location of a cube centered here in the origin of the co-ordinate system, then, an infinite polyhedron arises. An infinite polyhedron is a gapless polyhedral formation separating two interwoven, infinite spaces, being equal here, each forming a tunnel-system being very angular here. This infinite polyhedron 119 is shown in FIG. 44 (bottom) as a very small section.

Like a convex basic polyhedron does, an infinite polyhedron serves as a basic polyhedron for a shell that develops by being rounded-off. While the rounding-off of this infinite polyhedron, with monolithically produced, not faceted or triangulated hyperbolic paraboloids (hypar), which are bounded by straight lines and which are joined at continuous transitions into a Schwartz surface, is known, the possibility to subdivide the hypar surfaces into quadrangular meshes with coplanar node points and to join, in an inventive manner, the triangular meshes on the sides of neighboring hypar surfaces into seam meshes remained unknown up to now.

The anticlastic double sherds described hereafter and the anticlastic composed quadrilaterals 56, composed of them, for the shell in FIG. 52 are not hypar-shaped indeed. The anticlastic partial surfaces, strained into an infinite polyhedron in a rounded or faceted manner, shall be able to be joined to the inventive shell's pieces already determined concerning its shaping, of a corresponding convex polyhedron at a continuous transition. This is completely unknown up to now. The base is preferably the cube and the close cubic packing.

The meshes of a synclastically curved sherd 24 with the format A shall occur in equal number but in a modified shape also within an anticlastically curved sherd 24 with the format C.

Like the synclastic sherd above, also this anticlastic sherd below is located in FIG. 44 in the area of a hatched eighth-sector 35 of a cube's quadrat 36. This time nevertheless, the quadrat is a polygon of an already mentioned open cube shown here only by its lower half, which cube forms an angular tunnel's piece. The tunnel's piece can be narrowed by rounding it off with a plurality of this anticlastic sherds 24 with the format C. In doing this, there is not a "vaulting" process outwards from of a closed cube, but a "straining" process inwards into the space of the open cube. Each piece of a tunnel, in the shape of an open cube, has a tunnel-axis 88 through the polygon's middles 120 of this cube's both openings. The tunnel's axes 88 altogether of each of the both angular tunnel-systems form an imagined infinite cubic wire-frame grid. Both grids 121, 122 are interwoven to one another. The First grid 121 has exclusively grid-nodes 89, while, in FIG. 44, the Second grid 122, which is upset to it, has a grid-node that is special here and that is the origin 91 of the co-ordinate system in the middle of an omitted central cube.

Such grid-nodes 89, 91 co-determine the position of array-side planes, as will be explained later. The both spacediagonals 94 of two omitted cubes of the close cubic packing are located at a straight line between the grid-node 91 of the First grid and the grid-node 89 of the Second grid and meet in a common former vertex 6 of these both omitted cubes.

With its center-point 91, the closed cube 90 from FIG. 44 (top) can also be inserted in the origin of the co-ordinate system (bottom) in order to fill the gap of a cube there. This happens along with the synclastic sherd 24, which belongs to it, in order that the synclastic sherd 24 with the format A can adjoin without gaps and continually to the anticlastic sherd 24 with the format C. But this joining fits only if the array sides 9 of the synclastic and the anticlastic sherd are congruent.

Also the half parabolic cross-section of a known hypar surface might be fixed as the determining side for the synclastic as well as for the anticlastic sherd. But this is not recommended for the previously defined, most possible regular subdivision of the synclastic sherd.

Therefore, it must be maintained that the array side 9, which, within a plane inclined 45°, the anticlastic sherd has in common with the synclastic sherd, is being adapted to the sherd being synclastic, whereby the known parabola shape is rejected in favor of a mathematically unknown shape that also is not a sinus curve.

The FIGS. 45-48 show different solutions to generate an anticlastic sherd, in dependence of a synclastic sherd. They all have in common that the vertical array-side planes of the synclastic sherd, which generally spoken are planes being normal to a basic-polyhedron's edge, shall apply to the anticlastic sherd too. In each of these drawings, the synclastic sherd and the anticlastic sherd, which is going to develop, can be mirrored, and all that can be copied in quadruplicate around the uppermost corner point 5 as a zenith of a cushion-roof arising hereby. Within a shell built according to FIG. 45, 46, 47, or 48, at least two pairs of sherds occur, each of both with a shared array side 9, that together form a TST-surface's section being quadrilateral and bounded by four cutting curves between four cut corners 5, 6, 6, 51, such as that one 56 in FIG. 9. These pairs are mirror-symmetrical here. Only one pair is shown in each of these figures.

As can be seen in FIG. 45 and also applies to FIGS. 46-49, beside the shared array side 9 with the format s2, the anticlastic sherd has an array side being located within a vertical plane, with a format s3, being shorter than the array side 8 with the format s1 of the synclastic sherd.

Moreover, the new developed anticlastic sherd 24, with the format C, having been anticipated already in FIG. 44 can be copied, in the same manner like a sherd cut out of a hypar surface, and the copy 24 with the format C can be turned 180° around the "original's" straight train-side curve 52 as a rotation-axis 52. The train-side curve lies in the diagonal of a horizontal polygon 36 of the infinite basic polygon; this polygon is rendered widely hatched in FIG. 44 below. Besides, the diagonal lies at a right angle to the diagonal of a horizontal polygon 36 for the synclastic sherd; this polygon is rendered widely hatched in FIG. 44 above.

Only the dashed array sides 8, 9 of turned copy of the anticlastic sherd are visible in FIG. 45. The one array side 9 has the format s2 of the shared array side 9 of the synclastic and the anticlastic sherd and is located again within a plane being inclined 45°. The other one 8 with the format s3 is located again within a vertical plane. Together, the copy and the original of the sherd 24 with the format C yield to an anticlastic double sherd 30 with the format C+C', which is shown as a copy in a position turned 120° clockwise around the cube's spacediagonal as a rotation-axis at the cube's vertex 6. Each such a double sherd has three side planes that intersect in the origin, that is, the center-point 91 as the reference-point of the convex basic polyhedron.

The fourth plane, of the array side 8 with the format s3 being short here, as a part of the border-arc of the future enlargement's opening 2, is oriented parallel to the next vertical polygon 36 of the convex basic polyhedron.

Besides, each such an anticlastic double sherd has also three side planes that intersect with that tunnel-axes' grid-node 89 which is not a center-point of a convex inserted basic polyhedron 90.

Finally in FIG. 45, the cutting curve of a synclastic sherd or the congruent cut-seam curve of the double sherd including it, at a cube's vertex above, passes over to a coplanar array side of the anticlastic double sherd completely shown below additionally.

Back to the solutions for the process to generate the meshes of an anticlastic sherd: In analogy to FIG. 8, the first solution in FIG. 45, aims at sherds with a translational subdivision into meshes. But as a difference to FIG. 8, all the curves of one respective array are located within parallel planes that are inclined, namely with an incline of 45°. So, each of the array chords 14, 15 of the upper sherd of a cap—like in the case of the initial sherd of the Bohemian dome in FIG. 8—gets a counterpart 14, 15 with the same orientation within the new sherd bordering below on the array side 9, again in a sequence or distribution of seats, that is mirrored on this shared array side. Also each mesh 12 has such a mirror-symmetrically arranged equivalent 12 that is oriented in parallel and shortened in one direction. By the intersection-lines 100 with the y-z-plane, you can see that all planes of the inclined array curves are parallel.

In FIG. 46 as a second solution, the principle to place mirror-symmetrically, within two adjacent sherds, array chords and meshes, which are equally oriented, that is, parallel, has been transferred to an already existing synclastic sherd with a special centric scale-trans subdivision into meshes. Within the synclastic sherd, the lengths of the chords of the array curves within vertical planes were limited again, like described for FIG. 37, by planes that converge in a line 103 at the x-axis and that cross the y-z-plane in radial lines 104 starting from the origin. Then, the array curves within the inclined planes of the synclastic sherd have been copied again in the same manner like in FIG. 45 into the region of the developing anticlastic sherd. Consequently, within the resulting anticlastic sherd, there are again the thickly drawn, equally oriented array chords 14, 15 and the hatched meshes 12 on the "seats" being mirror-symmetrically equal in relation to the synclastic sherd. Chords being placed in a mirror-symmetrically equal manner and belonging to the array curves within an inclined plane, keep their initial length here too.

Unfortunately, the resulting anticlastic sherd is not quite well suited for grid-shell-type constructions, because of the very narrow meshes on the array side 9 shared with the synclastic sherd. But in a plate-type construction, the tall meshes are not conspicuous. This holds true especially if adjoining meshes being located in pairs within one plane on the shared array side 9 are combined to give one large parallelogram-mesh. This is possible here and also necessary by reasons of rigidity.

In FIGS. 47 and 48, other subdivisions for the anticlastic sherd are shown that match to the same scale-trans sherd 24 as in FIG. 48 and that are feasible in each construction type.

The train-nodes 54 of the horizontal, straight train-side curve 52 had resulted automatically in FIGS. 45 and 46, because the chords 14, copied as parallels, actually intersected this train-side curve. Also in FIGS. 47 and 48, the train-nodes 54 remain in exactly the same position as in FIG. 46. If FIG. 46 did not exist, these node points would have to be found by reducing—in a view perpendicularly from above—the straight, horizontal train-side curve 52 to the length of a cutting chord, that is, by auxiliary lines 44 within the vertical array-curve planes of the anticlastic sherd, which are identical to the vertical array-curve planes of the synclastic sherd and which are oriented parallel to the y-axis.

In FIGS. 47 and 48, the chords 14, 15 and meshes 12 of the synclastic sherd, excluding those 14, 12 directly at the shared array side 9, have no longer an equally oriented counterpart within the anticlastic sherd.

Instead of this, in FIG. 47 showing the third solution, the inclined array-curve planes of the anticlastic sherd all meet in a tunnel-axis 88 through the tunnel-axes' intersection point 89 located out of the polyhedron's center-point 91, whereat they intersect the y-z-plane in radial lines 123 that meet in the point 124 halving the tunnel-axis 88. The different incline of the inclined array-curve planes, which define the shortening of the chords being located, like also the chords 14 of the synclastic sherd, in vertical planes, has resulted from the position of the train-nodes 54 being included in them and located at the straight train-side curve 52. This subdivision into meshes of the anticlastic sherd is coherent indeed but complicated.

Therefore, it is finally the fourth solution in FIG. 48 that is used in the later described examples of shells with scale-trans sherds. Here, the anticlastic sherd has been generated simply by a translational subdivision into meshes, which deviates imperceptibly from this scale-trans subdivision into meshes. In doing this, which also has happened in FIG. 45 and has been described for FIG. 8 before, the shared array side 9, as a copy, has been shortened several times by one chord and, in this state, has been located, offset in parallel, as an array curve 11. But the resulting array side 8 and along with it the array curves of the anticlastic sherd have other shapes and chords' inflexion-point-angles than in FIG. 45. Thus, also here, there are no longer any parallel chords and meshes corresponding between the synclastic and the anticlastic sherd.

The following FIGS. 49-61 demonstrate the possibilities how to compose the sherds 24, based on the cubic geometry, with the formats A, A', and C exclusively from FIGS. 44 and 45, into various single shells being solitaires or into different complex formations. Each of the latter ones consists of one single continuous, steadily double-curved or faceted surface and is called a "complex shell" hereinafter. To be combined further, this has optionally: arched openings being straight-lined in plan, or; sides partially being completely straight-lined. Within an unit-construction-system here, the modular repetition of identical sherds enables to modify a complex shell later with the same set of formats.

The sherds' formats from FIGS. 46-48 are not applied in doing this, even if these can form an unit-construction-system with the same options for combination.

FIG. 49 shows a triangular cap 49. The three double sherds 30 have the format A+A' from FIGS. 44 and 45. They are more finely subdivided than those of the cap from FIG. 32.

FIG. 50 shows a dome having an approximated hemispherical shape and being composed of four triangular caps. Here again, the rhombus-shaped composed quadrilateral 56 bounded by four cutting curves 25 and located between four corner points 5, 5, 6, 6 can be seen well.

FIG. 51 shows a portion 125 of an infinite continuous spatial surface. This portion consists of six anticlastic double sherds 30 with the format C+C around the corner point 6. Below it, its plan projection in plan into a plane in parallel to the x-y-ground-plane is rendered.

In FIG. 52, six of such portions 125 are composed into a complex shell being a larger portion of this infinite continuous spatial surface, which is strained into an infinite polyhedron 119 from FIG. 44 as a basic polygon. As central axes of the First grid 121, the thickly drawn tunnel-axes 88 meet in the grid-nodes 89. In each of the grid-nodes 89 of the First grid, the planes of three array sides of each anticlastic sherd next to this grid-node, like the thickly outlined sherd visible in FIG. 51 but omitted here and like the hatched one, cross each other. These three sides are namely: two array sides 9 with the format s2, which can form the transition to a synclastic sherd, and one array side 8 with the format s3, which is located here within a plane being parallel to the x-z-plane and including other nodes 89 of the First grid.

The Second grid 122, interwoven with the First grid and dual to that, with tunnel-axes rendered strongly broken is conceived equally, thus congruent. But it has a special grid-node 91 in the origin of the co-ordinate system. There, the planes of three array sides of the thickly outlined double sherd meet each other. This are namely: another array side 8 with the format s3 whose plane is located here in the y-z-plane, and again the both array sides 9 with the format s2, which can form the transition to a synclastic sherd.

The portion in FIG. 53 of four anticlastic double sherds 30 with the format C+C and of one synclastic double sherd 30 with the format A+A', around a corner point 6, has been formed from that in FIG. 51 by replacing two anticlastic double sherds by one synclastic sherd.

In the same manner, four times on a hole of the complex shell in FIG. 52, each of two anticlastic double sherds might be replaced by a synclastic sherd. By this, a cap would be formed at the top, closing upward there the complex shell. In this case, the reference-point 91 of the four synclastic double sherds would be the special grid-node, located in the origin, of the Second axis-grid of tunnel-axes.

In FIG. 54, four parts from FIG. 53 form a shell with four lateral, perpendicular, plane open enlargements. These enlargements might be also arisen in another way. That is to say, instead of closed sides, they might have been attached to a synclastic shell shown in FIG. 50, whereat each of the four enlargements would have replaced one half lateral cap of two synclastic double sherds.

The array side 8, with the sort s3, of the anticlastic sherd is located within a plane being here vertical, at the border-arc of the plane 2 of the enlargement's opening. This plane is oriented in parallel to the next lateral polygon of a cube as a convex polygon, as already can be seen in FIG. 45 in the front on the left. Besides, it stands upright on the x-y-ground-plane.

In FIG. 55, a synclastic double sherd was taken out from a triangular cap 49 with the format of FIG. 49 and replaced by two anticlastic ones. Two parts according to FIG. 55 and two caps according to FIG. 49 are combined to give one shell with only one opening, in FIG. 56. Moreover in the drawing, a projection in plan is underlaid to this shell. In this projection, the vertical array-curve planes are represented as lines parallel to x-axis or to the y-axis, which lines extend over two sherds of different double sherds.

You may imagine this shell also materially to be formed of clay being still moist: A hemispherical shell from FIG. 50 could have been enlarged: by cutting it up along two cut-seam curves 26 diverging from a zenith 5 being lateral on the right and being on the ground area in FIG. 50 and, by drawing apart, to the side and upwards, the three hereby separating cut corners 5 of the sherds, in order to open two wedge-shaped gaps to be filled each with a wee-shaped triangular sherds' pair 126 of two anticlastic sherds 24 being interconnected at their shared, longer array side 9. In doing this, the cut-seam curves 26, being located within a plane perpendicular to the surface, would have been split into cutting curves 25, which then would have represented the wedges' sides. After this, the cutting curves 25 would have become straight train-side curves 52 and then have been fused in pairs into train-seam lines 64. In FIG. 56, one wedge-shaped sherds' pair 126 is offset from the shell in order to elucidate the process imagined just before.

FIG. 57 shows a complex shell with four openings, composed of three shells adjoining to each other via two fluent transitions. Before having been put together, the left shell had two openings, whilst the middle and the right-hand one had three openings.

In the upper half located behind the both train-seam lines 64, the part in FIG. 58 has the same four sherds like those in FIG. 53 in its upper region. This upper half was copied and turned 180° around the both train-seam lines 64 as a rotation-axis. By turning and mirroring, nine of the hereby resulted parts with a quadratic outline in plan became an undulated roof having sides being undulated, which roof is shown in FIG. 59. Without difficulty, you can realize that a thickly outlined part thereof on its own can be a quadrilateral cushion-roof.

Such a cushion-roof 61 in FIG. 60 is differently shaped from that one in FIG. 12. In contrast also to that one arising in FIG. 25, it is quadratic. The anticlastic regions are smaller because the planes of the array curves 11 and of the array side 9 of one of the both directions for each sherd, and consequently the planes of the border-arcs 46 each composed of two such array sides of a cap included in the cushion-roof, are inclined.

The cushion-roof 61 is surrounded at some distance by three parts 127 having been copied from a quarter or a half of this cushion-roof and having been turned 180° around a straight side of the cushion-roof. If all this were joined to each other, a cushion-roof would result again, this time, however, with a long, straight-lined side in the front.

FIG. 61 shows spectacular possibilities to combine a plurality of double sherds within a complex shell. Here, the holes, of enlargements or tunnels, with horizontal opening's planes become courtyards and large rooflights of a cantilevered roof where a quadratic grid of cushion-roof's sides, that is, circumpolygons appears distinctly. In a fluent transition, the surface of a three-quarter sphere develops from this roof.

In FIG. 63, a new, smaller synclastic double sherd 30, with the format K+K', consisting of' a sherd 24 with the format K and of a double sherd 24, with the format K', being mirror-symmetrical to it, is added to the set of shell's pieces. The longer array side 8 of a smaller synclastic sherd is transferred from the shorter array side 8, with the format s2, of an anticlastic sherd 24, with the format C, in order to be able to adjoined to that. Because this one deviates now markedly from the circle arc, its shape looks comparatively irregular. The shorter array side, with the format s4, of a smaller synclastic sherd results by the parallel orientation to chords of the coplanar, adjoining array side of an anticlastic sherd.

In FIG. 64, six smaller synclastic double sherds 30 with the format K+K' are composed into a deformed quarter sphere in order to close one of two enlargement openings of a synclastic shell. Hereby, the accomplished shell 128 has a concha. It has two normally vaulted, closed sides, one open enlargement, and one enlargement closed by a concha. At the shared upper corner point of its upper sherds, the concha forms a subordinate zenith 129.

The possibilities, added by the smaller synclastic double-sherd's format K+K', are shown by the complex shell in FIG. 63, as a continuous, double-curved spatial surface with: an undulated roof; a courtyard; six single shells being arrayed, that is also, merged in the undulated roof; two open enlargements, and finally; three enlargements closed by conchas.

Of course, also a deformed hemisphere around a small cube as a convex basic polyhedron can be formed of the small double sherds with the subordinate corner points in the array corners 130 or in the rhombus's middles 131 and in the differently oriented, subordinate zeniths 129, as can be seen in FIG. 64.

As can be seen in FIG. 65, the triangular caps 132, as a quarter of this "deformed" hemisphere, can form, combined with an anticlastic partial shell 125, the quarter region 133 of a caved dome, which is set up on the x-y-ground-plane. You can not see that this quarter region with its surface's midpoint 6 at the cube's spacediagonal 94, along with it, can be turned in such a way that this prospectively former spacediagonal coincides with the vertical z-axis. In this case, it 133 forms an undulated roof. By a complement 134 on the left side, it can get a straight-lined side and include a thickly outlined, equilateral triangular cushion-roof between three corner points 6. Thus, also within another context, the part of an individual shell can become a complex shell.

The shell 128 from FIG. 62, provided with one enlargement being open and another one being closed by a concha, shall be transformed within the area with the closed enlargement in such a way that the alternating between synclastic and anticlastic curvature is eliminated in favor of an exclusively synclastic but slighter curvature. Thus, this area, figuratively speaking, is bulged like a large dent.

In FIG. 66 as well as in FIG. 67, a region to be bulged, each consisting of several sherds, has been taken out from the shell 126 of FIG. 62 upwards, and shown in a magnified, dashed manner.

The first region 135 in the front in FIG. 66 has as corners: the shell's zenith 5; a cube's vertex 6; a subordinate zenith 129 in the front on the ground area, and; an array corner 131 in a rhombus-face's middle of the concha. The bulging of this region happens by means of those array curves that are aligned exactly or nearly with the direction of the enlargement being closed by the concha, that is, to the y-direction. In doing this, the three lower sides of the region 135 between the four aforementioned corners are unchanged.

The new upper side, which is located between the zenith 5 and the array corner 131, and which has an uniform direction of curvature, is, as well as each of the new large bent curves located in front of it or, in other words, below it, the result of combining the equally sloped array chords 14—three ones being rendered prominent by thick lines here—of a large existing curve being curved alternatingly to and fro and consisting of array curves of two or several sherds, by moving them 14 in parallel and putting one after the other, into a longer chord 136 having the same orientation and slope.

In FIG. 67, another region 137 is taken out of rear side of the shell 128 being shown as a mirrored copy. This region is rendered in a magnified, hatched manner. Its upper corners 5, 131 are identical to those of the region on the front side, while the both lower corners 4, 130 are located in a plane including the y-axis and being inclined 45°—the left-hand one 4 of both, in the middle of a larger, spatially curved rhombus of four sherds 24 with the format A+A'; the right-hand one 130, in the middle of a smaller triangular cap. The bulging proceeds in the same way as in FIG. 66.

Then, only still a copy of this region 137 being mirrored in this 45 degree plane of the new lower side is needed for the lower shell-region in order to obtain a changed shell 138 as in FIG. 68. The upper, long array side, located within a vertical plane of a thickly outlined, oblong double sherd 30 within the bulged frontal region, has the format s5. But the left-hand array side 8 of this double sherd with a special format is not plane. By that reason, it is not suited for a modular addition and therefore has not a format-sign. This sherd's chords and meshes located below or, in other words, before the resulting, dashed, likewise spatial cut-seam curve 26 have orientations that do not occur in the standard formats.

From the changed shell 138 in FIG. 68 with the new bulge on the right, a piece of the frontal area of the shell is already pulled out to the side, that is, a composed quadrilateral 56 consisting of: a sherds' pair 139 of a synclastic sherd 24 with the format A and an anticlastic sherd 24 with the format C, and of; a sherds' pair 140 mirror-symmetrical to it, with the formats A' and C'.

In FIG. 69, behind or, in other words, above, the right-hand one 139 of the sherds' pairs, pulled out in FIG. 68, is rendered in a magnified, turned and dashed manner. Several times, two chords 14 being equally oriented and sloped but having a different length have been exchanged within a larger curve 55 that is composed of one array curve of the one and of one array curve of the other sherd and that exists within the x-z-plane.

At the double sherd 141 before or, in other words, below the initial, dashed double sherd, you can see that the turning point 4 of this larger curve 55 is dislocated upwards hereby. This has happened also to the turning points that are located: between the array curves in parallel to it; and within the array side 9 shared by the both sherds, whereby this array side has been deformed into a format s6. Because of this, the anticlastic sherd has became larger than the synclastic one. The synclastic sherd is a specimen 24 of a new format B, the anticlastic one, a specimen 24 of the format D.

The left-hand sherds' pair 140 of the composed quadrilateral 56 from FIG. 68 shall be changed too. The 45 degree inclination of the array-curve planes shall be abandoned in favor of a position of these planes that is vertical like in the case of a conventional translational surface. In FIG. 70 at first, the array chords that join to the cut-seam nodes 27 within vertical planes extending across at right angles to these planes, were left over from the net of meshes.

In FIG. 71, the four lower ones of these chords have been extended, and the upper ones have been shortened—in a view perpendicularly from above, up to the horizontal auxiliary lines 45 that on its part are shortened now, in the same view, up to the array chords. Between the cut-seam nodes 27 and the new ends 13 of the chords, already two chords 15 of the transverse direction are drawn.

In FIG. 72, these chords have become parts of array curves 11 running conventionally within vertical planes. The perfectly changed sherds' pair 142 can be seen in FIG. 73. Its anticlastic sherd 24 with a format E is equally large as its anticlastic one 24 with a format G. Anew, the shared array side has a new format: s7.

The re-shaped sherds' pairs 141, 142 can replace unchanged sherds' pairs in favor of a more regular or irregular general impression.

Yet, the synclastic sherd 24 with the format G of the last described sherds' pair also allows to bound a steeply sloped, exclusively synclastic shell at a vertical plane, that is, as it were cut, as has been happened in FIG. 74. In this case, four array sides 9 with the format s7 form the border-arc of the plane vertical opening. The rear region of the dome 143 consists of six mirror-symmetrically shaped double sherds with the format A+A'. By these sherds, the improvement of the shell's rear side as against the shell 1 in FIG. 1 is achieved. The four fore, seemingly inventive double sherds on the opening are merely ordinary quad sections 3 being known, namely: two specimen with an asymmetrically shaped format A'+E and two specimen with a format A+E'. Their seam meshes are asymmetric indeed. Such a seemingly inventive double sherd of sherds with a translational subdivision into meshes has to be considered merely as a known, quadrilateral, not-centric scale-trans surface by the reason that two of the four array chords of each mesh being composed of two cut triangles are parallel. Only by reasons of the uniformity of the sherds within the unit-construction-system and because of the evenness of the subdivision of the shell as a whole, the fore region formed of them has not been replaced by the much more regular subdivision, such as that of a globe.

In FIG. 75, two shells, which, in a combined state, span over basic polyhedra being convex and infinite, can be imagined to be cut and to be set to each other, like Bohemian domes of a vault, at a plane and partially also straight-lined border-arc 144 as a traverse arch. The right-hand one of both shells remained open at its second, right-hand border-arc 144. The sherds' pairs 141, 142 as well as a false double sherd 3 with the format A+E' can be recognized by hatching patterns. Moreover, at a fore enlargement, you can see an inventive asymmetrical double sherd 30, with the format C+D', composed of an unchanged anticlastic sherd with the format C and of a changed anticlastic sherd, with the format D', having an array side 9, with the format s6, drawn towards the top.

While, in the previous FIGS. 68-75, possibilities to deform a very small region of a shell, that is, of a composed quadrilateral were explained, in FIGS. 76-78 shall be demonstrated how a larger shell, already deformed by a more extended bulge, on its part can be bulged in a large area.

For this, in FIG. 76, a shell 138 from FIG. 68—after the completion of its enlargement, which has been uncompleted on the top, by a sherds' pair 141 and its mirror-image—has been dissected in a vertical plane that includes an angle bisector 145 between the x-axis and y-axis. Then, at the arc 146 of the cut within this vertical cutting-plane, the hereby resulted shell-region having an open enlargement and a closed bulge has been composed, along with a copy of this shell-region having been mirrored in this plane, into a larger shell 147 being continuous according to the present invention. This shell has two open enlargements on the left behind and two bulges in the font on the right.

In FIGS. 77-79, a larger region of this larger shell 147 shall be bulged within the region of the two bulges in the front. But the bulging does not work again here according to FIGS. 66 and 67. Instead of this, the region to be bulged must be designed completely new as a triangular cap, starting from the both existing, mutually mirror-symmetrical border-curves 148 each consisting of two array sides, whereat on the ground, a new border-curve of the cap results later from the swinging curve 149 with two turning points.

In a magnified representation in FIG. 77, the re-design happens to the left half of this region, which half has been removed already in FIG. 76. The way of the geometrical construction starting from its upper sherd, that is to say more precisely, from the zenith 5 is the same as that one in the right half of a double sherd in FIG. 34, even if this time, the chords of the upper array side 8 with the format s5 vary by their length within each of the both curves 148 within the vertical planes, and even if the inclined array-side planes, which appear as lines 100 on the x-z-plane, are obviously more inclined with respect to the z-axis than 45°, thus lie flatter. The inclined plane array curves 11 are again the result of copying in parallel the lower array chords 15 of the seam meshes. As an exception, the lower endpoint 150 of the new cut-seam curve has no longer any relation to the regular convex basic polyhedron and to its vertex 6 still existing in FIG. 76. It is located lower and more towards the outside. Consequently, the next, lower sherd, which is represented in the drawing by three other inclined array curves 11 that are copied as parallels from the upper sherd, turns out with a small height and stretched.

The third and lowest sherd to be constructed, having a horizontal, resulting array side 8 with a format s8 at the new lower border-curve of the cap within the x-y-ground-plane is defined in FIG. 78 by the horizontal planes for array curves that include the cut-seam nodes 27.

The four single, thickly drawn, horizontal chords 14, having different lengths, of this lowest sherd have been constructed graphically as follows: Initially, the four cutting chords 28 have been drawn. This has been started at the seam mesh on the lower endpoint 129 of the array side 9, with the format s2, included in the border-curve of the cap and located above the x-axis. Some line 151 has been drawn from the array side's second-lowest node point 13 to some point 41 on the cutting chord 28. Then, this one 151 has been extended beyond this point 41, downwards until it had met, at a point 46, that horizontal array-curve plane which includes the lower endpoint 129 of the cap's lateral border-curve and thus is identical here to the x-y-ground-plane. For a horizontal view, the horizontal, parallel array-curve planes are represented by auxiliary lines 44. Than, between the corner point 129 and the last gained point 46, a segment being for the time only a part of a first horizontal array chord 14 had been drawn. Then, a horizontal auxiliary line 152 has been joined to the upper endpoint 27 of the lowest cutting chord 28 that is running parallel to the mirror-axis 145 this time. In a view perpendicularly from above, the array chord 14, still having been too short, of a seam mesh has been extended up to this auxiliary line. The next higher horizontal array chord 14 of the next higher seam mesh has been drawn in the same manner. In that case, the left starting point of this chord is the first cut-seam node 27 being located within a cut-seam curve and the starting point of another horizontal auxiliary line 152. It is located on a horizontal array-curve plane lifted from the bottom—thus not on the ground-plane like the point 129 before. Finally, the lower array side 8 with the format s8 has resulted by copying the four different new array chords.

Eventually, FIG. 79 shows the shell resulted from of the shell 147 from FIG. 76, after the quasi bulging or, in better words, after the insertion of the isosceles triangular, thickly outlined cap 153 of two halves according to FIG. 78 that are mirror-symmetrical in the line 145. Here, the resulting lower border-curve 154 of the bulged region has replaced the curve 149 with the two turning points from FIG. 76.

The deformations, shown in FIGS. 68-79 and leaving the orientation and the slope of the chords of only one of the both array sides of one sherd unchanged, have resulted in new curves such as the both lateral border-curves 148 and the lower border-curve 154 resulting from it, of the recently drawn triangular cap 153 with a special format. But they have also disadvantages: So, any given point at such a border-curve as a polygonal curve can not be interpolated in a mathematically exact way, starting from its node points 13 if its chords shall become regularly round segments of an arc. Besides, the possibilities of shaping by constructing geometrically anew part regions of a shell are limited too. That is why, other geometric procedures to change as a whole even larger regions of a shell are described later.

But, for a time, back to the construction of a shell with a material thickness—this time of sherds mainly with standard formats based on a convex or an infinite basic polyhedron, but exclusively with the formats occurring in FIGS. 66-75!

In FIGS. 40 and 41, construction types for completely synclastic shells in FIGS. 39 and 42 have been already shown, which shells circumscribe convex basic polygons. Outside and inside surfaces of such shells are defined simply by scaling up or down the virtual net of meshes. In this case, each panel component is a very flat frustum of a pyramid.

Hereafter is shown how the outlines of single components bounded mesh by mesh look like, at synclastic as well as at anticlastic sherds from FIGS. 51-65—no matter if a framework design or a panel design is concerned.

Also here at the framework nodes, not any inaccuracy should occur, just as, at the butt-joints between areal components, not any offsets should occur. Therefore, "node-axles" 155 being connecting lines between the intersection points of the chords of the outside and inside shell surface have to be defined systematically. Such a node-axle stands approximately perpendicular to the local surface of the shell at this node. It is either the central axis of a framework node or it is the line wherein several, mostly four, areal components, such as sandwich panels, meet at the shorter sides, that is, ends of its edge-faces located within the components' butt-joint. Each "edge-face" 156, 157, 158 is located between two node-axles. In the case of a shell as a bar-grid construction, an edge-face includes the central axis of a bar or the gravity axis of a metal beam. In the case of a shell as a panel construction, an edge-face represents the face of the butt-joint being visible as a joint line at the both surfaces of the accomplished shell.

In the case of a sherd 24 in FIG. 80, with the format A from FIGS. 44 and 45, having a circle arc as a determined array side 8 being dashed thickly here, the facts are as obvious as before: The sherd shown as a virtual net of dashed chords, which hereinafter are called "axis-chords", is copied again twice here. Keeping the center-point 91 at the origin, the one copy is scaled down, the other one is scaled up. The scaled-up sherd defines the outside surface, the scaled-down one, the inside surface. Each of the outer chords 14, 15 and each of the inner chords 14, 15 is parallel to that axis-chord from which it was gained by copying and scaling. Each new outer and inner face 12 of a mesh is parallel to the mesh's face of the initial sherd. The thickly drawn node-axles connect the both shell surfaces at its node points 13. Each time, two node-axles as well as one new parallel chord of the chords 14, 15 at the inner shell surface and such a chord at the outer shell surface altogether bound one of the edge-faces 156, 157, 158.

In the present example, each axis-chord 14, 15 halves the edge-face wherein it is located. All node-axles 155 of this sherd are aligned to the center-point 91. Merely within the vertical plane of the determined array side, at the y-z-plane, the node-axles form symmetrical miter cuts with always the same angle $\alpha$ between the edge-faces 156 being vertical there.

Unfortunately, the adjacent anticlastic sherd with the format C has not the one reference point to scale from and to draw lines starting from there in a ray-like arrangement. Because of the unequal lengths of the array chords, an alignment towards a tunnel-axis is not recommended too. That is why, instead of this, the node-axles of the synclastic sherd are transferred, in an equally oriented state, to the anticlastic one. Here, also to the node-axles, the principle of mirroring the "seat numbers" applies again, like before to the chords 14, 15 and meshes 12 in FIG. 45. Hereby, also at the anticlastic sherd, within the same array-side plane, again result the miter angles $\alpha$, being equal only there, of the edge-faces to each other.

Whilst the length of the node-axles in each of the both sherds is the same everywhere within the vertical array-side plane, it decreases slightly at the nodes amidst of the sherd towards the cube's vertex 6. According to this, the material thickness decreases from panel component to panel component, or the height of the bar profiles, slightly from bar to bar. Also the mutual miter angles of the edge-faces of an array curve, which are located one after the other out of the y-z-plane, are other ones ($\beta$) than within the y-z-plane. They vary at each node point within each sherd. Besides, unlike the axis-chords themselves, the edge-faces of axis-chords, which are located one after the other, of an array curve are located no longer within a single plane.

Within its respective sherd, each edge-face 157 that includes an axis-chord 14 of a vertically plane array curve is oriented transversely to each edge-face 158 that includes the axis-chord 15 of an inclined plane array curve.

Within FIG. 80, additionally to FIG. 45, a turned smaller synclastic sherd with the format K has been joined to the left-hand, short array side 8 with the format s3 of the anticlastic sherd with the format C. The mirror-symmetrical seat distribution of equally oriented chords and mesh's planes recurs between the anticlastic sherd and the smaller synclastic one.

As mentioned already, because of the cube's symmetry characteristics, the anticlastic sherd 24 allows to be extended into a double sherd, by copying it and turning it 180° around the straight horizontal train-side curve as a rotation-axis. Its second sherd 24, which is indicated here only by dashed axis-chords, is still congruent to its original, even if it has a material thickness, because the node-axles, running from the node points, which are located between the axis-chords within the virtual net of meshes, to the outside and to the inside, are equally long, Now, the single chords and meshes of the both larger adjacent sherds 24 with the formats A and C are viewed: The both axis-chords 14, corresponding within vertical array-curve planes and having a different length at each of their sherds but equally oriented in space, are located within edge-faces 157 that are equally oriented, that is, oriented in parallel. These both faces have different lengths indeed, but they have the same corner angles or, in other words, miter angles—in a position having been turned 180°. The both edge-faces 157 are no longer located within one vertical plane like the array curve is, which they include.

The corresponding axis-chords 15, which originate respectively from one of both sherds and have the same length and gradient, and that are located within array-curve planes being inclined, are located in edge-faces 158 that are equal concerning their orientation as well as the outline.

When the axis-chords 15 of the anticlastic sherd 24 with the format C and of the small synclastic sherd 24, with the format K, having been joined to its other array side 8 with the format s3 are viewed, then, the same applies in analogy. But here, the longitudinal and transverse direction of the net of meshes are exchanged. Thus, the axis-chords 15 and their edge-faces 158 corresponding in pairs within the array-curve planes being inclined have different lengths, while the axis-chords 14 and their edge-faces 157 corresponding in pairs within the array-curve planes being vertical are equally long.

In FIG. 80, you can see also lower faces 12 of meshes that—like the not hatched upper faces of meshes too—correspond by seat number and orientation to—that is, are oriented in parallel to—the plane faces 12 of meshes coming from FIG. 45 and being outlined now by hatched lines. In each mesh of the both smaller sherds 24 with the formats C and K, the initial face of a mesh, the lower face 12 of the mesh being shown hatched, and the upper face of the mesh each have slightly different shapes.

By other node-axles 155 shown isolated out of the three aforementioned sherds, the context is indicated wherein these sherds with a material thickness can be set by turning and mirroring.

Thus, shapes of shells are possible that consist exclusively of such sherds and its mirror images with standard formats and that have been shown from FIG. 49 up to FIG. 65.

Accordingly, the node-axles allow to be applied also to bulged shells according to FIGS. 66-69, which had resulted from assorting and combining equally oriented and sloped, that is, parallel array chords within a polygonised curve. This has happened in FIGS. 81 and 82 to the region 135 of a shell from FIG. 66. The three edge-faces 157 from FIG. 80, which include the three axis-chords 14 of array curves within planes parallel to the y-axis, occur here again. The right-hand one of these edge-faces, which originates from the small synclastic sherd with the format K in FIG. 80, has been turned 180° within its plane and has been shifted into the plane of the both other edge-faces. The meshes' faces 12 joining to it below and before it are transferred too.

Then, in FIG. 82, the three edge-faces 157, along with its axis-chords 14 of equal orientation and partly differing length, are combined to give a new, oblong edge-face 160. The mesh's inside surface 167 joining to it below is located still within a plane in parallel to the three separate faces 12 in FIG. 80.

The aim of the shown design with an appreciate material thickness is the continual transition between mesh components as well as the seemingly seamless transition between sherds of a shell. The surfaces of a mesh component can be shaped at pleasure outside and inside in the case of a synclastic curvature—maintaining the coplanar corners at node points. Additionally to the pyramidal stellation, also the bulging of each mesh to the outside beyond at least one of both continuous surfaces of the shell.

FIG. 83 shows a special inside surface or, in other words, lower surface of a synclastic sherd 24 with a scale-trans subdivision and the shape from FIG. 46. Additionally to the other kind of subdivision into meshes, there are two other differences to the synclastic thick sherd in FIG. 80. On one hand, the corner points and node points of the inside, lower surfaces of the meshes are located everywhere directly within the initial chords' corner points 5, 6 and node points 13, 27 and not as far below it as the upper corner points and node points are located above it in FIG. 80. because this is not disadvantageous in the case of a purely convex shell shape. On the other hand, each mesh on its own is convexly vaulted on their lower, inside surface. This helps to avoid the acoustic disadvantages of concave interior surfaces in synclastically curved shell structures. The sound is dispersed while being reflected. Besides, a flutter effect by the sound creeping along the otherwise concave inside wall surface of the shell is broken.

The vaulted lower surfaces of the meshes are not curved within the continuous surface of the sherd. They and the edge-faces 156, 157, 158 have curved border-arcs 161, 162 instead of the chords 14, 15. These arcs are curved strongly and inversely to the slightly curved arcs, which otherwise are represented by the straight chords. Now, the quad-mesh's faces 12, having been shown just before, are replaced by small, trapezoidal quadrilateral caps 163 having been generated according to the present invention, between node points 13. The seam meshes between corner points 5, 6 and node points 13, 27 are replaced now by small, kite-shaped quadrilateral caps 164 having been generated according to the present invention. When you imagine each cap to be turned upside down, to be scaled up, and to be laid upon a horizontal bearing area, the border-arcs 161, 162 of the small cap, at their apex, are slightly inclined towards the zenith of the small cap—thus, inclined in an opposed manner to the caps mentioned up to now, with border-arcs, which, at their apex, are inclined away from the zenith. Each of these turned caps has a central axis through its respective zenith and through the reference-point 91 of the large-scale sherd. In contrast to the usual z-axis, this central axis is not oriented exactly normal to the replaced plane face of a mesh, which face can be considered now as a ground area of this turned individual thin load-bearing cap of a vault.

As a whole, the sherd from FIG. 83 can be built larger than 100 squaremeters and turned upside down in such a way that the gravity point 165 of its whole surface tuns into the lowermost place of the sherd. Then, the sherd acts as a vault, which, in the case of an even much larger scaling up, can cover a trough-shaped terrain bent up outwards, with a moderate interior height following the terrain's course.—But back to usual dimensions!

There may be also small caps on the outside of the large-scale sherd from FIG. 83, which outside is shown here in a faceted manner. That caps are stronger vaulted to the outside, that is, they have a stronger curvature as the large-scale quad-meshes or smaller caps, which hitherto pass over continually to each other. Then, in a constructively minimized manner, each such a cap might be the outer surface of a pneumatic cushion having the size of a mesh.

If also such a sherd, with caps being banked outwards, were built much larger, were not turned but laid down flatly, whereat the gravity point 165 of its whole surface became the highest place, and if each small cap, in a scaled-up state, was considered again as an individual, thin, load-bearing cap, then, the sherd would act as vault that might cover, with a low interior height, a terrain bent down outwards, shaped like a hill. Then, in a constructively minimized manner, this cap would be a foil sail as a part of a roof surface, laced along the caps' border-arcs by a cable net, of a large air-supported hall.

At the previous synclastic sherds above a basic polygon as a part of a convex basic polyhedron, the array side 8, determined to be evenly subdivided, had a constant or a continually changing curvature. FIGS. 84-90, however, deal with a building envelope as a shell of sherds with a determining array side that is fixed in the shape of a basket arc. This array side 8 consists of two circle arcs 166, 167 each being evenly trisected, but with a different radius and a differing uniform chord length. Thus, it is inhomogeneous.

Then, in FIG. 84, none of the both center-points 168, 169 of the both circle arcs being parts of the basket arc is still located in the shell's center-point 91, the origin. Instead of this, the one point 168 is located at the z-axis, below this center-point, and the other one 169 at the angle bisector between the y-axis and z-axis and, in same time, at the connection 170 between the lower endpoint 171 of the upper, flatter basket arc's part and its center-point 168.

The shape of the basket arc is chosen in such a way that the line 170 from the center-point 168 to the lower endpoint 171 of the upper, flatter part 166 has the same angle γ with the z-axis, like two radial lines 104 have mutually between the both node points 13 at one array chord of the lower, more strongly curved basket-arc's part and its center-point 169. Hereby, numerous components of the building envelope in FIG. 87 with a basket arc in cross-section can be used also in other structures such as domes with a curvature being as regular as possible and with the radius of only one circle arc.

FIG. 85 shows the geometric construction of the seam meshes of a synclastic sherd, which construction is already known from FIG. 37, starts from the zenith (5), and proceeds up to the cube's vertex 6, On the top in FIG. 86, by copying and mirroring, this sherd has become a double sherd 30 with a format A+A'. Then, this double sherd has been copied twice again and the copies each have been turned 120°, once counterclockwise and once clockwise, around the cube's spacediagonal 94 shown extended here. So, a large triangular cap 49 with rectangular corners at the three corner points 5 has resulted. The double sherd 30 with the format A+A' on the left in the front is subdivided by thick curves into two large-scale quad-meshes 12 and two large-scale seam meshes 31, each with evenly subdivided sides.

The load-bearing building envelope 172 in FIG. 87, which looks like the upper half of an inflated and rounded ashlar, consists of four large triangular caps 49 around the zenith 5. The one, less curved large-scale seam mesh 31 from FIG. 86 with the slightly curved circle arcs 166 as sides forms the half of a wall surface. Copied and differently oriented yet, this large-scale seam mesh forms also the quarter of the roof surface. The other, more strongly curved seam mesh 31 in FIG. 87 forms as a double sherd being thickly outlined on the left a third of a small triangular cap as a "suitcase corner" of this rounded building envelope. Finally, the large-scale quad-meshes 12 form the quarter of a rounded edge of the building.

If a straight line is determined instead of the slightly curved circle arc 166 of the array side, and a circle arc including an angle of 45° instead of the more strongly curved circle arc 167 of the array side, then, a rounded ashlar arises, whose corners with their inventive subdivision are able to be applied in usual commercial software for design, architecture, and engineering. This case is not shown separately. Instead of this, the results of other shaping possibilities are shown hereafter.

In the case of the shell 173 in FIG. 88, the whole building envelope 172 from FIG. 97 is scaled—that is, in extents varying in the different quadrants. At first, the building envelope has been halved at the x-z-plane. Then, the left-hand half has been stretched in the y-direction, the right-hand one has been shrunk in the y-direction. Then, the deformed halves have been put together again. Then, the shell has been dissected at the y-z-plane. The rear part region has been shrunk slightly in x-direction, the fore part region has been stretched strongly. Also these part regions are put together again. The part regions, each unidirectionally shrunk on its own, are hatched, the former one vertically, and the latter one horizontally. During all these processes, the circle arcs of the array sides have changed into elliptical arcs.

The symmetrical building envelope 172 in FIG. 87 can be provided also with such inventive open enlargements, like the building envelope 174 in FIG. 90 has. For this, in accordance to FIG. 48, an anticlastic sherd with a format C has been geometrically constructed in FIG. 89, starting from the cube's vertex 6. Thus again, thick drawn, copied parts of the array side 9 shared by the both sherds have been joined as array curves 11 below to the straight-lined horizontal train-side curve 52.

The two open enlargements of the shell in FIG. 90 have resulted from this anticlastic sherd, by a combination of copying, turning, and mirroring. These ones appear to be stretched in such extents that they can be considered as annexes being slightly moved back from the faces of the walls and the roof. When these ones shall be squeezed in order to be able to compose them of double sherds unidirectionally shrunk like that one being completed in FIG. 93, the anticlastic sherd 24 with the format C cannot simply be scaled in one direction of space, because then, the continuous surface-transition between the synclastic sherd above and the anticlastic sherd joining to it below would be lost. Indeed, a new anticlastic sherd, with the format E, joining to the synclastic sherd without a fold, can no longer have a straight-lined lower train-side curve 52 as a rotation-axis for a copy like still in FIG. 90, because this straight curve, graphically spoken, has to be bent away from the initial direction of 45° at the cube's vertex 6 towards the array corner 4. That is why, still another, differently shaped sherd 24 with the format F has to be provided for the not mirror-symmetrical double sherd 30 according to FIG. 93.

At first, the upper, synclastic sherd 24 being rendered magnified is reduced in FIG. 91 to the array curves 11 within inclined planes. The geometric construction of the adjacent, unidirectionally shrunk, anticlastic sherd with the format E has been started by defining a very short and therefore loupe-like magnified array side within the x-z-plane, as a determining array side. To achieve a lot of regularity in this case of very narrow new meshes, it has been shaped as a circle arc evenly subdivided into chords. In doing so, its lowest chord 14 should obtain the gradient of the uppermost chord 14 of the synclastic sherd. Besides, its uppermost chord at an array corner 4 should lie on one straight line with the lowest chord of the synclastic sherd. Then, to the node points of this short array side being defined in such a manner, the array curves 11, being located within planes in parallel to the x-axis and being inclined 45°, and its chords 15 are joined in a mirrored arrangement, that is, in an inverted sequence of seats.

Then, at first in FIG. 92, the new, spatially curved cut-seam curve 26 has been drawn through the endpoints 27 of these array curves. It is shown below it, thickly copied. After this, the geometrical construction of the seam meshes has been started, for the connection with the differently shaped anticlastic sherd.

The construction of the seam meshes has been carried out in the same manner as in FIG. 78 below, even if there, the shape, the kind of curvature, and the orientation of the array-curve planes of the sherd have been completely different. However, the common is that the position of the cut-seam nodes 27 and the orientation of both arrays of array-curve planes of the sherd, which had been still to be constructed, had been already known.

In FIG. 93, this time, that is, within the sherd located on the right below, with the format F, the planes of the one array of curves are oriented vertically and in parallel to the x-axis, and those of the other one are inclined 45° and in parallel to the y-axis. This time, the seam mesh, where the process in FIG. 92 has been started, is located on the cube's vertex 6. As can be seen here again loupe-like magnified, a line 151 has been drawn from the next node point 13 of the shared array side 9 to some point 41 at the lowest cutting chord 28. This new line has been extended up to a point 46 that is located perpendicularly below a horizontal auxiliary line 44 running parallel to the x-axis, in a array-curve plane being vertical here. A line 14 has been drawn from the cut-seam mode 27 to this new point 46 here. Then this line has been extended to the front or, in other words, downwards up to a point 13 as a new node point of the lowest seam mesh. This point is located within a plane being inclined 45°, that is, is located, in an imagined view aligned with the y-direction, on an auxiliary line 45 that runs in parallel to an angle bisector 145 being this time within the x-z-plane.

As a result, FIG. 93 shows the new, unidirectionally shrunk anticlastic double sherd 30 with the format E+F. In FIG. 94, this one is copied and mirrored in its short, lower, resulting array side 9 into a double sherd with the format E'+F'. These both double sherds are combined with a synclastic sherd 24, with the format A, to give an eighth region 175.

Four such eighth regions 175, mirrored regions included among them, are put together in FIG. 95 into a half 176 of a diagonally halved, cantilevered roof with a round central column. In FIG. 96, the nearly identical regions 177 are put together into the half 178 of a diagonally halved open pavilion upon four quarter-circle columns and with a roof border region bent up in a stabilizing way. By even more eighth regions 175, the accomplished pavilion could be enlarged into a cantilevered roof upon four round columns. A plurality of such pavilions can be put together into a fluent vault with transverse arches rounded off in cross-section. The eighth regions 177 in FIG. 96 are modified by removing the regular meshes at the zenith and replacing them by free-formed, irregularly quadrangular meshes 179 for the bent-up border of a hole for a skylight. But because inventive seam meshes still occur in the freely changed double sherds of a cap provided with a hole, for the roof area of a pavilion, with a skylight, imagined to be accomplished, also this roof area on its own is an inventive shell.

Finally, FIG. 97 shows how the unidirectionally shrunk, anticlastic double sherds with the formats E+F and E'+F' can become also parts of a skeleton consisting of one single complex surface and having hollow cross-sectional profiles of "bars".

The narrow meshes that lie side by side in an unidirectionally shrunk double sherd of the examples from FIGS. 95-97 have to be combined each time as a row, to give one single component. Therefore, these examples may be built rather of a thin material being able to be folded and bent.

Up to now, the regular convex basic polyhedron, for a shell of double sherds above its polygons, was a cube. First of all, this is expedient. Besides, in doing this, all can be explained easier. Yet, the basic polyhedron can be also another Platonic solid, an Archimedian solid, or a solid being dual to one of them, or a polyhedron being subdivided geodesically according to Fuller.

In the following examples, the various convex basic polyhedra are vaulted all sides by sherds having a translational subdivision into meshes. Just so feasible is the special centric scale-trans subdivision into meshes.

For this purpose, the regular polyhedra—excepted one of them—are oriented in a twofold symmetry within the space of the co-ordinate system. When you imagine therefore a view aligned with the x-direction or y-direction or z-direction, thus, an image of the basic polyhedron with only two mirror axes results. This orientation of the basic polyhedron, such as in FIG. 98, facilitates comprehension. Within the drawn model, it is true that then, the ground area of some shells basing on them lies in a position sloped in space.

FIG. 98 shows a tetrahedron as a basic polyhedron 90. Its fore, upper polygon 36 as basic polygon is divided again, like the upper one of the cube in FIG. 32, into finely hatched sectors 35 having a right-angled triangular outline and lying between the polygon's middle 39, an edge's middle 37, and a polygon's vertex 6. Because the basic polyhedron is a triangle, is consists only of six sectors.

The starting point to generate the meshes was again the cut corner of a sherd, the zenith 5 that is not located at the z-axis indeed, but is located also here within a line 93, which runs in a direction normal to the basic polygon through its midpoint 39 to the polyhedron's center-point 91. To this zenith 5, an array side 8 has been joined, with a format s1, determined to have the shape of a circle arc of equally long chords within a plane being normal to the polyhedron's edge 38 and crossing the midpoint 37 of this edge of the polyhedron. In analogy to FIG. 34, then, the net of meshes of a synclastic sherd 24 with a format A has been generated. On the side, this sherd can be seen as a diminished copy, which, by mirroring, is doubled into a double sherd 30 with the format A+A'. In analogy to FIG. 45, then, an anticlastic sherd 24 with a format C, having an array side 8 with a format s3 has been drawn. This sherd has been combined with a copied sherd turned 180°, whose dashed sides can be seen already in FIG. 98, to give an anticlastic double sherd with a format C+C, which can be seen above as a diminished copy.

In FIG. 99, for the time, merely equal synclastic double sherds have been put together. The strawberry-like shape of the borderless closed synclastic shell 180 of 24 sherds 24 shows clearly perceptible deviations from a spherical surface. Cause, the more polygons a regular convex basic polyhedron has, the slighter the deviation of the circumscribed shell surface from the spherical surface becomes. The tetrahedron is the extreme case, with very few polygons. The spatial sector region, which each of these sherds occupies, is very larger, that is, more wide-spread than that one of sherds within a borderless convex shell being circumscribed to a cube and having an approximated ball shape. Here, in contrast to a cube, the uppermost point of the shell 180 is not located at the endpoint of several cut-seam curves but at an array corner 4 as a midpoint of a symmetrical composed quadrilateral 56 being similar to a rhombus.

Like a cube in FIG. 44, a tetrahedron can be the part of a close packing. But, because tetrahedra are not able to be packed without gaps, this packing consists of tetrahedra as well as of octahedra. Here, in an infinite, close packing, each tetrahedron is surrounded by four octahedra. Each of these octahedra is considered now as a triangular antiprism, whose bottom and top are missing. If now, each of the four octahedra is joined, on its open bottom or top, to a tetrahedron as a convex central basic polyhedron 90 and if this central basic polyhedron is removed after this, a section of an infinite polyhedron results.

Also this infinite polyhedron again divides space into two congruent infinite space halves being formed as angular tunnel-systems. In FIG. 100, inventive anticlastic double sherds 30, with the formats C+C applying here, have been strained Into these systems. Like in FIG. 52, also here again, two interwoven congruent grids of tunnels-axes 88 can be seen. This time, in each of these both grids, the grid-nodes 89 are mutually disposed like the carbon atoms in a diamond grid.

The First Grid 121 has grid-nodes 89 wherein intersect the planes of three array sides of each hatched or thickly outlined anticlastic double sherd that is located next to the respective grid-node 89.

These three array sides next to every second one of these nodes of the First grid 121 are—as a difference to FIG. 52—namely: the both array sides 8, with a format s3; and the one of the both array sides 9, with a format s2, able to be joined to a synclastic sherd. At the other ones of these grid-nodes 89, these three array sides of the First grid are, like in FIG. 52: only one array side 8, with a format s3; and two array sides 9, with the format s2.

At the origin and center-point of the convex basic polyhedron 90 shown in FIG. 98 and then omitted, the Second grid 122 being congruent to the First one has also again a grid-node 91 being a special one of its grid-nodes 89. Three planes of array sides of the anticlastic double sherd 30 meet in the center-point 91 of the convex basic polyhedron. These sides are—like in FIG. 52—namely: one of the both array sides 8, with a format s3; and two array sides 9, with the format s2. But, in contrast to a cube (compared with FIGS. 45 and 53), the plane of the fourth array side—the second one of the array sides 8 with the format s3—is no longer oriented here parallel to another, to the next polygon of the same basic polyhedron.

Based also on a tetrahedron, the synclastic sherds 24 with the formats A and A' as well as the anticlastic sherds 24 with the format C can be multiplied and composed again into a triangular cushion-roof 57, which is becoming a part of a complex shell in FIG. 101. This cushion-roof lies in a sloped position to the present co-ordinate system in space. Therefore, you have to imagine: the sides 58 to lie on a horizontal ground-plane; and the normal 93, to be a vertical line centric to the basic-polygon within the plane of the bearing border of the roof. The planes of the border-arcs 48 of the triangular cap being included in this roof are strongly inclined with respect to this vertical line. Hereby, the corner regions of this cushion-roof are comparatively small. The inclination of the array-side planes is stronger here than in the case of the regularly quadrilateral cushion-roof 61 from FIG. 60. Here, it is not 45" but 54.36°

In FIG. 101, altogether three of the new triangular cushion-roofs 57 are grouped around a tunnel's piece with two triangular plane openings whose corners 51 are the vertices of a large imagined octahedron having the double side length of a missing tetrahedron or opened octahedron within a the infinite polyhedron.

Additionally to the infinite polyhedron basing on the cube packing and to that one basing on the tetrahedron-octahedron packing, there are many other infinite polyhedra, which hitherto have been covered with hyperbolic paraboloids or with complicated surfaces of differential geometry, and that, instead of this, can be covered also with a continually curved or faceted inventive shell surface.

But these ones exceed somewhat the power of imagination. That is why their geometry does not occur in any inventive drawing. Already the purely anticlastic complex shell in FIG. 100 on its own is needed rather for explanation. There, without dissecting meshes arbitrarily, plane openings being vertical cannot be directly formed as cross-sections of tunnels.

Thus, in FIG. 102, the sculptural shell 181, lying, like the cushion-roof, not on the x-y-ground-plane and therefore being visible nearly from above, has two inclined, acute-angled "frames" 182 being the border of trumpet-like spreading enlargements. This shell is seen nearly from the side in FIG. 103. It encloses the Second grid being equally oriented in FIGS. 98-105. As can be seen in FIG. 103, such a frame-like opening is plane indeed but inclined relative to the ground area lying also here in a sloped position to the x-y-plane. The third opening—visible above in FIG. 102, and in FIG. 103 in the background—is designed less costly, because the anticlastic sherds 24 with the format C are replaced by such ones with the formats D or D'. The new sherd formats D and D' provide for both: one plane border-arc 183 on the rear opening, which stands plumb to the ground area of this shell; and for three equal border-arcs 183 as bearing curves in the ground-area.

A part region, separated by two thick, mirror-symmetrical curves 184, of this shell forms the third of a shell in FIG. 104, shaped like the grip of a pistil. Its rotational-symmetry axis passing through a tetrahedron's vertex 6 forms another extended spacediagonal 94 of a tetrahedron. This spacediagonal lies nearly horizontally in the drawing. Therefore, this shape has also imagined to be turned into the vertical position.

The ground area of the shell 185 in FIG. 105 is again within the x-y-plane. It can be characterized as a barrel roof, because it has two plane border-arcs 186 each of two array sides 8 with the format s3, and two straight sides 58. But just as well, it may be characterized as a synclastic shell with two opposite anticlastic open enlargements, because the bulge is very strong upwards in the middle and protrudes laterally even beyond the straight bearing border-curve 58 at the bottom. Also this example demonstrates that inventive shells can exceed the shape of a hemisphere downwards without having there borders with arbitrary cut-offs.

After these unusual building shapes in FIGS. 102, 103, 104, and 105, which are hitherto unknown even in a similar manner in the case of a not-inventive subdivision, once again, in FIGS. 106-115, shapes are shown, which are arranged within two interwoven cubic grids, but whose meshes have slightly other shapes than before. The sherd formats of FIG. 106 are valid for FIGS. 107-114.

In FIG. 106, the upper half of an octahedron as a basic polyhedron 90 is shown oriented with two vertices 6 at the y-axis, two other vertices 6 within the x-z-plane, and with two edge's middles 37 at the x-axis. Here, two complete, equilateral triangular polygons lie in an inclined position above, while four halved polygons having the shape of right-angled triangles stand upright to the ground area. The right-hand one of both equilateral triangles is again subdivided as a basic polygon 36 into sixth-sectors 35 whose finely hatched specimen is vaulted by a synclastic sherd 24 with the format A as a part of a double sherd 30 with the format A+A'.

This sherd can be seen in FIG. 107 within an approximated hemisphere of equal sherds. This approximated hemisphere represents the half of a "sphere" having the net of meshes being topologically identical to the "sphere" of the hemisphere of FIG. 50. This equality results from the duality of the cube and the octahedron.

However, the shells from FIGS. 50 and 107 have two differences: On one hand, the net of meshes is turned 45° around the y-axis. On the other hand, a synclastic sherd 24, with the format A, filling the same spatial sector region within the sherd's side planes as in FIG. 32 and being located on an octahedron, compared to such a sherd being located on a cube, has other proportions of the chord lengths to each other within the meshes' net and other slope angles of the array chords and mesh faces on the corresponding equal "seat" within the net of meshes. This could be recognized in a representation wherein the both nets of meshes cover each other as well as possible in order to compare them.

As has been explained for FIG. 35, in only one of the both intersecting curve-arrays of the net of a sherd, each curve on its own can have equally long chords lying after one another. Each curve of the other array transverse to it, on its own has chords of different lengths, lying after one another, which chords become increasingly shorter, away from the array corner 4 being right-angled here, towards the polyhedron's vertex and the sherd's corner point 6. This affects scale-trans surfaces even more. It turned out that it is less conspicuous if the shorter curves are irregular. But, in the case of the octahedron's sherd as an exception, the curves being the shorter ones are those which are subdivided evenly. That is why the subdivision is more irregular here than in the case of the cube's sherd. But—rather in contrast to the expectations—in the case of the octahedron's sherd, the deviation of the node points from the spherical surface is slightly smaller.

Also in FIG. 106, a cat-slide-roof's anticlastic sherd 24, with a format C, extending to an endpoint 51 of a cushion-roof's bearing side on the plane of the synclastically vaulted polygon of the polyhedron, is joined to the anticlastic sherd 24 with the format A. Beside, both sherds are enlarged into a double sherd being shown scaled down. The synclastic sherd with the format A is applied in FIG. 107.

FIG. 108 shows a complex shell as a section of an infinite curved surface of the anticlastic sherds with the format C and of double sherds with a format C+C. Like the net of the synclastic shell, also the net of the anticlastic surface, along with the two related interwoven grids of tunnel-axes, is rotated 45° around the y-axis. But here, if an equal edge length of the basic polyhedra is presupposed, these grids are markedly larger because the circumpolygon of a triangle has longer sides than that one of a square, whereby the straight train-side curve of the anticlastic sherd with the format C, as a half side of a circumpolygon, is markedly longer than in FIG. 44. In each of both compared assembly-kits, the straight train-side curve of the sherd with the respective format C has a quarter of the length of the facediagonal of a square between four tunnel-axes 88. Nevertheless, the center-point 91 of the basic polyhedron able to be inserted, here of an octahedron for synclastic sherds, is not a grid-node but the midpoint of a tunnel-axis.

In FIG. 108, the axis-grids are cut off below in a horizontal plane. Here, the complex shell is bounded below by two border-arcs 186 of two array sides with the format s3 within the same plane.

Like that one in FIG. 101, the cushion-roof 57 in FIG. 109 is triangular—according to the shape of the triangular basic polygon being inscribed in the middles 6 of the roof's sides and being a part of a basic polyhedron of triangles. But the incline of the inclined array-curve planes, with respect to the basic-polygon's normal 93 through the polygon's middles, has become less strong again than in FIG. 101.

FIG. 110 shows a synclastic shell 187 with a rather low opening below a flat border-arc 186 within a vertical plane.

By a copy 187 turned 180°, this shell 187, has become a closed complex shell in FIG. 111, with two "humps" and a hatched, rhombus-like symmetrical composed quadrilateral 56 as a saddle surface in between, which extends across the arc 183.

In FIG. 112, the fore part region, lying before the y-axis, has been transferred from the shell of FIG. 110 and has been doubled towards the rear side by copying it and rotating it 180° around the z-axis.

In FIG. 113, a thickly outlined, merely anticlastic part region from FIG. 108 on the left, which is located between two plane arcs 186 and four straight train-side curves 52, has been attached, in the front, to the formation from FIG. 112

In FIG. 114, the mixed-curved region behind the y-axis in FIG. 112, has been transferred from there and copied three times. So, a serrated roof of rounded shed skylights has been formed.

Finally, in FIG. 115, by scaling, the shell shape from FIG. 112 has obtained a completely other shape.

Thus, its double sherds are no longer modules of an unit-construction-system according to FIG. 106 but only of a new assembly-kit. Put together in triplicate, the scaled shell results into an undulated barrel-vault.

Hitherto, various symmetric shells were shown, which can be put together modularly on their open enlargements being parts of an infinite, anticlastically curved surface within an infinite polyhedron and which thus belong to an unit-construction-system for single and complex shells. Now, they will be followed by shells, whose open enlargements belong no longer to such an infinite, anticlastically curved surface indeed, but still consist, however, of double sherds where three planes of array sides 8, 9 meet in the center-point 91 of the convex basic polyhedron and where the plane of the fourth array side 8 on the opening's border-arc is oriented also here, like in the case of a cube as a basic polyhedron (compare with FIG. 52), in parallel to another, an upright polygon 36 of the basic polyhedron. Then, the anticlastic double sherds 30 are no longer composed of sherds with only one format indeed.

Also the tetrahedron in FIG. 116, as a basic polyhedron 90, is no longer built into an infinite polyhedron of tetrahedra and octahedra. First of all, it is shown in a position with only one symmetry axis, the y-axis. The polyhedron's half below the x-y-plane is dashed. Here, the synclastic sherd 24 with the format A indeed is exactly the same as that one in FIG. 98. But the anticlastic sherd 24 with a format C differs by the shape from that one in FIG. 98. Cause, to be able at all to be used within an open enlargement, it is shrunk unilaterally, because all array chords 14 being located within array-curve planes normal to the polyhedron's edge 38, thus located within planes parallel to the plane of the both array sides 8 lying after one another with the formats s1 and s3, have been transferred with the same gradient indeed but somewhat differently than before, from the synclastic to the anticlastic sherd. Unlike FIG. 91, this has happened along with a halving of each array chord 14.

The anticlastic sherd has a cutting curve resulting thereof that is curved again. Consequently, starting from that curve as a cut-seam curve 26, another sherd 24 with a format D had to be drawn up to a new point 188 that deviates now from the plane of the basic polygon.

The array-curve planes of the new sherd had been fixed already before: The planes of the one array-plane in order to enable a plane arc's opening 2 between array sides of a format s4 within stand upright on the x-y-ground a plane in parallel to the next lateral polygon 36 of the basic polyhedron. The planes of the other array of curves lie horizontally, that is, in parallel to the ground-plane in order that the enlargement has bearing border-curves being horizontally plane.

The drawing construction of the decisive seam meshes has proceeded again by shortening construction lines, being not shown here, which lie within planes of seam meshes—in analogy to FIG. 78 (bottom). It does not matter on which of the both endpoints 6, 188 of the cut-seam curve this process has been started.

In FIG. 116, two unequal sherds 24 with the formats C and D together have a spatially curved cut-seam curve 26—instead of a train-seam line 64, which always occurs in rotation-symmetric double sherds such as in FIG. 15 or FIG. 45.

FIG. 117 shows a slightly deformed hemisphere whose net of meshes, imagined to be doubled into a "sphere", is identical to the "strawberry" 180 in FIG. 99. Unlike in the case of a cube, two of the three side planes of each sherd intersect no longer at angles of (360:n)° to one another in their intersection-lines 92, 93, 94. The n-gonal, here only triangular cap 80 above the basic polygon 36 to be vaulted in FIG. 116, in a position being sloped to the left, is thickly outlined (compare the analogous representation of the n-gonal caps in FIGS. 120, 122, 124, 126).

FIG. 118 shows a deformed hemisphere of synclastic sherds 24, provided with one opening of anticlastic sherds. Here, a second opening in the background on the left with a plane at an angle of 70.53° to the first one still would be possible.

If you tried to provide a shell around an octahedron, which is arranged in a twofold rotational symmetry in plan-view and has two polygons being located in parallel planes and being vertical, in the same way with openings like on the tetrahedron in FIG. 116, sherds with a format D would result with only a single surface-curvature, thus, as a simple section of a barrel. By that reason, there is no drawing of it.

All the convex basic polyhedra following now to the tetrahedron and having more sides than an octahedron are oriented in a twofold mirror-symmetry in plan-view. In the drawing, their lower halves are completely omitted.

In FIG. 119, all four different sherds 24, one of each format A. B, C, and D, are located on a pentagonal dodecahedron as a basic polyhedron. To save space in the drawing, the polyhedron has been halved.

But, to have nevertheless an idea of the whole polyhedron, a strongly scaled-down specimen of a whole convex polyhedron with the same orientation and the same center-point 91 at the origin has been inserted—as in other, later examples too.

The sloped, equilaterally pentagonal basic polygon 36 viewed hereinafter (top, left) is also hatched in the miniature. The synclastic sherd 24 is located laterally, above the tenth-sector 35 of the large pentagon as a basic polygon.

Concerning its shape and its subdivision into meshes, this sherd deviates slightly from a (not shown) sherd above the sixth-sector of an equilateral triangle as a basic polygon of the Platonic solid being dual to it, of an icosahedron. This correlation corresponds to that one, which has been described already for FIG. 107, between the sherd of a cube and of the octahedron as a basic polyhedron being dual to it.

Also here, on the upright polygon 36, a pentagon being halved by the x-y-ground-plane into a quadrangle between three regular vertices 6 and an edge's middle 37, again arises an enlargement with a vertical opening 2 within a plane in parallel to this halved polygon. The chords 14 of the anticlastic sherd, with a format C, which are located within array-curve planes normal to the polyhedron's edge 38 lying between the basic polygon 35 and the vertical polygon 35, get the same slope as within the synclastic sherd 24. But in contrast to FIG. 116, they are not defined by halving their length but again, like in FIG. 8, by cutting them off at a straight train-side curve, also like in FIG. 45, starting from the cap's bearing point, that is, polyhedron's vertex 6. But, because of the sherd being attached below in this drawing In contrast to FIG. 45, this straight train-side curve is already included in a congruent train-seam line 64. It is again the half of a side 58 of a regular circumpolygon being circumscribed to the basic polygon within its plane being sloped however relative to the ground-plane, that is here, of a pentagon, which can be also here the side of a cushion-roof. All these straight lines lie again at right angles to the hypothenuse 34 of the right-angled triangular sector 35 of the basic polygon such as in FIG. 44 above.

The accomplished dome is shown in FIG. 120. On the left of a thickly outlined n-gonal cap 80 being pentagonal here, a triangular cap 49 being dual to it, "above" an imagined icosahedron's triangle as a basic polygon, is shown outlined by dashed lines and hatched. The curved sides of the caps dissect longitudinally and transversely the typical spatial composed quadrilaterals whereof one has its midpoint 4 at the top of the shell. Here, the net of the cut-seam curves is topologically the same as that one of the edges of a rhombic dodecahedron.

The mainly synclastic shell in FIG. 120 is also provided with a lateral enlargement with a vertically plane entrance opening. Additionally, one identical vertical entrance opening and two openings being mirror-symmetrical to them could arise directly upon the ground-plane. A further enlargement is shown on the right above as a roof skylight. The enlargement's plane opening's border-arc lies in a plane being inclined towards the rear side and is round in a completely closed way. This enlargement replaces a pentagonal cap 80. Also each other cap can be replaced by an open enlargement, by copying a lateral enlargement and mirroring it upwards or to the side, in a plane of a border-arc 48 of this cap, and by making the mirrored piece then, by copying and mirroring it once more, a completely round enlargement.

On all platonic solids such as in FIG. 119, the array sides 8, 9 and the cutting curve 25 of the synclastic sherd 24 are located, like already in the case of the cube, within three different disparallel planes whereof each time two intersect: in the spacediagonal 94 leading from the polyhedron's center-point 91 to its vertex 6, besides; in the perpendicular bisector 92 of the polyhedron's edge 92 starting from the polyhedron's center-point, and finally; in the normal 93 located in the middle of the basic polygon of a convex basic polyhedron 90. Also here, these three planes' intersection-lines 92, 93, 94 intersect in the polyhedron's centrepoint 91.

This applies also to the different synclastic sherds 24 with the formats A, A', B, and B' above the different regular polygons of a semi-regular, an Archimedean solid as a basic polyhedron.

Representatively for the semi-regular solids, the upper half of a cuboctahedron as a basic polyhedron 90 is shown in FIG. 121. Like also in other examples for other polyhedra, the both sectors 35, above which a shell shall be vaulted, are shown turned around the upper basic-polygon's midpoint 39 in order not to cover the chord's net of the subdivision into meshes.

To a sherd 24 with the format A having the array side 8 with the format s1, being located within a vertical plane, being determined to be evenly subdivided, and being located above the eighth-sector 35 of a quadrat lying as a first basic polygon 36 horizontally on the top, joins, on the second, less evenly subdivided array side 9 with a format s2 of this sherd, another synclastic sherd 24 with the format B, above the sixth-sector 35 of a sloped equilateral triangle as a second basic polygon 36. The latter sherd has its second, resulting array side 8 with the format s3 within the plane of the determined array side with the format s1 of the first sherd with the format A. At a by-zenith 81 in the font on the left, it meets five other sherds being either equal or mirrored to have the format B'. This by-zenith is located at another face-normal 189 being located in the lateral basic-polygon's middle 39 and leading to the center-point 91 of the cuboctahedron.

To the synclastic sherd 24 with the format B'—shown here only by array curves 11—to another array side 9 with the format s2, an anticlastic sherd 24 with the format C has been joined. Its definitive array side 8 with the format s4 has been drawn at one's free discretion.

The way to draw at one's discretion was necessary, because, by proceeding according to FIG. 116, an enlargement would not arise whose curved surface on the opening's border-arc everywhere would lie exactly perpendicular, thus here horizontal, to the opening's plane in order to ensure the continuous transition to a neighboring shell; and because, by proceeding according to FIG. 119, not any open enlargement but only a very acute cushion-roof's corner of only one format being slightly curved and stretched and of its mirror image could arise.

Also here, the plane of the shell's opening 2 is oriented parallel to an upright, halved lateral basic polygon 36 being situated as close as possible, this time being diagonally halved by the x-y-ground-plane.

The orientation of possible additional openings is equivalent to that one on the cube, but the anticlastic surface of the enlargement is smaller here than on a comparable shell in FIG. 56, based on a cube. Besides, the border-arc of the opening is rather pointed and less frame-like shaped. A modular arrangement of several shells, with maximum four lateral openings like in FIG. 54 as well as one upturned opening according to FIG. 52, is possible due to the relationship of the basic polyhedron to the cube. But by the reason that the anticlastic sherds cannot have a relation to an infinite polyhedron because none of them has a straight-lined train-side curve 52, which relation is a necessary condition for that modular arrangement, not any combination of several steeply sloped shells with an undulated roof consisting of cushion-roofs is possible. Consequently, the assembly-kit is not enlarged here into an unit-construction-system.

The accomplished dome in FIG. 122 can be assembled of three kinds of symmetrical caps. This time, there are two formats of thickly outlined, n-gonal caps 80, each above one basic polygon 36. Besides, there are—like on the cube as a basic polyhedron—larger triangular caps with right corner angles, as quarter shells, one of them being distinct by a wide hatching pattern. Finally, thirdly, there are rhombus-like shaped caps 190 bounded by hatched lines and each consisting of two synclastic sherds 24 with the formats A, A', B, and B' around a polyhedron's vertex 6. The sides of the rhombi form the net being topologically identical to a rhombic dodecahedron. In contrast to the vertices of the rhombi, the corner points of these caps are not coplanar certainly.

In FIG. 123, you see the eighth of a truncated icosahedron of 20 equilateral hexagons and 12 hatched equilateral pentagons. Also this basic polyhedron is semi-regular. It has the edges' net of an unusual soccer ball. The synclastic sherd 24 of the first drawn format A was drawn here like in FIG. 121 above the larger one of the both different basic polygons 36 in order to minimize the deviations from the spherical surface, which are stronger within the second drawn sherd with the format B, due to the latter's smaller extents.

The sherd with the format A is located above a twelfth-sector 35 of a hexagon 36 kept undissected here, while the adjacent sherd with the format B is located above the tenth-sector of an equilateral pentagon 36 being halved here by the x-y-ground-plane.

Starting from the cut-seam curve 26 included within the future double sherd, the sherd "above", that is, on the halved pentagon standing vertically here, as a basic polygon, is drawn, by transferring each chord from the already existing array side and by constructing cutting chords for each individual mesh from the basic-polygon's vertex point 6 to the by-zenith 81.

In both sherds, with the formats A and B, adjacent on the shared array side 9, the array-curve planes being not vertical but inclined relative to the respective basic polygon, lie in parallel to the plane of this shared array side 9, which plane includes the center-point 91 at the origin and a polyhedron's edge 38. The viewing direction, from which these array curves appear as a straight line, is the edge's perpendicular bisector 92. The plane of the projection oriented normal to it is made clear again by a circle marked with a cross here.

The pentagons and hexagons are strained now with comparatively flat caps 80 such that the polyhedron seems to become a "ball", whereof an eighth is shown in FIG. 124, forming the quarter of a shell whose deviation from a hemisphere's surface can no longer be perceived. Also for this shell, an alternative subdivision is possible—here within the regions of the hatched triangular cap 49 being bounded by dashed lines. Their corners 5, 81 are the vertices of a dual, already geodesically subdivided basic polyhedron, from which an alternative subdivision into meshes might be generated.

Enlargements for openings in such a dome and in shells being derived from polyhedra having even more faces have to be made intuitively in analogy to FIG. 121. Because the curvature of the synclastic sherd is comparatively slight, also here, its chords 14 of array curves within a plane being normal to the polyhedron's edge 38 cannot be transferred into an anticlastic sherd simply by moving them parallel and scaling them.

The basic polyhedron 90 following in FIG. 125 has, as can be seen in the miniature at the origin, 20 equilateral and 36 isosceles triangles. In the large representation, only an eighth thereof is shown. This eighth is already the quarter of a genuine geodesic cupola having the shape of a hemisphere with frequency 2 according to Fuller.

Four isosceles triangles are grouped around each equilateral triangle of the geodesic basic polyhedron. Each 36 of all these triangles will be covered with triangular inventive caps having continuous transitions to each other.

The generating process and the sequence of making the various, comparatively flat sherds still can be recognized, like in FIG. 123, directly by auxiliary lines and by eventually still missing chords of one array of curves.

Because of the triangular shape, this time it is that array side 9, with a format s1, which is located within a plane not being oriented vertically but inclined relative to the first basic polygon, and that, as the longer one of both array sides, determines by its fixed circular shape the shape of the first synclastic sherd 24, with the format A, above the sixth-sector 35 of the equilateral triangle as the first basic polygon.

It is somewhat more difficult to draw the other synclastic sherds 24 with the formats B, C, and D above the isosceles triangle being the second basic polygon. The radial line 189, on which the zenith 81 of the caps including later those sherds shall be located, runs through the gravity point 39 of this triangle. However, this radial line is not a normal to the second basic-polygon 36 being pearced by it, like it has been true up to now in the case of nearly all basic polygons. By that reason, for this cap, there are no longer any array-curve planes that stand perpendicularly to the basic polygon.

The meshes of the sherd 24 with the format B for an asymmetric double sherd were geometrically constructed like those of the sherd with the format B of the symmetrical second double sherd in FIG. 123.

But as a difference to it, the plane of the cut-seam curve 26 is inclined relative to the basic polygon.

The projection plane, where all array curves and the cut-seam curve above the isosceles triangular basic polygon appear straight-lined and whose normal is the radial line 189, was made clear in the drawing again by a cross within a circle below.

Before drawing the sherd 24 with the format C, at first, another new determining array side has been to be fixed. Once before, first of all, its array corner 4 had been to be defined. It is located at a radial line 191 that crosses a shorter isosceles polyhedron's edge 38 indeed, but this time not as a perpendicular bisector. Instead of this, the new radial line runs through a midpoint 192 of a connecting line 193 between the gravity points 39 of two adjoining isosceles basic polygons. Only then, for the sherd C, the new determining side 9, with a format s3, of equally long chords could be fixed, whose node points are now evenly distributed on a circle arc between a corner point 6 of an equilateral triangle, and the sherd's array-corner 4 at the new radial line 191.

Also the position of all curve-planes for the other synclastic sherd 24, with the format D, is defined by the new radial line 191. Like the smaller synclastic sherd 24 in FIG. 123, this sherd, along with its mirror image having the format D', also can be considered as a part of a pentagonal cap.

But within the accomplished quarter shell in FIG. 126, only the triangular caps are distinct by thick outlines.

By another subdivision than the described and illustrated one, the format B could be saved by mirroring the format A. But then, the outlines of the both other sherds would be shaped very differently to that one and to each other.

The domes represented before, surrounding basic polyhedra of lots of polygons, allow only a few possibilities to be added. Now, shells that base on simple convex basic polyhedra having again more adding possibilities shall be presented again. These are prisms with a quadrilateral regular plan and rectangular, upright lateral polygons.

The upper half, shown in FIG. 127, of an equilateral triangular prism as a basic polyhedron 90, serves as a first example. The prism has vertical lateral polygons 36 originally being quadratic but halved by the x-y-ground-plane into rectangles. Also here, the reference-point of the basic polyhedron is a center-point. All its vertices 6 have still the same distance to the reference-point and thus all are located still on an imagined spherical surface being centered there.

To the mirror-image A' of the format A of a first drawn synclastic sherd 24 that has an array side 8, with the format s1, determined as an evenly subdivided circle arc within a vertical plane and that is located above the sixth-sector 35 of the horizontally lying triangle as a basic polygon 36, joins, on the left, on the mirror-image's second, less evenly subdivided, resulting array side 9 as a subsequently determining array side, a second synclastic sherd 24, with a format B above/on the eighth-sector 35 of an upright, halved quadrat as a second basic polygon. Also this sherd might be mirrored simply in the plane of its cutting-curve, as a potential cut-seam curve 26, being geometrically constructed starting from a polyhedron's vertex 6 being located, spatially seen, on the top, in the foreground. The double sherd resulted thereof can be multiplied around its other corner on the bottom as a by-zenith 81 to result into a cap.

The anticlastic sherd 24 with the format C, joining to the first drawn synclastic sherd 24 with the format A, is formed again as in FIG. 116, that is, by halving the lengths of the mirror-symmetrically arranged, equally sloped array chords 14. But then, as a difference to there, four instead of three asymmetrical specimens of double sherds each with one format, including the mirror-image—according to the shape of the lateral basic polygon—are necessary for a shell's enlargement.

In FIG. 128, a shell 194 with only one opening is going to be joined to a complex shell consisting of three single shells 195 being initially open on three sides, in order to expand it. The individual synclastic shells 195, provided with bent-up free border regions, have enlargements with a small depth such that they can be called "inverted suspension-shells".

The second example for a construction-set for shells being able to be added is based on a hexagonal prism in FIG. 129 with the same lateral vertical polygons 36 as in FIG. 127. The hexagonal prism could be vaulted likewise by approaching to a spherical shape. But the upper hexagonal cap would turn out very highly situated above the hexagonal top having an area being quite large in comparison to the sides. Therefore, a respective ellipse's segment was fixed for both: for an array side 8 to be determined, with the format s1, located within a vertical plane being normal to a horizontal polyhedron's edge 38, for the both first drawn synclastic sherds 24 with the formats A and A'; and for the array side 8 to be determined, with the format s3, joining to this array side within the same plane, for the synclastic sherd 24 drawn after that, with a format B. By a continuous transition, the both ellipse's sections mutually join at an array corner 4 on the end of the perpendicular bisector 92 through the midpoint 37 of the horizontal polyhedron's edge 38. Each array side on its own has been subdivided into equally long chords.

By halving the array chords 14 and by transferring them with an equal slope, on the left side, like in FIG. 127, an unidirectionally shrunk, first anticlastic sherd 24 with the format C has resulted again from the first synclastic sherd 24 with the format A. Likewise, another anticlastic sherd, with a format D, with array curves being vertical and inclined 45° has resulted again.

At first, nevertheless, on the synclastic sherds: In the front, a resulting, spatially curved cut-seam curve 26 followed, coming from the already fixed resulting array side of the synclastic sherd 24 with the format A, that is, the array side 9 with the format s2, lying within an inclined plane, and from the fixed array side 8 with the format s3, being located in a vertical plane. Thus, by seam meshes along it, a third synclastic sherd 24 with the format E had to be geometrically constructed in the front below. Its resulting array side, within the plane standing here vertically upon the x-y-ground-plane and including a vertex 6, an edge's middle 37, and the center-point 91 of the prism, is not the same as the array side 9 with the format s2—despite of the same incline of 30° also of its own plane to the normal 189 through a halved square face 36. Thus, it has a format s4.

Then, this difference has the effect that, beside the first anticlastic double sherd 30 with the format C+D of sherds 24 with the formats C and D being asymmetrical to one another, there is another anticlastic double sherd 30 with the format F+G consisting of sherds 24 with the formats F and G being asymmetrical to one another.

The lower resulting array side 8 lying within the x-y-ground-plane, with the format s6, of the lower anticlastic sherd of the enlargement, has—like also in the previous example by the way—not any chords that are parallel to those of the lower array side 8, with the format s5, of the synclastic sherd adjacent on the left side. Thus, also at the vertically plane array side 9 with the format s4, it seems as if there were not any $C^1$-continuous surface-transitions being mathematically exact. This false impression is intensified by the very different average length of the horizontal array chords of the both sherds adjacent to each other there. But, by rounded curves through the node points or by rendering with hatched faces, the continuity of the surface would be visible.

FIG. 130 shows a shell resulting from FIG. 129, joining steeply sloped to the ground but being comparatively flat as a whole, provided with one lateral opening. Instead of the lateral caps 80 outlined thickly one time, this shell can receive up to 5 other openings. Two and a half completely opened shells are set to each other in FIG. 131, causing three connections in a continuous surface-transition.

The edge lengths of the prisms as basic polyhedra need not be equal on the top and on the sides in each case as in FIGS. 127 and 129. This implies that the lateral polygons need not be quadratic.

Because the regular top and bottom polygons can have also other numbers of sides, the prism can be quadratic too. In a retrospective view, you can consider the lateral cap 153 in FIG. 79, of three differently shaped sherds and its mirror-images, as the quarter of a shell around an ashlar being a prism with a quadratic plan and with vertices 150 being located lower than on a cube, even if the lateral border-curve 148 of that less regular cap had resulted only and thus had come into being very differently than the knowingly determined sides of the two shells shown before.

As already could be seen in FIG. 88, the circle-arc-shaped sections of the array sides change by scaling into ellipse's-arc sections. There, two times subsequently, a part region of a shell had been separated in a vertical plane of the co-ordinate system and each had been scaled on its own into the direction of one axis of the co-ordinate system running normal to this separating plane. As a result indeed, there are chords of different lengths even within one elliptical array side.

Also n FIG. 132, again a shell having a cube as the basic polyhedron and consisting of sherds with the formats from FIG. 44, is coming to be the object of a partial scaling. The shell is shown in a top view exactly perpendicular from above. At first, in a vertical plane of two cut-seam curves 26 and two array sides 9, it is dissected diagonally into a lower left part region 196 with two open enlargements and into one closed part region on the right above. By an additional halving, the closed part region is dissected into two part regions 197 each of two halved caps. The both dissecting planes represent now the x'-z'-plane and the y'-z'-plane of a co-ordinate system having been turned 45° around the z-axis.

In FIG. 133 then, the lower left part region 196 from FIG. 132 has been stretched in the y'-direction by scaling towards the lower left, and has been re-assembled with the both unaltered part regions 197. In doing this, the node points of each altered seam mesh 31 crossing the x'-z'-plane remained coplanar. Its both node points 13 having the same z-altitude kept their altitude even if the seam mesh is asymmetric now. Each transition between differently scaled regions on a cut-seam curve 26 is even more inconspicuous as that one in FIG. 88 on shared array sides 8 of differently scaled part regions.

By the same factor as within the lower left part region, the shell of FIG. 133 was stretched in FIG. 134 within its upper right part region. So, in the altered shell, one more co-ordinate system, an oblique co-ordinate system x",y",z", could be installed, whose vertical planes, namely the x"-z"-plane and the y"-z"-plane, include vertical array sides 8 that meet at the zenith 5. This is possible only because the performed scaling aligned with the x'-direction on its own or the y'-direction on its own was as large into the direction of the arrow as into the direction opposed to it.

This is no longer true in FIG. 135. Therefore, the idea of an oblique co-ordinate system cannot apply here. This time, the upper left half of the shell from FIG. 134, located beyond the y'-axis, has been stretched in the negative x'-direction. This has happened by the same factor as it had come to pass in the y'-direction in FIGS. 133 and 134. By that reason, the upper left part region in FIG. 135 has again planes at right angles to each other, of array sides 8. These array sides have an elliptical shape, because not any scaling had been in z-direction. They are more regular than the array sides included within the border-arc 148 of the flat cap 153 in FIG. 79.

In FIG. 136, the upper left part region of the shell has been stretched once again such that all four array sides 8 meeting on the zenith 5 are located within different planes.

In FIG. 137, the shell from FIG. 136 has been rotated not only in order to turn the array sides 8, located within a plane in parallel to the plane of an opening, into the y-z-plane of the initial co-ordinate system x, y, z. Moreover, the whole shell has been stretched in the x-direction and shrunk in the y-direction.

The result, the shell 198 in FIG. 137—as against the comparable shell 20 shown below in FIG. 1, with two open enlargements adjoining at a corner—represents already an improvement, but has not yet the likeness of the intended shape. Because of the high degree of asymmetry, it belongs only to an assembly-kit.

As can be seen in FIG. 138, on one of its openings, the shell 198 from FIG. 137 has been enlarged by an identical shell into a double-shell.

The shell 198 from FIG. 137 can no longer be added with identical shells into a complex shell by expanding two-dimensionally. But on both openings, it can be assembled still with two equal shells into open chains. These restricted possibilities to be added apply also to the regular domes in FIGS. 118 and 120 if these ones have been provided with a second lateral opening. Despite of their high degree of symmetry, these both domes belong only to an assembly-kit, just like the domes around prisms in FIGS. 128 and 130 and the tailorable shell 198 in FIG. 137. They do not belong to a construction-set because the places where caps or enlargements are optionally situated cannot be changed.

While the vertical planes of the border-arcs of the four part regions of the shell in FIG. 136, meeting between the array sides 8 on the zenith 5, are at odd angles to each other, a construction-set will be shown hereafter, for shells wherein part regions even with differing formats cover even-numbered angles.

In FIG. 139, a part region in the lower right x-y-quadrant is taken out of a shell such as in FIG. 132, with planes arranged at right angles, of array sides 8. It consists of two dome segments 199, 200 being acute-angled at the zenith 5 and being distinct from each other by a thick cut-seam curve 26 and by a thick array side 9: on the one hand, of a triangular cap's half 199 consisting of two synclastic sherds with the format A and one with the format A'; and on the other hand, of a half of an enlargement part-region 200 consisting of one synclastic sherd with the format A' and four anticlastic sherds with the format C from FIG. 44.

These dome segments 199. 200 occupying up to now an angle of 45° on the zenith 5 in top view have been diminished in FIG. 140 and extended in FIG. 141. But this happened not by scaling. Instead of this, this segment angle of 45° was diminished or enlarged. But this happened not by turning the array sides simply around the origin. That is to say, merely the cut-seam curve 26 and the array side 9, belonging to both dome segments and located above the angle bisector between the x-axis and y-axis, were adopted concerning the position and the shape.

Then, a new angle at the z-axis, between two vertical side planes of a sherd, was defined. The angles between these planes are (360:n)° or (90-(360:n))° in order that the dome segments 199, 200 in FIG. 139, 201, 202 in FIG. 140, and 203, 204 in FIG. 141 can be set to each other without gaps as well as modularly, and in order that there can be three, four, or five array-side planes per sherd. For "n", the number 10 was chosen here. Consequently, instead of 45°, the one angle in FIG. 140 is 36° and that one in FIG. 141 is 54". By the new orientation of the vertical planes of the array sides, also the planes of all array curves are defined—and by their chords, also the outlines of the seam meshes 31. The process to draw a seam mesh was analogous to FIG. 4. That is why the numbering is not repeated here. The geometric construction has started again by cutting off a horizontal traverse line 40 at each of the both ends 46 in the intersection points with one of the array-curve planes. The both node points 13 of each single mesh, which node points out of the cut-seam curve hitherto have the same altitude, have the same z-altitude here again, but not the same absolute altitude as before in FIG. 139, which, on its part, is the same as in FIG. 133.

The purely synclastic dome segments 201 in FIGS. 140 and 203 in FIG. 141 each consist now of three sherds, with different formats, no longer being able even to be made congruent by mirroring. The likewise anticlastically curved dome segments 202, 204 all together include, along with the both mirrored sherds of the upper caps, eight other, anticlastic sherds with again other various formats.

In FIG. 142 then, in fifteen different examples of shells, the dome segments from FIGS. 139-141, or only its upper regions are combined differently. In the left-hand vertical row of FIG. 142 at first, with five cushion-roof shells 205, 206, 207, 208, 209, the anticlastic region of each dome segment is reduced to one anticlastic sherd in order that only one sherds' pair of one synclastic and one anticlastic sherd is remaining of each dome segment. Here are arisen, as shapes of the straight bearing curves: an equilateral pentagon 205, an isosceles trapezoid 206, a rhombus 207, an asymmetrical trapezoid 208 and a kite 209. The both other vertical rows each of 5 shells in FIG. 142 show ten steeply sloped shells being composed of segments from FIGS. 139, 140, and 141. Each of the three shells of a horizontal row in FIG. 142 has the same vertical array-side planes.

The angles between the closest vertical array-side planes of the shells 205, 210, 215 in the uppermost row are five times 72°. In each shell of the uppermost row, an array side 8 of a double sherd 30 is located in the same plane as a cut-seam curve 26 joining at the zenith 5, of another double sherd.

All other 12 shells shown below it in FIG. 142 include asymmetrical double sherds of two sherds that cannot be made congruent by mirroring in the plane of a cut-seam curve. In each shell 206, 211, 216 of the second, 207, 212, 217 of the third, and 208, 213, 218 of the fourth row, at least once, the cut-seam curves 26 of two double sherds meeting opposite at the zenith 5 are located within one plane. In each shell of the third and each shell 209, 214, 219 of the lowest row of three shells, at least once, two array sides 8 meeting at the zenith 5 are located within one plane. In none of the three shells of the lowest row, at the zenith, one cut-seam curve is located coplanar with another cut-seam curve.

If you inscribed again a basic polygon or a prismatic basic polyhedron into all 15 shells, then, in top view, this would have the shape of: an equilateral pentagon in the uppermost row of three; that of a kite in the second uppermost one; that of a rectangle in the middle one; that of an irregular quadrilateral in the second lowest; and that of an isosceles trapezoid in the lowest one. The quadrilateral prisms can be considered as deformed cubes.

The shown shells of the middle and the left column have openings ranging from two to five, in an arrangement being free to choose. Identical of different shells can composed into open or closed chains. Several chains can be interconnected several times. Some shells 215, 219 can even be composed with identical shells into circular annular chains. Shells such as 207, 212, 217 in the middle row, being circumscribed to an ashlar as a basic polygon can be even combined two-dimensionally like in FIGS. 59-61, merely with other proportions. Thus, the sherds with the formats from FIGS. 140 and 141 are parts of a construction-set.

If a shell being built accordingly, within one part region, has at least one open enlargement consisting of one segment 200 from FIG. 139 and the mirror-image of this segment, that is, one enlargement of sherds with the format C, then, such a shell can be connected with a shell of the unit-construction-system purely based on a cube.

Hitherto, mostly, construction-sets or unit-construction-systems, each of shell's pieces of a few formats, for single or complex shells were described. There, the shells complied with polyhedra that were symmetric. In the course of this, it turned out that the cube offers the most possibilities for variations and, in same time, can be imagined in the simplest manner.

Hereafter, a custom-tailored shell, called already a "blob", standing individually on its own, will be drawn, consisting of an assembly-kit of lots of differently shaped shell's pieces. This shell shall develop by deforming a regular shell. In doing this, the shell is not simply deformed by the described scaling processes. Instead of this, the process restarts thoroughly from another convex basic polyhedron. This time, it is an irregular polyhedron that is going to be vaulted or enveloped. It has a reference-point at the origin, being displaced from the gravity point. However, by reasons of simplicity, it has still upright lateral polygons. Therefore, it is a prism here, with irregular quadrilaterals in a horizontal position that are equally large as a bottom and as a top.

For comparison, in FIG. 143, the wireframe of the array sides within planes parallel to one of the co-ordinate-system's planes, of a shell similar to that one 128 in FIG. 62, around a half-shown polyhedron as a basic polyhedron 90 can be seen. You can see both: the border-arc of an open enlargement on the left as well as in the front, and the horizontal border of a closed synclastic shell. Besides, horizontal straight train-side curves 52 run from the cube's vertices 6 being the upper ones here to the endpoints 51 of the straight sides 58 of the circum-polygon for the bearing border of a potential cushion-roof. Several times, a straight orientation-line 74 runs from the midpoint 39 of the horizontal basic polygon through the middle 37 of a polyhedron's edge consisting of two equally long parts 33 and through a corner point 51 of the circum-polygon. On each orientation-line such as that one on the right, each line 32, 53 lies between two of the three aforementioned points. From the center-point 91 of the basic polyhedron, a line runs as a perpendicular bisector 92 of a polyhedron's edge through the edge's middle 37 up to a common array corner 4 of four sherds whereof respectively two have one array side 8 within the same plane being oriented vertically within the co-ordinate system. In the edge's perpendicular bisector 92, the array-side plane of these four sherds, which is oriented normal to a polyhedron's edge consisting of two equally long parts 33, intersects at a right angle the other array-side plane, which is inclined with respect to the normal 93 of the horizontal basic polygon.

In FIG. 144, this orthogonality of the array-side planes is abandoned along with that one of the horizontal basic polygon. Besides, the polyhedron's edges as sides 38 of the basic polygon 36 are no longer dissected centrally by the lines 92, which are located exactly below the orientation-line, and that thus are no longer perpendicular bisectors to the respective side 38 of the polygon. Likewise, the straight sides 58 of the circumpolygon for the cushion-roof's bearing border are no longer divided by the cube's vertices 6 into two parts 52 of equal length. Also the parallelism of the opposite sides of the circumpolygon is removed.

The obliqueness of the upper horizontal basic polygon of the polyhedron recalls that of FIG. 24. Accordingly, also here again, twice within the basic-polygon's plane, two extensions 76 of basic-polygon's edges 38 being opposed here and an orientation-line 74 in between coming from the reference-point 39, intersect in a vanishing point 75. Also here again, the orientation-line subdivides a basic-polygon's edge into two parts 33, which have again different lengths. The both basic-polygon's edges 38 being opposed here join to the endpoints 6 of that basic-polygon's edge.

In FIG. 144, the four future cut-seam curves 26 being thickly hatched here and the likewise thickly hatched array sides 9 each joining below to one of them within the same plane, can be seen. All four planes of these curves 26 and sides 9 are vertical and intersect in the z-axis along the line 93 between the origin 91 and the zenith 5 and each include a cube's vertex 6.

Intentionally, the zenith 5 of the shell has been displaced from a position above the gravity point of the basic-polygon's area to the rear and to the left. Because of the offset of the reference-point 91 out of the gravity point and also out of the intersection point of the facediagonals within the basic-polygon's cutting face within the x-y-plane, the so-called "face-diagonals" 94 between this reference-point 91 and a polygon's corner 6 are no longer parts of genuine facediagonals. Nevertheless, like happened already in the case of a tetrahedron, they are called here like this, because they have the same inventive function.

Also in FIG. 143, first of all, the node points 27 of a thick cut-seam curve 26 being located there in the front on the left, and the node points 13 of a thick array side 9 joining to it below, have been transferred into FIG. 144. The altitude of these node points 27, 13 has been adopted for the four corresponding new vertical planes of the cut-seam curves and array sides of the new shell. This has happened by drawing horizontal lines 220 coming from the initial node points, into a direction parallel to the next polyhedron's edge 38, up to new node points within the four new vertical planes. As a whole, these horizontal lines 220 look like the contour lines of a cloister vault.

In FIG. 145, the making of the upper cap has been started, that is to say, coming from its bearing point 6 in the fore upper vertex of the prismatic basic polyhedron. The area there is rendered loupe-like magnified. At first, a horizontal traverse line 40 has been drawn through a point 41 located on a cutting chord 28 joining to the cube's vertex.

Again, like in FIG. 24, this horizontal traverse line lies in parallel to the next straight train-side curve 52. Already in FIG. 24, the orientation of the straight train-side curve as a part of a sole freely determinable one of the circumpolygon's sides had been freely determinable. But here, the straight train-side curve is more significant, because it is also the surface tangent of a synclastic expansion part of the shell at the corner point 6 whose development will be shown not before FIG. 147. Thus, it determines not merely the more or less stretched or unidirectionally shrunk proportions of a cushion-roof, but moreover, also those of a steeply sloped synclastic shell as well as the depth of that shell's potential enlargements. By determining the orientation of the straight train-side curve, also the tangent 221 is determined. This tangent below, to the bearing curve of a closed, steeply sloped, synclastic shell, is parallel to the straight train-side curve and runs through the lateral common array corner 4 within the x-y-ground-plane.

As will be seen later in FIG. 148, this lower common array corner 4 can also be the turning point where the bearing curve of the synclastic region of a shell passes over into that one of the anticlastic region of the shell's enlargement. The more all the aforementioned lines 40, 52, 221 are turned such that their angle δ to the y-axis becomes smaller, the less deep becomes the shell including the enlargement in the x-direction, and the more stretched in the y-direction.

Coming from the upper end 27 of the cutting chord 28 joining by its lower end above to the prism's vertex 6, then, into each of two directions being sloped downwards, a line as a part of a future array chord 14 has been drawn at first up to one of the both endpoints 46 of the horizontal traverse line.

These endpoints 46 are located in different vertical array-curve planes. Each array-curve plane is oriented parallel to the next orientation-line 74 and is represented in the drawing by a short auxiliary line 44 in parallel to this orientation-line.

Then, each of the both still uncompleted lines of the future four sides of a seam mesh has been extended to become a complete array chord 14.

Unlike FIG. 24, the respective lower endpoint 13, resulting from this extension, of each of the both complete array chords 14 is not located in a vertical array-curve plane but in an inclined one. Here, this plane is an array-side plane that includes—like the plane's section 96 in FIG. 33—the origin 91 and the polyhedron's edge 38 next to the chord. But now, the incline of the parallel curve-planes is no longer 45° within the whole shell, but another one on each side of a polygon.

By drawing, the extension of the part line segment of the chords 14 has happened as follows: Each time, an imagined viewing direction, clarified by an arrow, aligned with the next polyhedron's edge 38, has been chosen, whose projection plane normal to it is shown again by a cross within a circle. Then, in that imagined view, the part line segment of the chord has been extended up to the spacediagonal 94.

Only after that, it was possible to draw the both other, the resulting dashed array chords 15. Hereby, the first mesh of the double sherd of a cap upon an irregular basic polygon of a basic polyhedron was fixed. The next higher mesh has come into being accordingly. However, in the imagined view aligned with the polyhedron's edge, the part line segments of the chords are not extended up to the spacediagonal 94 itself, but only up to a parallel 101 to the spacediagonal, which parallel is attached to the lower cut-seam node 27 of this mesh. In the same manner, the other seam meshes up to the zenith 5 are defined.

Coming from there, also the other seam meshes of the double sherd being situated opposed on the zenith have been defined up to the rear vertex 6 of the polygon. However, the imagined viewing directions, wherein the part line segments of the chords are extended up to the respective spacediagonal's parallel 101, are other ones there because the basic polygon has no longer parallel sides.

Now, the other, conventional quad-meshes, shaped as parallelograms, of translational surfaces can be joined to the seam meshes in order to complete the cap. But this is no longer shown in a drawing.

Instead of this, in FIG. 146 as an alternative to FIG. 145, the making of a shell of sherds with a scale-trans subdivision into meshes is started. In the case of free-formed surfaces from irregular polyhedra, there is not the advantage to have a few panel formats indeed. But the advantage of having a more pleasant appearance remains. The more pleasant impression results from the fact that, if a double sherd is considered as a homogeneous deformed net of quads without knowing that it consists of two sherds, the curves of the net's longitudinal and transversal direction do not have an inflexion point being quite strong where they cross the cut-seam curve. Besides, the angles of the four corners of meshes at an individual node point, differ less from node point to node point.

In FIG. 146, the geometric construction proceeded coming from the same circumpolygon for a cushion-roof and from the same cut-seam curves 26 and array sides 9, which have been defined in FIG. 144 and were used already in FIG. 145. Consequently, the vertical array-side planes and array-curve planes are identical, as well as the inclined array-side planes and the imagined viewing directions, clarified by arrows, for extending the part line segments of the chords into complete chords 14. However, the array curves themselves will get other shapes.

Instead of the lines 101 parallel to a spacediagonal, such lines 105 that are aligned radially to the origin 91 have been joined to the cut-seam nodes 27 within the vertical cut-seam planes, you see. These radial lines 105 represent the inclined array-curve planes in an imagined view parallel to a polyhedron's edge. Thus, for the right-hand sherd of the double sherd in the front on the right, being under construction and already having all array curves 10 in vertical planes, the radial array-curve planes arranged transversely to it intersect in a reference-line 103 parallel to the upper right edge of the polyhedron. Unlike FIG. 36, this reference-line lies no longer on the x-axis.

But in FIG. 146, this time, it is the area for the left rear double sherd with other relevant polyhedron's edges, that is shown loupe-like double sized. Here, only the seam meshes are drawn so far. There, on the rear side, the horizontal traverse lines 40, which cross the cutting chords 28 at a point 41, have an orientation being identical to FIG. 145. Because, there in the background, they are parallel to the part 52 of the rear side for the cushion-roof, they have another orientation than the four fore horizontal traverse lines being not magnified in FIG. 146. Within the shell, the auxiliary lines 44, being parallel to the orientation-lines and conceived for fixing the vertical array-curve planes for the array chords 14 of the seam meshes, have the same orientation on the left behind as on the right in the front, because two times, two orientation-lines 74 each lie on one straight line.

The fixing of the conventional trapezoidal quad-meshes, which has happened already within the double sherd in the front on the right, proceeding from the both cut-seam curves into the surface of the sherds, is not as simple as in the case of the translational subdivision into meshes. That is to say, the length of each chord of the vertical array curves 10 had to be individually defined here by extending or sometimes also shortening it up to a radial line 105, from the imagined viewing direction aligned with the respective edge of the polyhedron.

In FIG. 147, the net of the upper, thickly outlined cap 80 of four different asymmetric double sherds is already complete. Moreover, in the front on the right, the making of two lateral caps, which are halved by the x-y-ground-plane, has been started in order to expand the upper shell downwards to result into steeply sloped synclastic shell. A double sherd of the fore cap and one of the right-hand one have progressed differently.

The geometric construction of the right-hand one of the both double sherds will be explained more in detail: It has been processed again from the fore right vertex 6 of the prism—this time downwards up to the by-zenith 81 that is located on the curved bearing border of the shell, within the x-y-ground-plane. The cut-seam curve to be constructed lies on an oblique plane that includes a prism's vertex 6, a by-zenith 81 and the origin 91. The connecting line 189 being horizontally oriented here, between the origin 91 and the by-zenith 81 lies in parallel to an orientation-line 74.

A part of the right-hand one of the both developing lateral double sherds is shown under the loupe again, as can be seen on the right side of them. For a time, the position of the cut-seam nodes on the already known oblique cut-seam plane was still unknown. Two array sides 9, whose planes intersect in the spacediagonal 94, of the four different array sides of the developing double sherd already exist. One of these array-side planes includes a horizontal polyhedron's edge 38 between two marked vertices 6, and the other one includes a vertical polyhedron's edge between the polyhedron's vertex 6 in the front and the point 37 within the x-y-ground-plane.

The geometrical construction of the seam meshes corresponds to FIG. 37 even if: its shapes are different, the zenith is apparently turned to the side, and the geometrical construction to be now described has been proceeded not from the zenith, but from the polyhedron's vertex. Here, unlike FIG. 37, the imagined view, in which all future curves 10 of one of the both curve-arrays of a sherd look straight-lined, is not aligned with the z-axis but with the connecting line 189 between the origin 91 and the by-zenith 81 within the x-y-ground-plane.

Between the array-side's node points 13, 78 next to the fore vertex 6 of the polyhedron, a skew traverse line 83 has been drawn as a diagonal of a future seam mesh. Then, this line has been cut off at first below at a point 41 within the cut-seam curve that, in the new viewing direction, appears as a diagonal line 34 within the polygon to be vaulted. The cut-off part is dashed. After this, a line has been drawn from the polyhedron's vertex 6 to the end 41 of the cut-off line. It has been extended up to an array-curve plane being vertical here and appearing, in the new viewing direction from the right, as a vertical auxiliary line 222. Hereby, it has become a cutting chord 28. Then, coming from the upper existing node point 13 of the mesh, a line has been drawn as an array chord 14 within a vertical array-curve plane. After this, another line has been drawn, as an array chord 14 within a horizontal array-curve plane, from the lower existing node point 78 of the mesh to the endpoint 27 of the new chord 28. This endpoint is the first cut-seam node of the new double sherd.

But before the next seam mesh was able to come into being by starting from this point, the quad-meshes 12, adjoining to the first mesh 31 of the new sherd and having an irregular trapezoidal shape, still had been to be drawn. At first, the upper new chord 14 of the seam mesh 31, as a copy, had been moved parallel upwards to the next higher node point 13 of the upper array side 9. But, because of the intended scale-trans subdivision into meshes, this copy had to be extended, before becoming a complete chord 14 of the adjoining quad-mesh to be drawn. Because of this, a radial line 105 being aligned to the origin has been joined again to the cut-seam node 27. Then, in an imagined view into a direction in parallel to the next upper horizontal edge 38 of the polyhedron, the upper one of the parallel chords 14, which is still too short, has been extended up to this radial line 105. This asymmetrical trapezoidal quad-mesh 12 has been completed by a chord 15 below. This chord and another chord 15 made in the same manner are two dashed array chords of a second seam mesh having been to be geometrically constructed after this. Then, this chord's endpoints have been interconnected again by a diagonal, skew traverse line 83, and so on.

The aforedescribed double sherd is drawn up to the third seam mesh. Also all quad-meshes resulting from the three seam meshes are drawn. But one chord is still missing on each one of the recently drawn quad-meshes. The other double sherd in the front is developing in the same manner, but has been proceeded only up to the second seam mesh.

The other double sherds of the synclastic shell, which can be seen in a completed state in FIG. 149, have equally developed. But this shell should be able to be modified. So, its lateral caps had to be left off again.

The upper cap 80 from FIG. 147, remained again in doing this, was intended to be enlarged for a time into a cushion-roof. This has happened in FIG. 148 to a large extent. On that occasion, like in FIG. 48, the array curves 11 lying within inclined planes have been gained again from an array side 9 by copying, by shortening in the lower part, and by moving in parallel. The curve's lowest points 54, as train-nodes, have come into being by shortening the straight horizontal train-side curve 52 to result into the length of a cutting chord—that is, in a view from above, by auxiliary lines 44 as cutting lines that this time lie in parallel to the orientation-line 74, which, in FIG. 48, was still congruent with the y-axis.

By choosing a (not shown) flatter basic-polyhedron and by keeping the existing cut-seam curves, the inclines, away from the z-axis, of all inclined planes of the arcs of the cushion-roof to be generated anew in that case, would have been able to be increased altogether. Seen from above, then, the arcs would have been more strongly curved. Hereby, keeping the cushion-roof's outline unchanged, the anticlastic corner-regions would have become smaller. This fact would have been better for the static load distribution. Nevertheless, it would have been possible likewise to increase the height of the basic polyhedron in favor of visual connections across extended corner regions of a once more anew generated cushion-roof. That is to say, beside 0° and 45°, the incline related to the z-axis, away from it, can have any useful value up to ca. 75°.

But in FIG. 148, indeed, the convex basic polyhedron having been fixed in FIG. 144 is kept unchanged. The anticlastic, cat-slide-roof regions of the cushion-roof in the front and on the left on the upper cap, which are, in contrast to the cat-slide-roof region on the right, explained just before, already completely drawn, shall be used as upper parts of two lateral open enlargements, arranged at an angle, of an otherwise synclastic shell, which can be seen as a result in the best mode in FIG. 151.

But for a time, again to FIG. 148. The lower common array corner 4 on the right is here already the turning point wherein the bearing curve of the synclastic surface region of a shell shall pass over into that one of the anticlastic surface area of the enlargement of this shell. In FIG. 148, the tangent 221 of the bearing curve at this point is parallel to a straight train-side curve 52 of the cushion-roof on the right. If the orientation of this straight train-side curve was changed, the depth also of the fore enlargement would change.

In FIG. 148, like the sherds of the cushion-roof's corner regions, also more below, the other sherds of these enlargements are formed of pure translational surfaces. By its upper cut corner 6, an anticlastic sherd is joined already to the prism's fore vertex 6 next to the viewer. The sherd's lower array side is located within the x-y-ground-plane. Its lateral array side 9 within a vertical plane including the array corner 4 within the bearing border, is already given according to FIG. 144.

The chords 14 within horizontal array curves of this anticlastic sherd should be located, equally oriented, on mirror-symmetrically arranged seats to the chords of the (not drawn) synclastic sherd to be imagined adjoining on the right. Therefore, the lower resulting array side of the already drawn anticlastic sherd on the x-y-ground-plane has come into being as follows: Each sherd 14 of the horizontal, lower array side 8 of the (not drawn) synclastic sherd has been attached, equally oriented, to the uppermost existing inflexion-point, that is, inner node point 13 of a curve. The parallel moving was aligned with the long thick array on the right. This curve is, for example, one thickly drawn array curve 11 running parallel to the shared array side 9 or this array side 9 itself. The shifted chord 14 has been shortened at a point 27 as a future cut-seam node.

The cut-off part is dashed. This point 27 is located within a vertical plane standing in parallel to the fore polygon 36 of the prism. The position of this plane is fixed within the depth of field by an existing node point 223 on a straight train-side curve of an accomplished sherd of the cushion-roof on its front. This plane, imagined to be seen from above, appears as auxiliary-line 224. Then, the next array curve 10, having been shortened by omitting one chord of the parallel one, has been joined to this cut-seam node 27. After this, coming from the seam mesh, the horizontal shortened chord 14 has been copied into the x-y-ground-plane—to be a part of the lower horizontal array side 8 of the drawn anticlastic sherd. Likewise, the other sherds of the two enlargements that have an array side 8 on the ground-plane have been defined too.

Finally in FIG. 148, each of the both interstices in the front, between a cushion-roof's sherd and a lower anticlastic sherd, still has to be filled with a triangular, wedge-shaped sherds' pair. Then, the straight train-side curves loose their marginal position on the cushion-roof and hereby become train-seam lines 64. The both sherds of each wedge-shaped sherds' pair still missing in an interstice, along with two adjacent existing sherds, are forming two new anticlastic double sherds. But, in contrast to that one 126 in FIG. 56, these sherds' pairs will be asymmetrically shaped. Their altogether four fore array sides will form that free opening's border-arc of an enlargement, which arc is located within a plane in parallel to the fore vertical polygon of the prism (compare FIG. 151).

As additionally shown magnified in a round section on the left in FIG. 148, the making of the cut triangles of the upper one of the both differently shaped sherds missing in the front on the left, has been proceeded starting from the left fore vertex 6 of the prism to the fore.

From the first node point 13 of an array side being located within a plane being inclined to the front, an auxiliary line 151 has been drawn up to any point 41 on the first horizontal chord 28 of the train-seam line. This inclined auxiliary line 151 has been extended up to a point 46 in a vertical array-curve plane that is oriented parallel to the fore lateral polygon 36. In an imagined view from above, this plane appears as an auxiliary line 224 being parallel to the fore upper horizontal edge of the polyhedron and joining to the first cut-seam node 27. A part of a new chord 14 has been drawn from this node point to the endpoint 46 of the inclined auxiliary line 151.

Then, this part has been extended to the left below, up to the node point 78 of a later drawn, dashed array curve. This node point 78 had to be located exactly within the plane of the hatched cut triangle 29 whose upper corner is located at the upper vertex 6 of the basic polyhedron and which belongs to the sherd already existing on the left of the gap to be filled. In the imagined viewing direction, which lies again—along with a line being oriented normal to an imagined projection plane made clear, as a symbol, by a small circle marked by a cross—within the plane of this cut triangle, this sherd would not appear as a surface but as a straight line only, up to which the already existing part of the new chord 14 has been finally extended in order to be a complete chord. Thus, the first mesh on the horizontal train-seam line 64 has been defined. Hereby, it was possible to draw in a dashed manner the missing chord 15 of the mesh.

Likewise, the next seam mesh has been geometrically constructed up to and including drawing a chord's part, starting this time from the second cut-seam node 27. But it was not possible to define instantly the endpoint 78 of the other chord 14 being complete after extending it. Before this, the next-lower hatched cut triangle 29 of the sherd already existing on the left has been copied and then, as a copy, has been shifted with its upper corner, into the direction of the short thick arrow, up to the first cut-seam node 27 of the horizontal straight-lined cut-seam curve. Only then, in the same manner like the hatched upper, undisplaced cut triangle 29, this one cut triangle has defined the plane wherein the sought endpoint 78 of the chord lies. After that, this process has been repeated still two times.

The curves 11 of one of the both curve-arrays of the upper new uncompleted sherd in the interstice are shown dashed. Their chords are made simply by copying and moving in parallel the array chords, having been drawn always at last and likewise dashed, of the seam meshes that are filed on the horizontal straight cut-seam curve. In contrast to those of all preceding enlargements, these curves 11 are spatially curved.

The next three FIGS. 149-151 show shells of the sherds geometrically constructed before. All three include the upper quadrilateral cap 80 being distinct in FIG. 149 by a wide hatching pattern, with the upper zenith 5, as well as the right-hand lateral half quadrilateral cap with the by-zenith 81. The, thickly drawn border-curves being continuous consist of plane array sides 9.

In FIG. 149, you can see the closed synclastic shell that joins steeply sloped to the ground and whose lateral caps being halved by the ground-plane had been started to draw in FIG. 147. Each of the lateral caps can be divided, like the upper cap, along thick but hatched array sides 8, in double sherds 30. Also these double sherds consist of the known quad-meshes 12 as well as of inventive seam meshes 31 between four coplanar node points. Each time, two of these points 13 are located within different sherds and two other ones 27 are located on the cut-seam curve.

In FIG. 150, the fore, the left and the rear halved cap have been removed from the shell in FIG. 149. Instead of this, as cat-slide-roof regions for a cushion-roof, three anticlastic sherds' pairs have been joined to the upper cap. Thus, a cushion-roof and a synclastic shell have been combined. The intransparently drawn shell, varying in brightness, is illuminated from slightly right above. The shell is hatched mesh by mesh. It covers the inner courtyard being opened on circa a quarter in the front on the right and belonging to a slightly oblique-angled existing building whose edges can be seen only as a wireframe. The straight train-side curve 52 of the anticlastic sherd of the cat-slide-roof corner regions form straight-lined roof sides 52, 58 lying upon the straight-lined roof edges of the existing building.

Such a roof may be used otherwise as an independent building. On one hand, the rear, train-like extension can be removed and a rear cap can be installed there again. On the other hand, other anticlastic sherds being defined like in FIG. 148 can be joined to the straight train-side curves of the both other cat-slide-roof regions in the front and on the left as well as to those more below, whereby each of the both cat-slide-roof regions becomes the upper region of an open enlargement. Then, the corner point 51 of the cat-slide-roof region becomes the apex of the border-arc of the enlargement's opening.

FIG. 151 shows the result of such an alteration, as the best mode of the invention. The shell is divided into four part regions by curves 55, 148 being here now thickly drawn and consisting of array sides 8, which are located in vertical planes. At the common zenith 5, a widely hatched part region, which consists, like that one from FIG. 53, of five double sherds whereof one is synclastic and four are anticlastic, in the front on the left, is opposed diagonally to a widely hatched triangular cap 49 on the rear right side. Two of the anticlastic double sherds can be recognized once again on the left of them, in a copy of the outlines of their sherds. Each of these both double sherds has three plane array sides 8, 9 and one array side 9 that is not plane. While the upper double sherd has still a train-seam line 64, the cut-seam curve 26 of the lower double sherd is spatially curved.

The shell in FIG. 151 shows the solution of the problems of the shell 20 in FIG. 1 below. The flexibility of a triangle net of shell's pieces 24 in a large scale is combined with the evenness of a quad net for meshes 12 in a small scale, whereat triangular meshes 29 on the cutting curves being sides of adjoining quad nets are combined in pairs to give irregularly quadrangular meshes 31.

Inventive modifications of the shell in FIG. 151 by further geometrical generalizations are not excluded.

For example, the shown shape—corresponding to that one from FIG. 132 in FIG. 134—can be distorted as a whole: by turning the co-ordinate-system—this time, however, not around the z-axis but around an axis that lies within the x-y-ground-plane; and by scaling the shell subsequently into one direction of the then new co-ordinate system x', y', z'. If the resulted imagined structure is set up, with its sloped plane of the bearing border, upon the x-y-ground-plane again, then, unlike all drawings before, the connecting line 93 between the origin 91 and the zenith 5 is no longer vertical but inclined. Then, the basic polyhedron of the shell is a slanted prism. Then, there are no longer any vertical curve-planes in the shell.

Convex basic polyhedra may also be frusta of pyramids. Then, the opposed, previously vertical polyhedron's edges of a lateral polygon are no longer parallel to the connecting line 93 between the origin and the zenith, but they meet in a vanishing point as an intersection point of their imagined extensions. Then—unlike the lateral vanishing point 75 in FIG. 144, of opposed polyhedron's edges—this point is not located laterally more a or less distant beside the basic polyhedron, but, instead of this, hovers more or less high above it.

Finally, instead of an upper horizontal polygon, also a lateral polygon can act as a basic polygon, from which the inventive process to vault all sides is started.

Because, from a technical point of view, these possible geometrical generalizations rather apply to special cases, they are not figured.

For a limited field of application for at least locally symmetrical shells in FIGS. 49-68, of an unit-construction-system, in FIG. 80 already had been shown how to turn the virtual net into a structure of straight-lined or curved bars or panels with an appreciable material thickness. The principle, used in FIGS. 81 and 82, of copying, moving in parallel, and reassorting node-axles can be transferred also to shells of sherds with special formats in FIGS. 69-74.

However, with this method, you cannot make without further instructions special formats being compatible with the unit-construction-system and provided with a material thickness and belonging to a net of meshes such as in FIG. 79 that has developed according to FIGS. 75-78 by the geometrical construction of a triangular cap, coming from two curved sides being not circular or not ellipsoidal.

Likewise, this method is hardly sufficient for irregular, custom-tailored shapes such as the shell strained on an irregular prism, the "blob" in FIG. 151. Thus, a generalization had to be found for this method.

On one hand, the convex basic polyhedron of the shell in FIG. 151 is irregular, you see. On the other hand, the reference-point 91, above which stands perpendicularly the zenith 5, deviates from the gravity point of the basic polyhedron. Despite of this, in FIG. 152 however, the zenith is the point to start the geometrical construction of the node-axles oriented approximately or exactly perpendicularly to the curved surface of the virtual net. But this time, the node-axles 155 are located only below the initial node points 13, instead of both: above and below with the same length.

The first node-axle 155 has been joined to the zenith 5 below in a vertical position within the z-axis. Because of this, the miter between two coplanar vertical edge-faces 156 is no longer symmetrical just here. This symmetry is not necessary because these both edge-faces belong to different array sides, which need not be coplanar. Thus, in the zenith, the both angles $\epsilon$, $\zeta$ of the miter are unequal. The fact that the both edge-faces meeting here are coplanar, is a special case remained here still from the cube. They are not coplanar even in a cap of five equally shaped double sherds such as in the cap included within the shells 205, 210, 215 in the uppermost row of FIG. 142, as well as in the cap included within the shells 209, 214, 219, of four unequally shaped double sherds in the second-lowest row of FIG. 142.

Joining to each of the four edge-faces 156 meeting in the first node-axle at the zenith, the other edge-faces 156 being differently shaped bat always lying within the same vertical array-side plane are drawn in the shape of irregular oblong trapezoids. But out of the zenith, the node-axles between two vertical coplanar edge-faces are drawn further on as angle bisectors between two axial chords so that miters between the edge-faces are always symmetric. However, their angles $\kappa$, $\lambda$ are different at each node point, because also the angles between two adjoining axial chords 14 of the same array side vary from node point to node point. Despite the miters of the edge-faces are mirror-symmetric on a node-axle on its own, the node-axles, already also in synclastic regions, are no longer aligned to the origin—in contrast to FIG. 80.

In the right fore upper sherd in FIG. 152, the process to generate the meshes of the lower, that is, inside surface of the shell has been started. In doing this, at first—to the node points 13 that are located, within the both vertical array-side planes, below, that is, inside—chords 15, transversely to these planes, have been joined that are parallel to the initial array chords 15 joining to the upper ends of the respectively identical node-axles. Those both chords of these chords 15 of the lower surface side that are located next to the zenith cross each other at an intersection point 27 being a cut-seam node. Hereby, also the first both edge-faces 158 each between an outside and an inside chord has been defined within a double sherd. Two chords 14 have been joined to the new intersection point 27 within the inside surface of the shell. Each of them lies in parallel to an inside chord of a vertically plane array side and forms one of two parallel sides of a trapezoidal mesh only after having been shortened by a chord 15 running transversely to it. Hereby, the both subsequent edge-faces 157, each between two parallel chords 14, were defined. In the same manner, the other intersection points 13, 27 on the lower, that is, inside surface of the shell, the other node-axles 155, and the other edge-faces 157, 158 located between these node-axles can be defined.

It is possible to transfer the geometrical construction shown in FIG. 152 to each sherd with at least three vertical planes wherein each time two array sides are located, thus, also to the shell 138 in FIG. 68—with exactly the same result as in FIG. 82 for this shell's upper part region.

FIG. 153 shows the complete result of FIG. 152—a shell with a material thickness without offsets. The edge-faces are shown intransparent. The faces of the meshes are transparent. So, the result appears as a grid shell.

The grid-shell's quadrivalent nodes can be carried out as overlaps of lying flat steel laths for a grid with a crosswise bracing of meshes according to Schlaich. Their other, that is, trivalent, 5-valent or 6-valent nodes can be carried out according to Fuller if the ends of all laths are bent off at the same angle. This can be tolerated in the case of very finely subdivided shells. In more widely subdivided shells, plate nodes between standing flat steel bars with an individual mitering according to R. Lehmann can be used very well for all node points. Then, in the case of free forms, special plates with notches, which allow rounded-off acute inflexions to deviate clamped diagonal cables are needed. Instead of plate nodes, also bowl nodes between rectangularity profiled hollow bars such as in the node system "Mero Plus" can be used. Then, oblong screw-holes for varying angles of meshes' corners reduce the number of node sorts.

Because the diagonal tie cables, mutually crossing in a mesh and clamped onto the nodes according to Schlaich in order to stiffen the quadrangular meshes, cause a conspicuously uneven impression within the area of the seam meshes, only one single diagonal tension element 225 was provided for each mesh within the whole shell surface. But, to avoid the element to relax as a cable or to be compressed as a bar, the net of tension elements has to be sufficiently prestressed. For that purpose, all shell borders have to be mechanically fixed. Therefore, on the openings of the shell, but only in this area, the meshes are provided crosswise with tie cables.

The bars of two adjoining quad-meshes 12 or seam meshes 31, occurring in the areas of the change of the curvature's direction of the shell surface as a whole and having here nearly or completely coplanar node points, are produced as continuous bars. The nodes to which no chords are attached or clamped have to be flexurally rigid in the direction perpendicular to the shell surface.

The finely meshed quality of the surface, that is, the degree of subdivision of the mostly faceted surface can be lower in the case of panel constructions than in the case of the known construction type as a grid net of bars with continuous diagonal cable bracings.

When the degree of subdivision shown in FIG. 153 is not considered to be representative for a much finer subdivision into meshes, but to be real, then, the mesh subdivision is too large for a grid-shell, because the tie cables are too strongly deviated in the nodes.

However, also in finely meshed grid shells, the difference between synclastic and anticlastic regions concerning the density of bars remains visible. This restriction and this disadvantage does not exist in the case of inventive plate constructions that always appear to be regular. FIG. 153 shows also the contours of the plates of a faceted panel construction. But coplanar adjoining meshes 12, 31 of two inversely curved adjacent sherds should be combined to give one component 226 in order to make the transition between these sherds extraordinary inconspicuous and rigid.

Beside the panel constructions, shown in FIGS. 39-41, with alternatingly overlapping external butt straps for bolting, welding, or gluing, also indentations within butts of areal components are possible, whereat the approximated zig-zag-pattern could be seen either in a (not drawn) cross-section of the butt of the edges or in a top view to the butt of the panels.

Only in the case of small shells, sherds that are already pre-assembled of panel components with the extents of a mesh can be assembled still without effort. In this case, the seam meshes 31 have to be either already attached to a sherd or later individually inserted.

The mounting of a larger inventive shell proceeds better mesh by mesh. This works the best by starting above. In that case, the unaccomplished shell is hung up on the zenith, which is hoisted gradually, and elsewhere supported within reach from the ground. Close to the ground, it is enlarged downwards, that is, outwards by annular closed rows of meshes, being alternatingly bright and dark hatched in FIG. 154. Thus, It is quite easy to mark and to allocate the custom-tailored components on site.

Then, the roofing of rows of pieces 227 of metal sheet or foil material can follow likewise row by row close to the ground. In the drawing, the roofing pieces 227 respectively comprise only two, locally also three meshes. Pieces lying side by side are distinct by different hatching patterns. So, you can recognize that the roofing pieces are arranged offset from ring to ring in order to allow durable, neat and tight overlaps having a T-shape. Within the area of a composed quadrilateral between four cut-seam curves, the pattern corresponds to a wall bond, while, within the area of the cut-seam curves themselves, it looks like a raking bond.

With the same pattern, also rigid metal sheets being overlapped in a load-bearing manner can be arranged for tanks or other thin-walled shells.

Also pneumatic structures can be made with this pattern if its borders are joined airtight to rigid fixed faces in the area of the plane openings and to the ground plane The applications being possible in building construction were already mentioned. This are light-weight constructions of steel and glass for grid shells or, for panel constructions, canted thin panels or thick composite panels having a light-weight core. Here, possible kinds of shell forms are: domes for a weekend home, an emergency shelter, or an observatory; complex shells for exhibition or station buildings, cushion-roofs or blobs for an interior courtyard or a winter garden; blobs for a climatic envelope of a conventional existing building, a glassed climatic building envelope for a multi-story building, a factory building, a sports hall.

The present invention also relates to fields of application beyond building construction. A shell according to the present invention can be applied likewise to the construction: of basins, subterranean tunnel vaults, of shells also of fiber reinforced concrete or textile reinforced concrete for cast shells of, for example, concrete, wood foam or foamglass; of glued shells of glass elements, of aluminium-foam or wood-foam plates; of metal sheet containers for bulk goods or metal sheet tanks under limited pressure; or for one-layered or composite-layered insulated envelopes of vehicles on earth, on water, in the air, or in outer space. So, it is easy to construct geometrically a bow of a ship or of an airplane. Also furnishings and designed objects such as seat-shells or lamp-shades are fields of application.

All shells according to the present invention that are geometrically constructed according to the described rules and the features resulting thereof, as well as pneumatic constructions, can be generated in virtual models in computer programs to generate surfaces of spatial forms for these fields of application.

The shell according to the present invention is applicable for air-supported halls, which, for example, are brought to shape by a cable net according to the present invention, or, to roofs of air-inflated pillows with the extents of a mesh.

LIST OF REFERENCE SIGNS WITH SPECIFIC TERMS

| reference-sign | element, object | first FIG. |
|---|---|---|
| 1 | blob | 1 |
| 3 | ordinary quad section | 1 |
| 4, 5, 6, 7 | corner point | 1 |
| 4 | array corner | 1 |
| 5, 6 | cut corner, - as a zenith, - as a bearing point | 1 |
| 8, 9 | array side, - along, - across | 1 |
| 10, 11 | array curve, - along, - across | 1 |
| 12 | quad-mesh | 1 |
| 14, 15 | array chord, - along, - across | 1 |
| 24 | sherd | 2 |
| 25 | cutting curve | 2 |
| 26 | cut-seam curve | 2 |
| 27 | cut-seam node | 2 |
| 28 | cutting chord | 2 |
| 29 | cut triangle | 2 |
| 30 | double sherd | 2 |
| 31 | seam mesh | 2 |
| 35 | sector | 2 |
| 36 | basic polygon | 3 |
| 38 | basic-polygon's side | 3 |
| 38 | basic-polygon's edge | 32 |
| 39 | reference-point, of the basic polygon | 3 |
| 40 | horizontal traverse line | 4 |
| 49 | cap | 6 |
| 52 | train-side curve | 8 |
| 56 | composed quadrilateral | 9 |
| 64 | train-seam line | 15 |
| 72 | reference-line, for a scale-trans Bohemian dome | 22 |
| 74 | orientation-line | 24 |
| 81 | by-zenith | 26 |
| 88 | tunnel-axis of a plane grid | 31 |
| 88 | tunnel-axis of a spatial grid | 52 |
| 90 | basic polyhedron | 32 |
| 91 | reference-point, of the basic polyhedron | 32 |
| 94 | spacediagonal | 32 |
| 103 | reference-line, for a scale-trans dome | 34 |
| 119 | infinite basic polyhedron | 44 |
| 121, 122 | grid of tunnel-axes, First-, Second- | 52 |
| 155 | node-axle | 80 |
| 156 | edge-face, at an array side | 80 |
| 157, 158 | edge-face, at an array curve - along, - across | 80 |

What is claimed is:

1. A double-curved load-bearing prefabricated shell, the shell comprising:

a plurality of triangular sherds, wherein each triangular sherd is formed as one part of a bisection of an ordinary quadrilateral section of a surface defining longitudinal and transverse directions, the ordinary quadrilateral section having four section sides and four corner points and a net of first and second arrays of curves intersecting at node points of a $C^1$-continuous surface so as to define a plurality of planar quadrangular meshes between chords of the first and second arrays of curves, with an equal number of quadrangular meshes being defined in both the longitudinal and transverse directions, at least respective chords of the first array of curves being parallel to one another, wherein a cutting curve connecting two diagonally opposing corner points and intersecting a plurality of node points bisects the ordinary quadrilateral section so as to form the triangular sherd bounded on one side by the cutting curve connecting two cut corners of the ordinary quadrilateral section and on two sides by array sides being two remained ones of the four section sides, the two array sides meeting at an array corner and each connecting to one cut corner of the sherd, wherein the cutting curve intersects a plurality of node points so as to bisect a plurality of meshes such that the triangular sherd includes a plurality of the unbisected quadrilateral meshes and a plurality of cut triangular meshes;

wherein two sherds are fused into a double sherd having a continuous surface transition at the respective identical cutting curves, which form a cut-seam curve such that respective node points of each of the respective cut triangular meshes are connected and that each of the cut triangular meshes are fused into a quadrangular seam mesh having four coplanar node points and two sets of non-parallel opposing chords; and wherein at least six of the plurality of sherds are disposed so as to meet at one point shared by one of their respective both cut corners so as to form a surface whose node points define a $C^1$-continuous surface.

2. A double-curved load-bearing prefabricated shell, the shell comprising:

a plurality of triangular sherds, wherein each triangular sherd is formed as one part of a bisection of an ordinary quadrilateral section of a surface defining longitudinal and transverse directions, the ordinary quadrilateral section having four section sides and four corner points and a net of first and second arrays of curves intersecting at node points of a $C^1$-continuous surface so as to define a plurality of planar quadrangular meshes between chords of the first and second arrays of curves, with an equal number of quadrangular meshes being defined in both the longitudinal and transverse directions, at least respective chords of the first array of curves being parallel to one another, wherein a cutting curve connecting two diagonally opposing corner points and intersecting a plurality of node points bisects the ordinary quadrilateral section so as to form the triangular sherd bounded on one side by the cutting curve connecting two cut corners of the ordinary quadrilateral section and on two sides by array sides being two remained ones of the four section sides, the two array sides meeting at an array corner and each connecting to one cut corner of the sherd, wherein the cutting curve intersects a plurality of node points so as to bisect a plurality of meshes such that the triangular sherd includes a plurality of the unbisected quadrilateral meshes and a plurality of cut triangular meshes;

wherein four of the plurality of sherds are disposed so that the respective array corners of each sherd meet at a single point and so as to form a composite quadrilateral section of surface whose node points define a $C^1$-continuous surface, said section bounded by the four respective cutting curves and the shared four cut corners of the respective sherds, wherein the four sherds form two pairs of two adjacent sherds sharing a respective array side and forming one curve with their remaining respective array sides, each array side of the curve being curved inversely to one another on each side of the common array corner;

wherein each of the two pairs includes one sherd having a respective cutting curve forming a train-side curve having an endpoint defined by a cut corner of the sherd, each respective train-side curve sharing the same endpoint and defining a plane that, at the endpoint, is tangential to a $C^1$-continuous surface defined by the node points of the sherd.

3. The shell as recited in claim 1, wherein four of the plurality of sherds are disposed so that the respective array corners of each sherd meet at a single point and so as to form a composite quadrilateral section of a surface whose node points define a $C^1$-continuous surface, said section bounded by the respective cutting curves and the shared four cut corners of the respective sherds.

4. The shell as recited in claim 1, wherein each of the three curved sides of sherds lies in a plane.

5. The shell as recited in claim 2, wherein the both train-side curves are straight-lined, and the array sides are plane, and wherein the two sherds having train-side curves are anticlastically curved.

6. The shell as recited in claim 4, wherein at least one of the cut-seam curves is a straight line.

7. The shell as recited in claim 4, wherein the three planes defining the respective curved sides of sherds are perpendicular to a ground plane of the shell, one of these three planes intersecting the ground plane so as to form respectively the edge of a basic polygon of the shell.

8. The shell as recited in claim 4, wherein the three planes defining the respective curved sides of sherds intersect in a single reference-point within an imagined convex basic polyhedron, and wherein the plane defining one array side respectively includes an edge of the basic polyhedron.

9. The shell as recited in claim 4, wherein one side of at least one double sherd has the shape either of a circle or of an elliptical arc.

10. The shell as recited in claim 2, wherein the chords and the face of each quadrangular mesh within one sherd in a pair of sherds adjacent on one array side has a counterpart within the other sherd of the pair, the counterpart oriented in parallel, wherein the counterpart is disposed in a sequence of seats mirrored on the shared array side.

11. The shell as recited in claim 6, wherein the chords and the face of each quadrangular mesh within one sherd in a pair of two sherds adjacent on one array side has a counterpart within the other sherd of the pair, the counterpart oriented in parallel, wherein the counterpart is disposed in a sequence of seats mirrored on the shared array side.

12. The shell as recited in claim 7, wherein the basic polygon is symmetric.

13. The shell as recited in claim 12, wherein the basic polygon is regular.

14. The shell recited in claim 7, wherein each sherd of a plurality of sherds has a centric scale-trans subdivision into meshes, wherein all curves of one of both crossing arrays of curves are located within planes intersecting in an imagined horizontal reference-line located within the plane of the array side ending at the top in a zenith perpendicular above a midpoint of the basic polygon.

15. The shell as recited in claim 4, wherein two array sides meeting at the zenith are disposed within a single plane.

16. The shell as recited in claim 4, wherein cut-seam curves of two double sherds meeting opposite at the zenith are located within a single plane.

17. The shell as recited in claim 4, wherein an array side of a double sherd on one hand and a cut-seam curve joining to one of the corners of this double sherd and being part of another double sherd on the other hand are located within a single plane.

18. The shell as recited in claim 7, wherein the one plane, of both planes of the array sides of each of these sherds, that doesn't include a polyhedron's edge but is penetrated by a basic-polygon's edge in a point dividing this edge into two parts is determined by the zenith and by an orientation-line, wherein the orientation-line departs from a reference-point within the basic polygon and intersects in a vanishing point out of this basic polygon the straight-lined extensions of two other edges of the basic polygon, each of them joining by one of it's endpoints to one of both endpoints of the basic-polygon's edge being crossed by this orientation-line in said dividing point.

19. The shell as recited in claim 8, wherein the one plane, of both planes of the array sides of each of these sherds, that doesn't include a polyhedron's edge but is penetrated by a basic-polygon's edge in a point dividing this edge into two parts is determined by the zenith and by an orientation-line, wherein the orientation-line departs from a reference-point within the basic polygon and intersects in a vanishing point out of this basic polygon the straight-lined extensions of two other edges of the basic polygon, each of them joining by one of it's endpoints to one of both endpoints of the basic-polygon's edge being crossed by this orientation-line in said dividing point.

20. The shell as recited in claim 8, wherein each double sherd of the shell is purely synclastic or purely anticlastic, wherein, as a part of a shell's opening's border-arc, one array side of the four array sides of a purely anticlastic double sherd being adjacent to a purely synclastic double sherd is located within a plane in parallel with a lateral polygon being adjacent to the basic polygon of the synclastic sherd and being the next to the anticlastic sherd.

21. The shell as recited in claim 8, wherein each double sherd of the shell is purely synclastic or purely anticlastic, wherein, as a part of a shell's opening's border-arc, one array side of the four array sides of a purely anticlastic double sherd being adjacent to a purely synclastic double sherd is located within a plane being perpendicular to the ground plane of the shell.

22. The shell as recited in claim 8, wherein the basic polyhedron is rotational-symmetric and mirror-symmetric, preferably a cube, otherwise another Platonic solid, an Archimedian solid or it's dual solid, as well as a geodesically subdivided solid, wherein the reference-point is located in the center-point of the polyhedron, and wherein, at least in parts, the double sherds and their seam meshes have the shape of a kite, whilst the array sides of each sherd of these double sherds meet at a right angle in the array corner, and wherein the line of intersection of the both array-side planes of each of these sherds is oriented normal to the plane being tangent to the curved surface locally at this array corner.

23. The shell as recited in claim 8, wherein each of these sherds has a centric scale-trans subdivision into meshes, wherein the curves, which include also the array side of one of the both crossing curves' arrays of each of these sherds, are within planes that intersect in an imagined straight reference-line that passes through the reference-point of the basic polyhedron and is parallel to a basic-polyhedron's edge lying within the plane of said array side.

24. The shell as recited in claim 8, wherein all chords of both surfaces of each thick-walled shell's piece are parallel to the chords of the virtual net of a shell without material thickness, and each outside node point is connected to the corresponding inside one by a connecting line, called "node-axle", that includes the original node point of the virtual net, and wherein two node-axles as well as an upper outside one and a lower inside one of the surfaces' chords bound each plane edge-face, and wherein, into several directions from both endpoints of a vertical node-axle that is located at the zenith, the parallel chords on both surfaces depart within the plane of an array side and end in an endpoint being the endpoint of another node-axle having, like all other node-axles within the plane of a respective array side, symmetric miter-angles .alpha. between adjacent coplanar edge-faces, whereby the orientation and length of the chords joining to them directly or indirectly and being parallel to each other on the outside and on the inside, as well as bounding on two sides the other edge-faces, is determined.

25. The shell as recited in claim 11, wherein:

two times, the one of both sherds adjacent on an array side is purely synclastic, and the other is purely anticlastic, and two times, three of the four side planes of a double sherd that includes this anticlastic sherd and a straight-lined cut-seam curve intersect in the center-point of the convex basic polyhedron of the adjacent synclastic sherd, whereat each of both anticlastic double sherds has to be considered as a portion of a continuous shell that includes the vertices of an infinite basic polyhedron and that divides infinite space into two rounded tunnel-systems whose one has, as central axes, the tunnel-axes of a First grid having equidistantly arranged grid-nodes and whose other rounded tunnel-system has the basic-polyhedron's center-point as a special one of the nodes of tunnel-axes as central axes of a Second axis-grid being congruent and dual to the First one as well as being interwoven with it, and wherein the fourth side plane of each of these both anticlastic double sherds does not include the center-point of the basic polyhedron but intersects two of the three aforementioned side planes in a node belonging to the First grid's tunnel-axes and being located out of the basic polyhedron.

26. The shell as recited in claim 1, wherein the shell is used in the field of building construction, of interior construction and of the furniture and equipment of buildings as well as in underground construction, the construction of containers and of envelopes of vehicles on the road, in the water, in the air and in outer space.

27. The shell as recited in claim 2, wherein the shell is used in the field of building construction, of interior construction and of the furniture and equipment of buildings as well as in underground construction.

28. The shell as recited in claim 1, wherein the shell comprises foil material for pneumatic structures such as air-supported halls or roofs of air-inflated pillows with the extents of a mesh.

29. The shell as recited in claim 2, wherein the shell comprises foil material for pneumatic structures such as air-supported halls or roofs of air-inflated pillows with the extents of a mesh.

* * * * *